US008779331B2

(12) United States Patent
Rothschild

(10) Patent No.: US 8,779,331 B2
(45) Date of Patent: Jul. 15, 2014

(54) AUTONOMOUS HEATED INTERLINING

(71) Applicant: Michael Benn Rothschild, London (GB)

(72) Inventor: Michael Benn Rothschild, London (GB)

(73) Assignee: Michael Benn Rothschild, London (GB)

( * ) Notice: Subject to any disclaimer, the term of this patent is extended or adjusted under 35 U.S.C. 154(b) by 0 days.

(21) Appl. No.: 13/675,792

(22) Filed: Nov. 13, 2012

(65) Prior Publication Data

US 2014/0131341 A1 May 15, 2014

(51) Int. Cl.
*H05B 1/00* (2006.01)
*H05B 1/02* (2006.01)

(52) U.S. Cl.
CPC ..... *H05B 1/0227* (2013.01)
USPC ..... 219/209

(58) Field of Classification Search
USPC ..... 219/209, 600–677, 211
See application file for complete search history.

(56) References Cited

U.S. PATENT DOCUMENTS

| | | | | |
|---|---|---|---|---|
| 7,816,632 | B2 * | 10/2010 | Bourke et al. | 219/635 |
| 2008/0083720 | A1 * | 4/2008 | Gentile et al. | 219/211 |
| 2010/0107657 | A1 * | 5/2010 | Vistakula | 62/3.5 |
| 2011/0215086 | A1 | 9/2011 | Yeh | |

FOREIGN PATENT DOCUMENTS

| | | |
|---|---|---|
| CA | 2007128129 | 11/2007 |
| EP | 0612291 | * 4/1996 |

* cited by examiner

*Primary Examiner* — Dana Ross
*Assistant Examiner* — Joseph Iskra

(57) ABSTRACT

A autonomous heated interlining including embedded prismatic power cells, microcontroller with WiFi and Bluetooth connectivity and wireless inductive charging. The interlining offers a complete and simple integrated heating solution for any structured lined jacket, with wireless control and charging. The interlining heating system offers both primary and secondary heating channels for the inbuilt redundancy feature. The autonomous heated interlining offers digital monitoring and wireless control with automatic heating redundancy management in case of primary or secondary heating channel failures, thus always ensuring heating output for the wearer. The wearer operates the autonomous heated interlining from his/her mobile telephone, tablet/iPad® or laptop/pc with a web browser or simple dedicated application wirelessly.

45 Claims, 15 Drawing Sheets

AUTONOMOUS HEATED INTERLINING

CROSS-REFERENCE TO RELATED APPLICATIONS

Not Applicable

STATEMENT REGARDING FEDERALLY SPONSORED RESEARCH OR DEVELOPMENT

Not Applicable

REFERENCE TO A SEQUENCE LISTING, A TABLE, OR A COMPUTER PROGRAM LISTING COMPACT DISC APPENDIX

Not Applicable

BACKGROUND OF THE INVENTION

Currently, heated garments, which are presently available, are produced within a specific garment type; often these garments are basic anoraks, body warmers and motorcycle type wear. These standard type garments are often produced for specific markets and purposes, such as motorcycle use. The garment either has to be plugged into a vehicle's power supply; alternatively, power is supplied via standard type alkaline batteries contained within battery holders that are either positioned in the wearer's pockets or in a pouch accessible in the lining of the garment. The wearer normally controls the heating output of the garment from a separate control box with switches, which is generally located within an external pocket of the garment. This control box is often quite large and heavy, with sizeable cables coming into and out of the control box, which may become tangle. The controllability of the garment is often limited to selecting one of several heating levels and in some cases more basic control is purely limited to either having the garment switched either completely on or off. Generally, due to the limited capacity of the batteries, particularly in the case of alkaline powered heated garments, heating output wattage is limited and running time is often very short. A mixture of these problems often limits the overall usefulness and effectiveness of the heated garment in keeping the wearer warm for any prolong period of time at a reasonable heat level.

The present invention aims to solve at least some of the above problems.

BRIEF SUMMARY OF THE INVENTION

In an attempt to overcome some of the above limitations, the present invention offers a complete autonomous heating solution that can be embedded (fitted within) in almost an unlimited type of structured garments with a lining. The autonomous heated interlining is powered by embedded wirelessly rechargeable power cells, which the wearer never needs to manipulate in any manner. Simply placing the garment either on a charging hanger or in a charging cabinet recharges the power cells; simply sitting in a specially designed wireless charging seat can also recharge the garment. The wireless inductive charging method is both simple to operate with virtually no user intervention and is completely safe as it operates by using lower power magnetic waves. The garment charging cycle stops automatically, and provided the garment is placed on the special charging hanger the garment should always be charged and ready for immediate use.

The present invention is controlled wirelessly either from the wearer's mobile telephone or laptop/pc/tablet/iPad® via WiFi® or Bluetooth® connection using either a web browser or specifically written control application (Mobile App.) The wearer does not have the extra weight and inconvenience of using a separate control device to control the heating output of the invention; the wearer's mobile telephone or laptop/pc/tablet/iPad® can be utilised, which is often being carried anyway, thus avoiding the extra weight and inconvenience/complications of the control box and its associated cables which often can become tangled. The complete process of controlling the embedded autonomous heated interlining is simplified as it is controlled via dedicated mobile application, either on a mobile telephone or tablet device. The wearer/operator does not have attempt to control the heating of the garment on an unfamiliar device, instead he or she can operate the heated garment with the same convenience and ease as using any other mobile application on their mobile telephone or tablet. This method of operation also allows for possible future updates to increase functionality and performance, which can easily be delivered as application updates.

The autonomous heated interlining can be embedded within a wide range and type of garments from working garments such as High-Visibility Jacket 60 that conform to ANSI/ISEA 107-2010 Class 1, 2 or 3 specification (or current equivalent thereof) all the way through to evening wear such as a tuxedo jacket 65. A wide range of garment types within these two broad examples could have the invention embedded, such as fashionable uni-sex casual jacket 64, ski jackets 66 and any number of other types of lined jackets. The autonomous heated interlining can easily be embedded into children's garments, which can be controlled wirelessly from a mobile telephone or tablet device either directly by the child or a supervising adult.

The invention offers a fully monitored redundancy system that makes it distinctly suitable for medical and career wear embodiments; where complete guaranteed performance is of paramount importance. The automatic redundancy system ensures that if the autonomous heated interlining experiences a partial heating system failure, it will attempt to increase its remaining functioning system's outputs in order ensure that wearer continues to remain warm. The system will continue to monitor the current problem and monitor for further anomalies and make adjustments as necessary in real time without the intervention of the wearer/operator. The wearer/operator will be advised of any problems using the bi-directional wireless communication system that is embedded within the invention. The wearer will be notified either on his or her mobile telephone or on laptop/pc/tablet/iPad®, whichever device is currently being used to control the autonomous heated interlining.

The invention offers the ability to control heating output in an almost continuously variable manner from less than 1% heating level all the way through to 100% heating. The wearer can also control heating levels in a regional manner, thus if he or she wishes more heat output on the back of the garment, then output can be increased in this region specifically whilst maintaining lower heating levels on wearer's front left or right region as required. The system also ensures, if required, a virtually balanced output throughout all the regions can be maintained. The embedded electronic controller monitors and drives the different heating regions individually to ensure a complete uniformity of heat throughout the garment. The invention monitors heating levels and outputs throughout the autonomous heated interlining with a plurality of embedded digital temperature sensors that are interfaced to the Microcontroller.

One possible embodiment, utilising the embedded Lithium Ion power cells, allows the invention to produce a considerable heat output in the region of eight-five to one-hundred watts of total heating output. This considerable level of output ensures that a wearer can be kept warm even in extreme cold conditions with ambient temperatures well below 0 degrees Celsius, these conditions would normally lead to hypothermia if continued exposure existed for a prolonged period. The embedded Lithium Ion power cells also have an extremely high energy capacity, thus allowing the autonomous heated interlining to run for long periods of time between recharges, standard Alkaline cells would offer only a fraction of the operational heating time. The Lithium Ion or Ext Lithium Ion chemistry of the power cells is also able to maintain its high output level (voltage and current) in extreme cold conditions, which again makes it highly suitable for use in the autonomous heated interlining.

DETAILED DESCRIPTION OF THE INVENTION

Figure 1:
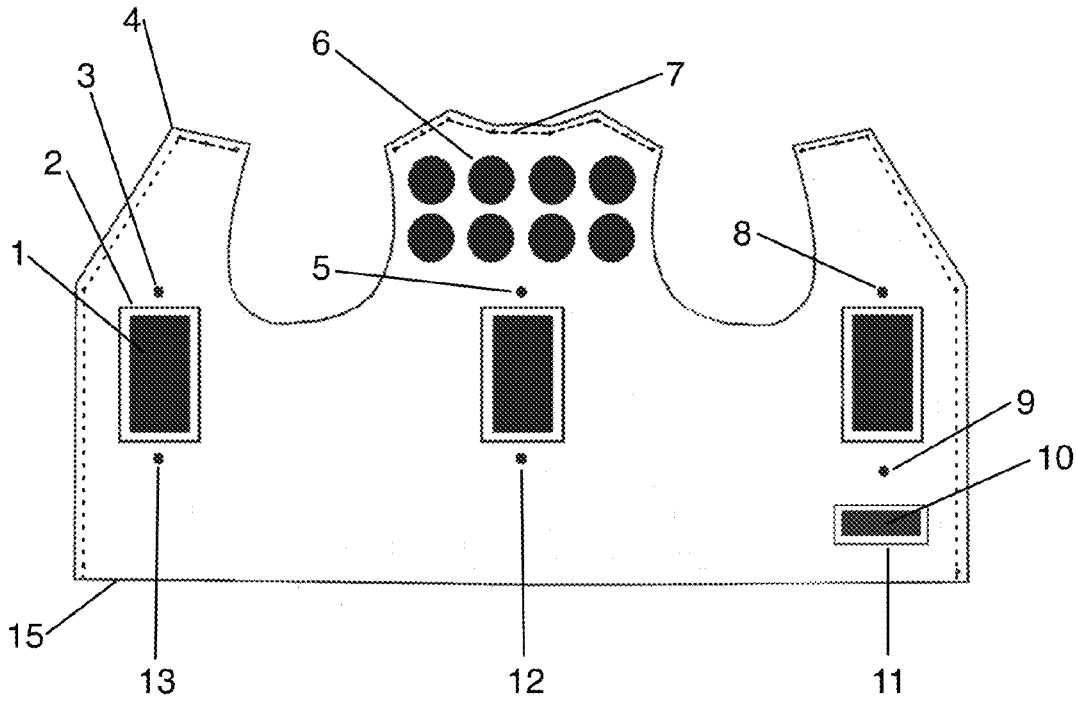
FIG. 1 shows the main components of the autonomous interlining excluding the heating channels for clarity.

An example of the invention will now be described by referring to the accompanying drawings:

FIG. 1 shows the basic structure of the autonomous, self-powered heated interlining 4. The components shown in the figure will be fully detailed in the description that follows. The figure shows the integrated Prismatic Lithium Ion Power Cells 1 (or alternative chemistry and/or cell type), the power cell patches 2, the digital temperature sensors 3, 5, 8, 9, 12, 13 the wireless inductive charging coils 6, the sewing line 7 used to sew the interlining into the garment and integrated (embedded) microcontroller controller 10 incorporating the WiFi® 802.11b/g Serial Module and Bluetooth® Module version 2.1 with integrated UART (SSP/HCl) interface. The horizontal base line 15 of the interlining is not sewn along; it is left unattached to the garment it is being embedded within. The base material of the autonomous heated interlining 4 can be produced from a felt type fabric or similar material with the same basic properties.

Figure 2:
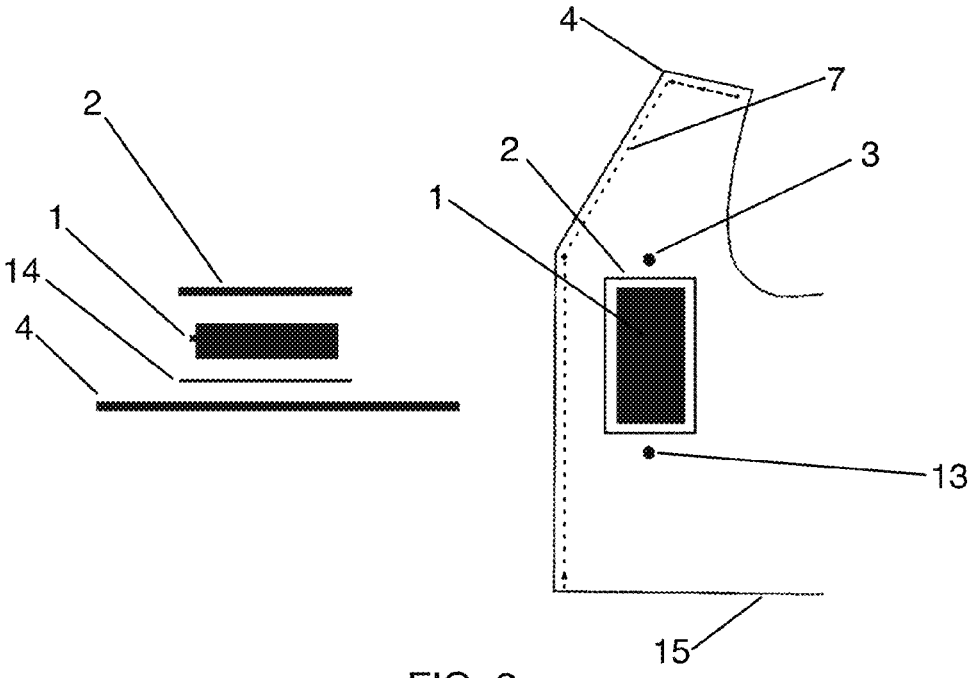
FIG. 2 shows an enlarged/exploded view of the embedded prismatic power cell 1 with its insulating Rayon material 14 and pouch 2.

FIG. 2 incorporates an exploded view of the integrated Lithium Ion Prismatic Pouch Cell (Nanophosphate or similar type) 1, with the heat reflective cotton lining 14 pouch 2; embedded within the autonomous, self-powered heated interlining 4. The sewing line 7 can clearly be identified along the front edge and up to the shoulder seam.

Figure 3:
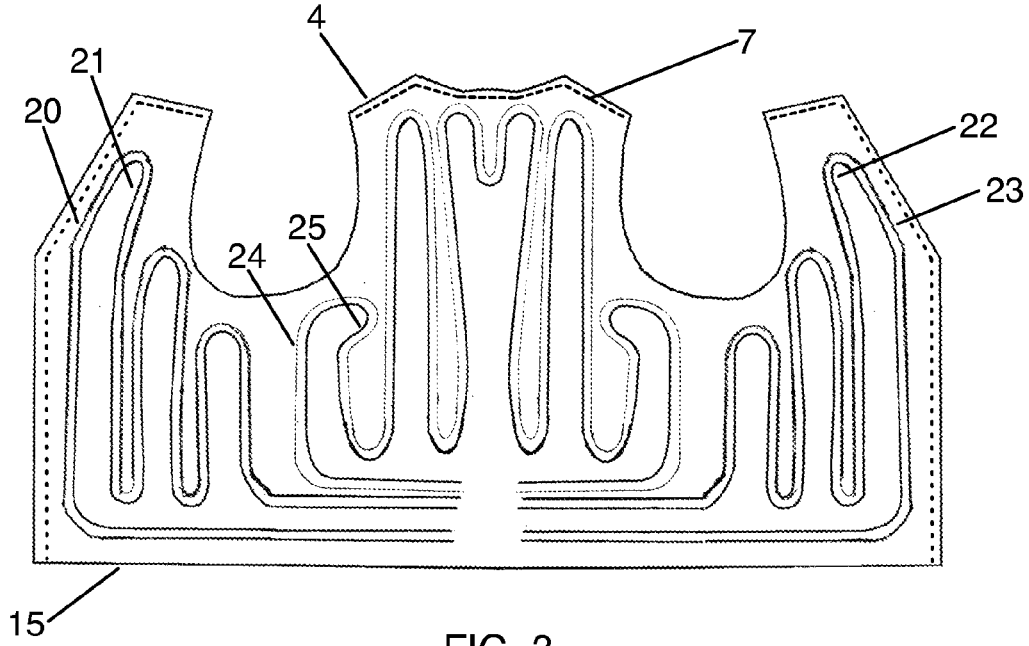
FIG. 3 shows the complete layout of the primary and secondary heating channels/regions.

FIG. 3 shows the detailed layout of the Primary and Secondary heating channels for each of the regions 20,21-24,25 and 23,22 respectively sewn on the autonomous, self-powered heated interlining 4. The particular embodiment depicted shows three heating regions with Primary and Secondary channels in each region clearly identified. A variety of alternative region numbers with Primary and Secondary heating channels could be implemented as required. The complete sewing line 7 is depicted, it should be noted that sewing around the armholes is not required in this particular embodiment.

Figure 4:
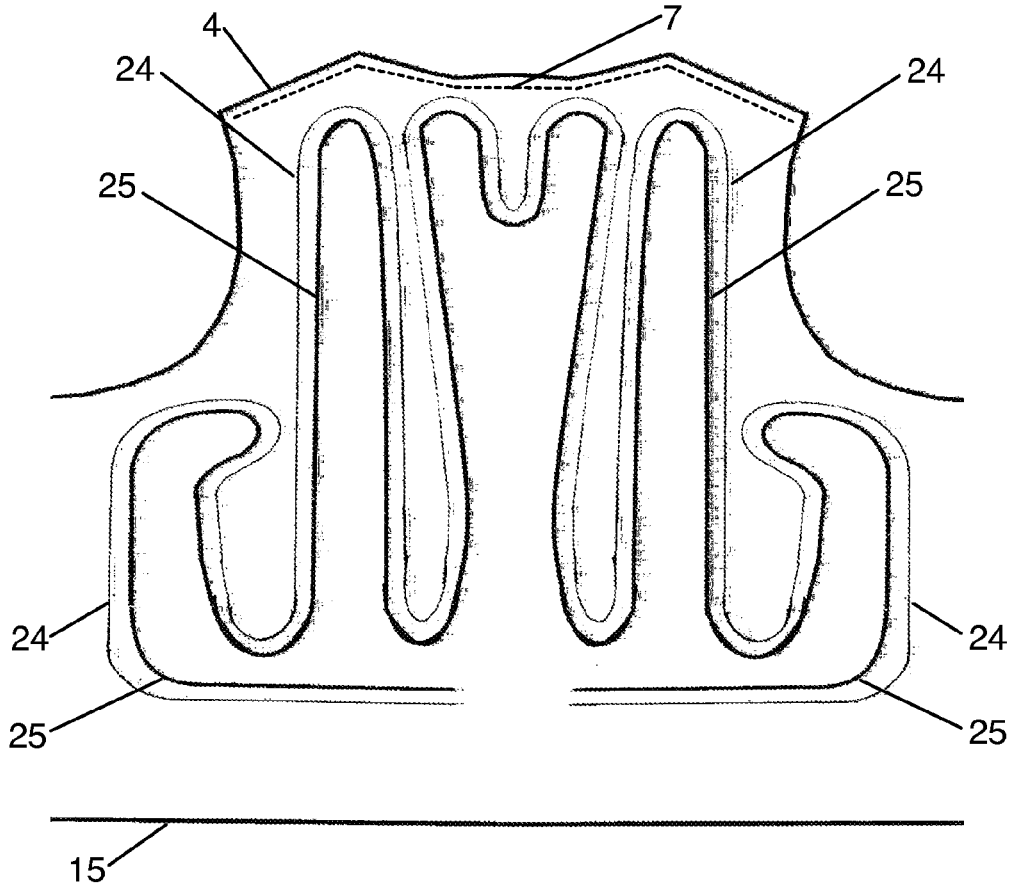
FIG. 4 shows an enlarged view of the central back section of the autonomous heated interlining.

FIG. 4 shows an enlarged view of the back Primary and Secondary heating channels 24 and 25 respectively located in region "B" in this particular embodiment of the autonomous, self-powered heated interlining 4. The sewing line 7 along the shoulder seams and back neck facing can be clearly identified.

Figure 5:
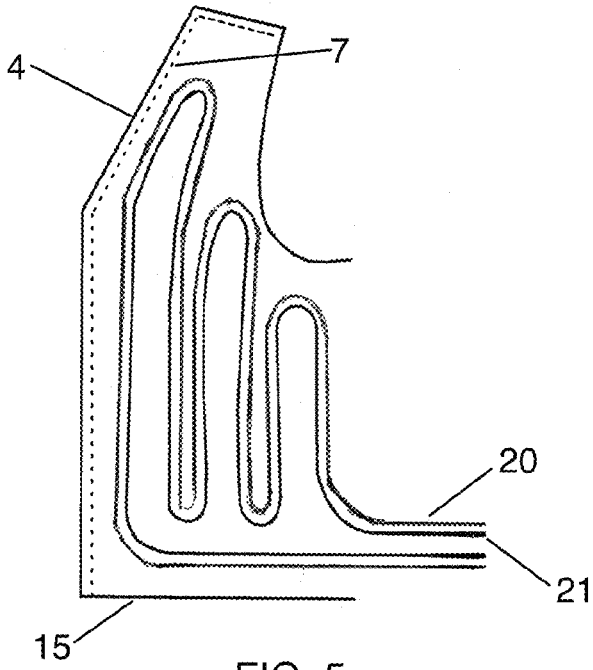
FIG. 5 shows a detailed view of the primary and secondary heating channels 20 and 21 on the left side (wearer's right) of the autonomous heated interlining.

FIG. 5 shows the front region "A" Primary and Secondary heating channels 20 and 21 respectively of the autonomous, self-powered heated interlining 4. The sewing line 7 along the front edge (sewn to garment's facing) and shoulder seam is clearly identified.

Figure 6:
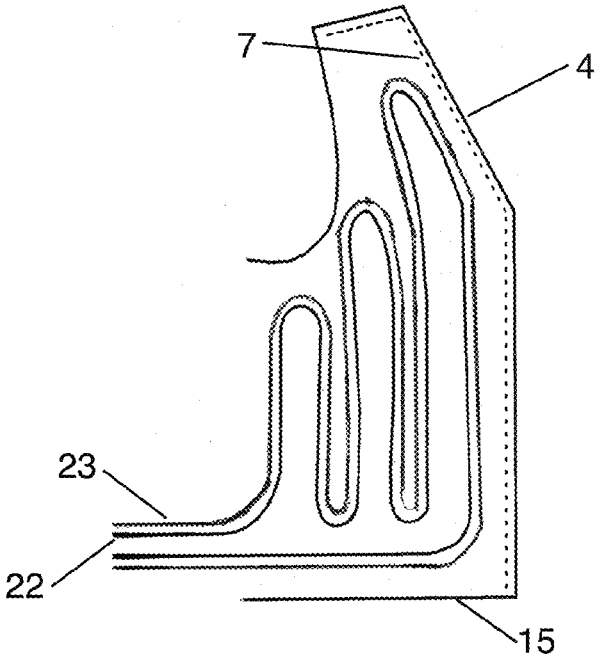
FIG. 6 shows a detailed view of the primary and secondary heating channels 23 and 22 on the right side (wearer's left) of the autonomous heated interlining.

FIG. 6 shows the front region "C" Primary and Secondary heating channels 23 and 22 respectively of the autonomous, self-powered heated interlining 4. The sewing line 7 along the shoulder seam and front edge (sewn to garment's facing) is clearly identified.

Figure 7:
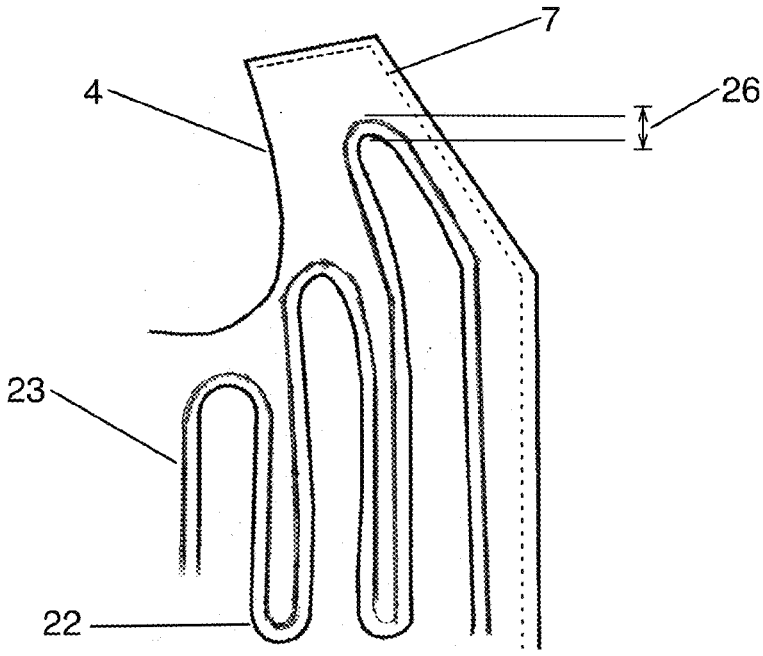
FIG. 7 shows a detailed view of the spacing 26 between the primary and secondary heating channels on the right side (wearer's left) of the autonomous heated interlining.

FIG. 7 shows an enlarged view of front region "C" Primary and Secondary channels 23 and 22 respectively. This figure illustrates a standard length autonomous interlining 4 with an approximate heating channel spacing 26 in the region of 1 cm to 3 cm (0.39 inches to 1.2 inches) between the Primary and Secondary heating channels in this particular embodiment. A wide variety of alternative spacings can be implemented as required by the nature of the garment to be fitted with the autonomous interlining 4. The sewing line 7 along the shoulder seam and front edge (sewn to garment's facing) is clearly identified.

Figure 8:
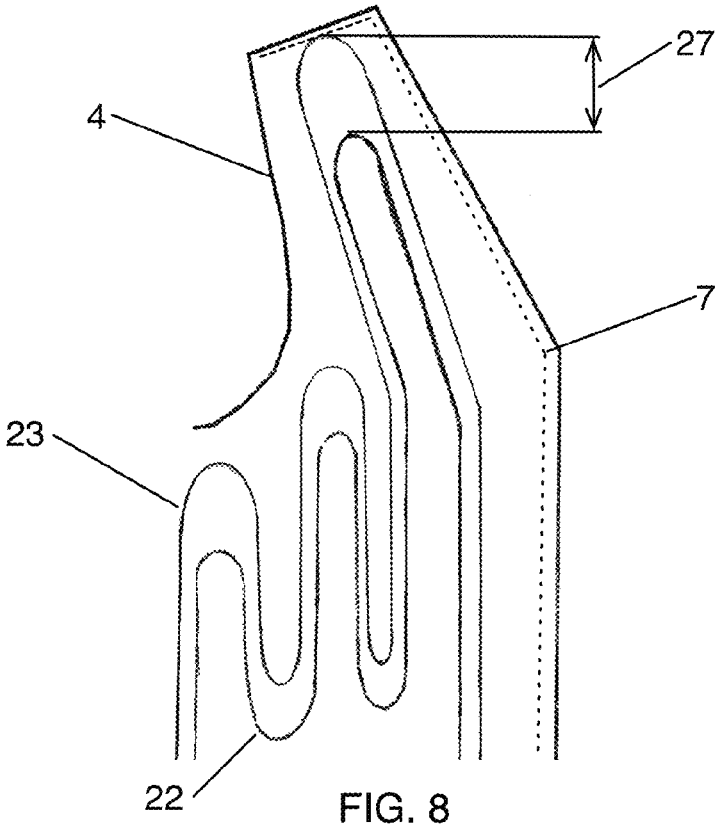
FIG. 8 shows an alternate embodiment of the primary and secondary heating channels on the right side (wearer's left) of the autonomous heated interlining with increased spacing 27 between the primary and secondary heating channels.

FIG. 8 shows an enlarged view of front region "C" Primary and Secondary channels 23 and 22 respectively. This shows a long length (fitting) autonomous interlining 4 with an approximate heating channel gap 27 in the region of 5 cm to 7 cm (2 inches to 2.75 inches) between the Primary and Secondary heating channels for this longer fitting embodiment. The sewing line 7 along the shoulder seam and front edge (sewn to garment's facing) is clearly identified.

Figure 9:
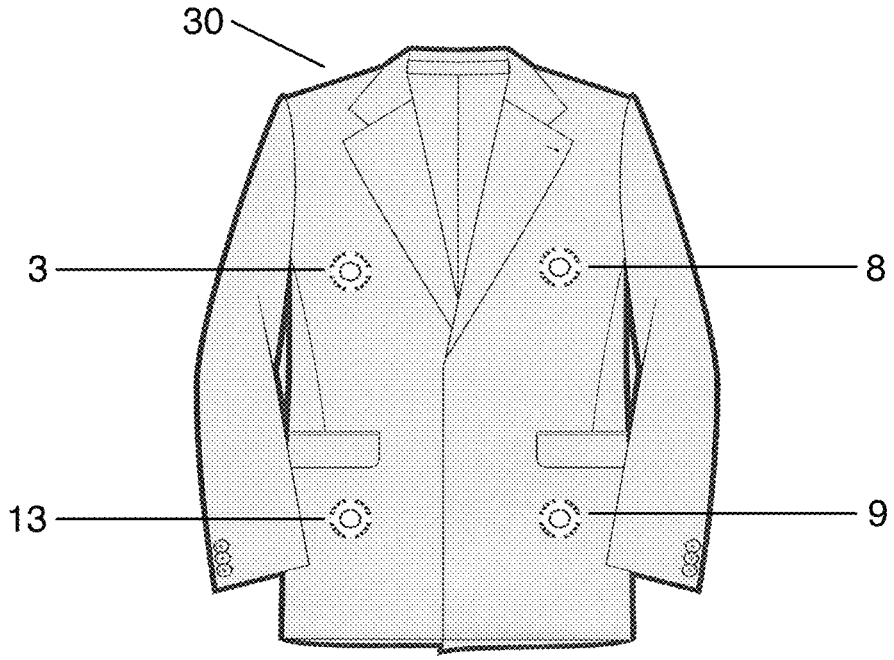
FIG. 9 shows one embodiment of the autonomous heated interlining embedded within a garment depicting the positioning of the plurality of digital temperature sensors (3, 8, 9 and 13) in the different heating regions on the front of the garment.

FIG. 9 shows one embodiment of a sleeved garment 30 fitted with the autonomous self-powered heated interlining 4. The circles shown on the wearer's front left 8-9 and wearer's front right 3-13 of this particular embodiment represent the approximate positions of the digital temperature sensors that feed regional temperature information to the integrated embedded microcontroller controller 10 for heating level control and adjustment of these particular regions.

Figure 10:
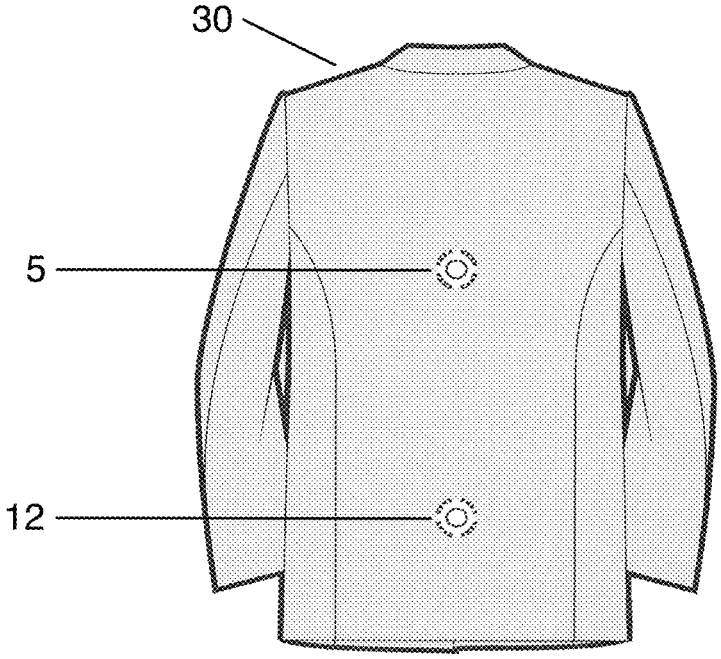
FIG. 10 shows one embodiment of the autonomous heated interlining embedded within a garment depicting the positioning of the plurality of digital temperature sensors (5 and 12) in the different heating regions on the back of the garment.

FIG. 10 shows one embodiment of a sleeved garment fitted with the autonomous self-powered heated interlining 4. The circles shown 5-12 of this particular embodiment represent the approximate positions of the digital temperature sensors in the upper 5 and lower 12 back heated regions of the garment. The sensors feed regional temperature information of these positions to the integrated embedded microcontroller controller 10 for heating level control and adjustment of these particular regions.

Figure 11:
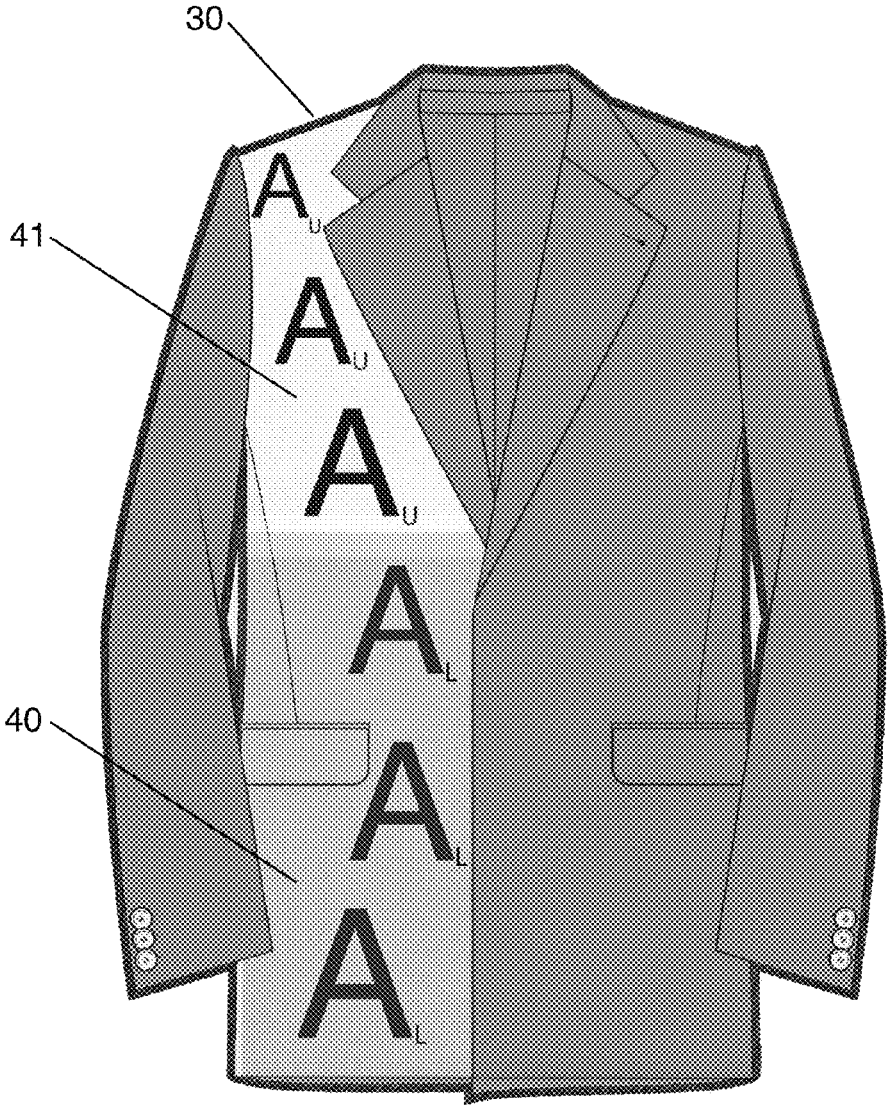
FIG. 11 shows the front view of one embodiment of the autonomous heated interlining depicting heating region "A" that is heated by the primary and secondary heating channels within that particular region (wearer's right).

FIG. 11 shows an enlarged view of one particular embodiment of the autonomous, self-powered heated interlining 4 incorporated (embedded) within a sleeved garment 30. Heating region "A" is shown split into an upper Primary region "AU" 41 and a lower Secondary region "AL" 40. These regions being located on the wearer's front right of the garment 30 embodiment, as shown in this particular representation. The two regions "Au" and "AL" temperatures are monitored and reported by the embedded digital temperature sensors shown in FIG. 11 numbered 3 and 13 respectively. The individual temperature information from both sensors is digitally transferred to the embedded Microcontroller 10. The Microcontroller 10 then independently controls the heating of the regions "Au" and "AL" as instructed and programmed by the wearer and/or operator of the heated garment.

Figure 12:
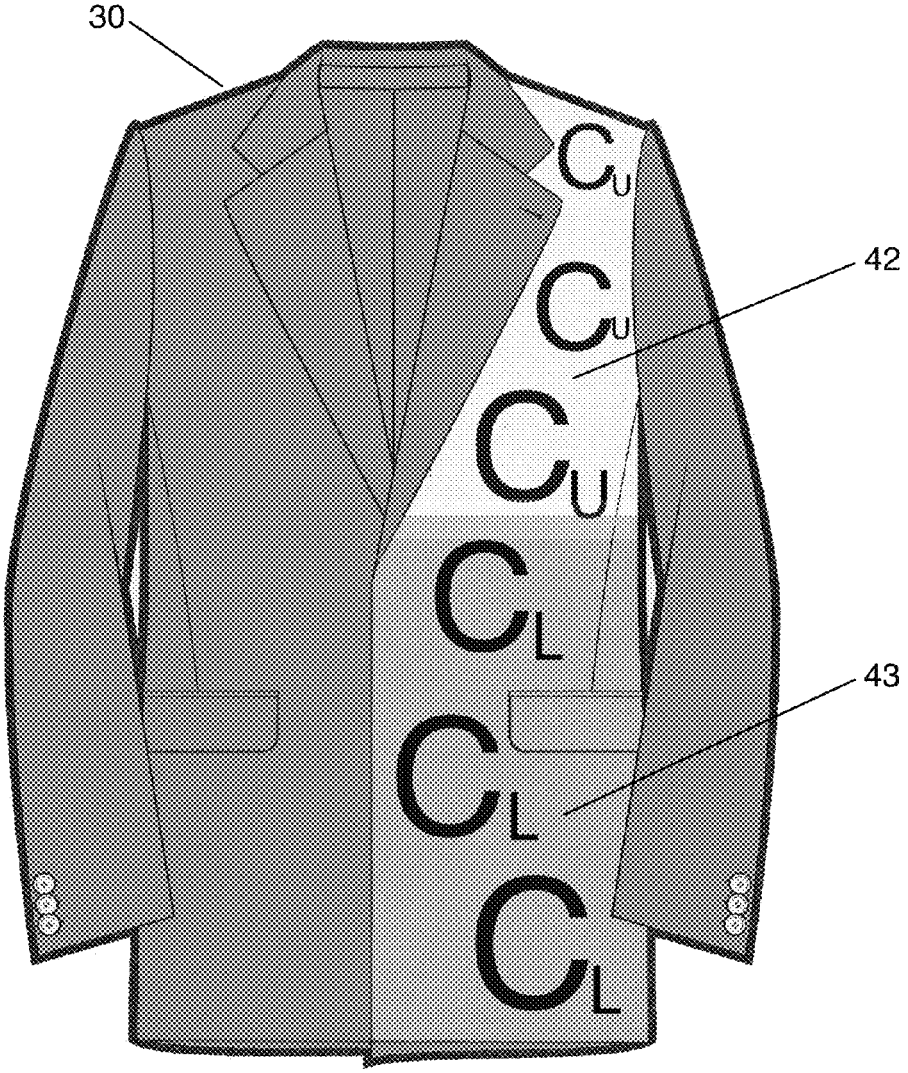
FIG. 12 shows the front view of one embodiment of the autonomous heated interlining depicting heating region "C" that is heated by the primary and secondary heating channels within that particular region (wearer's left).

FIG. 12 shows an enlarged view of one particular embodiment of the autonomous, self-powered heated interlining 4 incorporated (embedded) within a sleeved garment 30. Heating region "C" is shown split into an upper Primary region "CU" 42 and a lower Secondary region "CL" 43. These regions being located on the wearer's front left of the garment 30 embodiment, as shown in this particular representation. The two regions "Cu" and "CL" temperatures are monitored and reported by the embedded digital temperature sensors shown in FIG. 11 numbered 8 and 9 respectively. The individual temperature information from both sensors is digitally transferred to the embedded Microcontroller 10. The embedded Microcontroller 10 then independently controls the heating of the regions "Cu" 42 and "CL" 43 as instructed and programmed by the wearer and/or operator of the heated garment.

Figure 13:
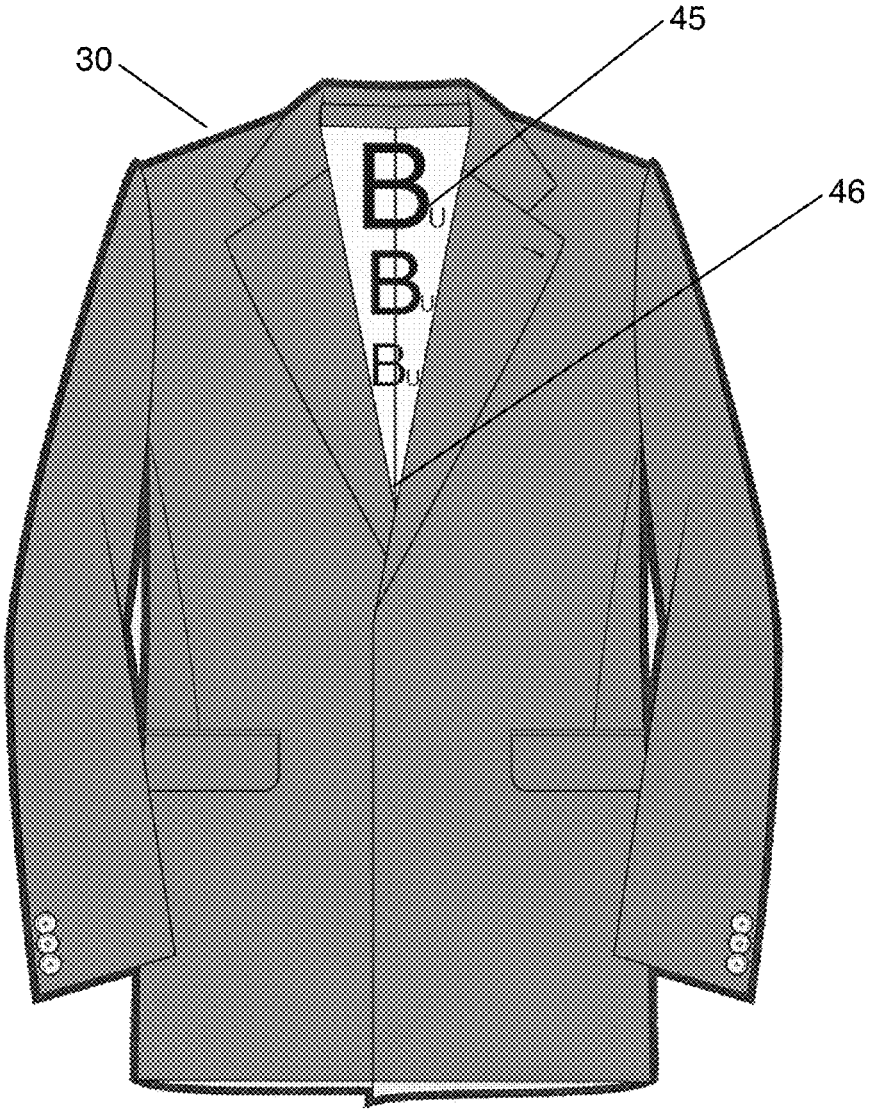
FIG. 13 shows the front view of one embodiment of the autonomous heated interlining depicting heating region "B" that is heated by the primary and secondary heating channels within that particular region (wearer's back).

FIG. 13 shows an enlarged view of one particular embodiment of the autonomous, self-powered heated interlining 4 incorporated (embedded) in a sleeved garment 30. Heating region "B" is shown divided into an upper Primary region "BU" 45 and a lower Secondary region "BL" 46. These regions being located on the back (internal lining) of the garment 30 in this particular embodiment shown heating the internal back. The two regions, Primary BU" 45 and a lower Secondary region "BL" 46 temperatures are monitored and reported by the embedded digital temperature sensors 5 and 12 respectively and shown in FIG. 12. The individual temperature information from both sensors is digitally transferred to the embedded Microcontroller 10. The Microcontroller 10 then independently controls the heating of the regions "Bu" 45 and "BL" 46 as instructed and programmed by the wearer and/or operator of the heated garment.

Figure 14:
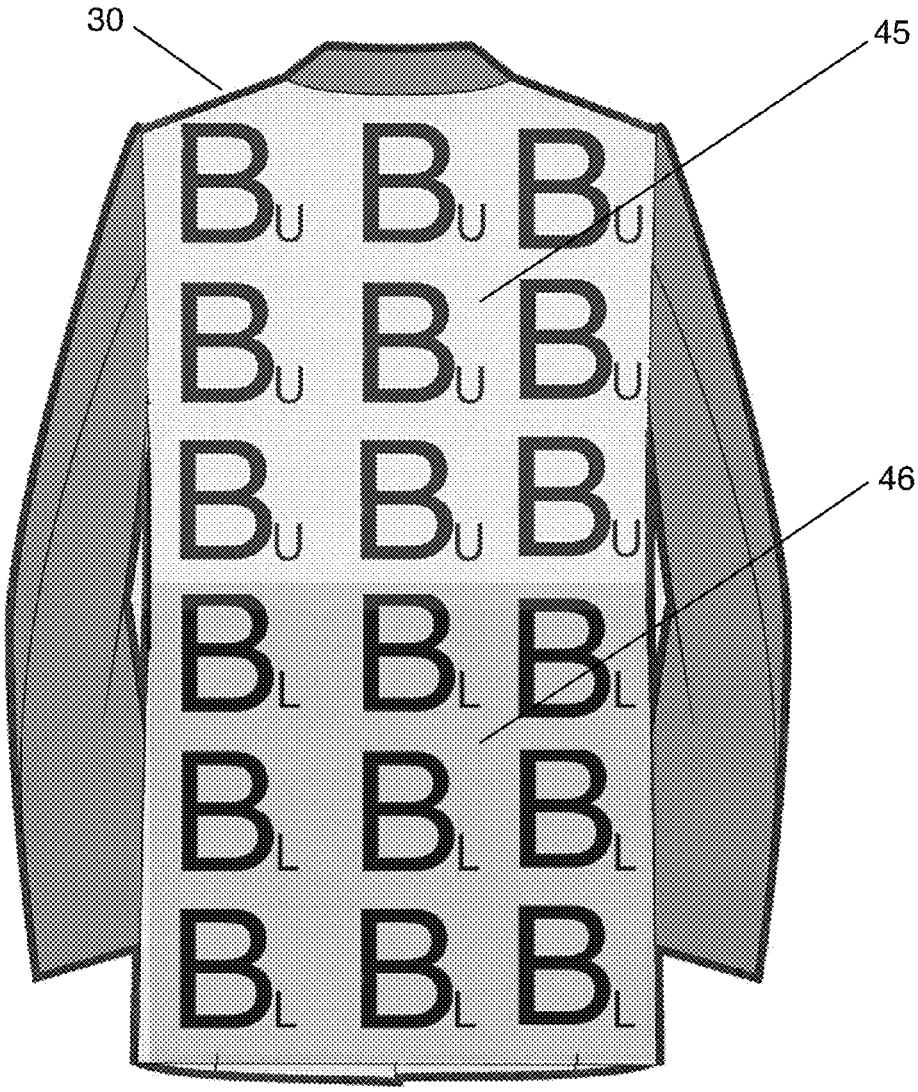
FIG. 14 shows the back view of one embodiment of the autonomous heated interlining depicting heating region "B" that is heated by the primary and secondary heating channels within that particular region (wearer's back).

FIG. 14 shows an enlarged back view of one particular embodiment of the autonomous, self-powered heated interlining 4 incorporated (embedded) in a sleeved garment 30. Heating region "B" is shown split into an upper Primary region "BU" 45 and a lower Secondary region "BL" 46. These regions are located on the back of the garment as shown in this particular representation; from the back view of the garment. The heating channels outputs are produced on the internal back (back lining) of the garment in this particular embodiment shown; so as to warm the wearer's back.

Figure 15:
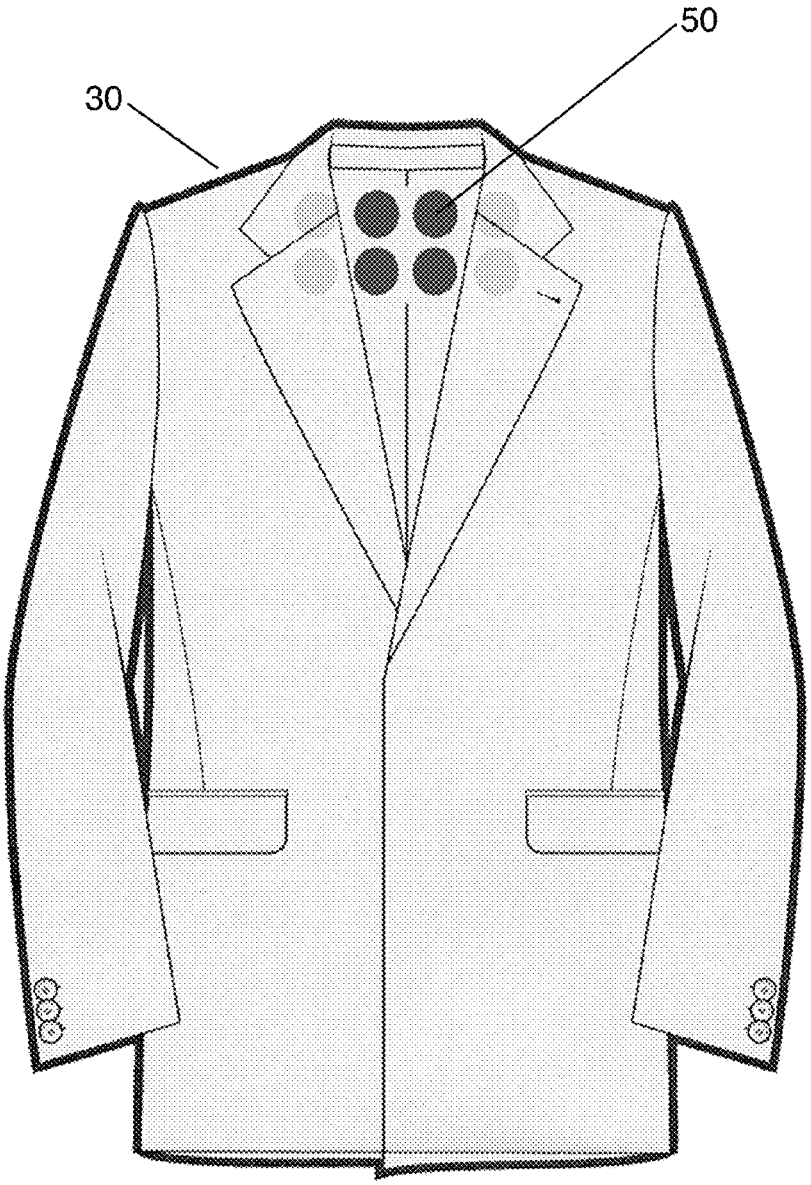
FIG. 15 shows the front view of one embodiment of the autonomous heated interlining depicting the positioning of the embedded inductive charging coils 50 concealed within the garment lining.

FIG. 15 shows an enlarged view of one particular embodiment of the autonomous, self-powered heating interlining 4 incorporated (embedded) in a sleeved garment 30. The collection of inductive charging coils 50 are shown in this embodiment embedded in the collar region. This particular embodiment shows eight inductive charging coils embedded within the back of the garment; an alternative number (greater or smaller) of inductive coils could be embedded within this approximate area subject to the particular embodiment's requirements. The size (diameter) of the planar inductive charging coils may also vary subject to the required power/charging specifications.

Figure 16:
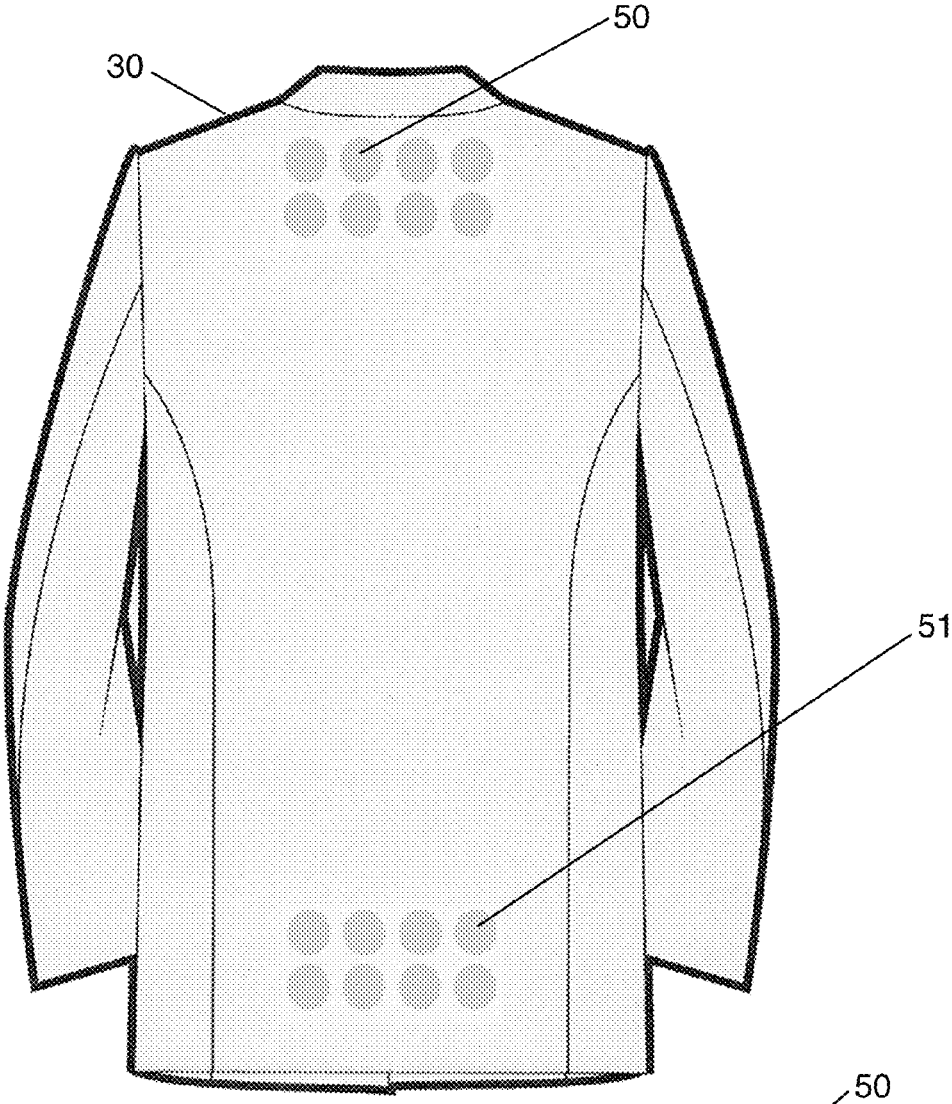
FIG. 16 shows the back view of one embodiment of the autonomous heated interlining depicting a plurality of possible positions of the embedded inductive charging coils (50 and 51) concealed within the garment back lining, also depicted (inset) is a complete layout of the autonomous heated interlining showing a plurality of inductive charging coils (50 and 51) amongst its other embedded components.
Figure 16:
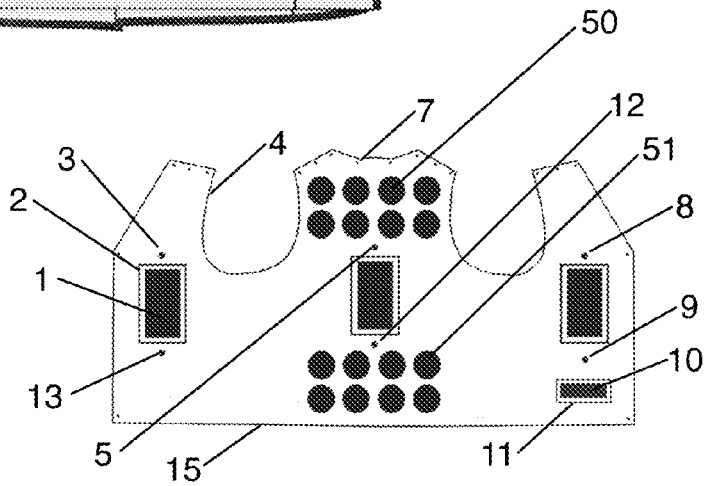

FIG. 16 shows the reversed view of FIG. 15. The collection of eight inductive charging coils 50 can be clearly seen embedded in the back collar region in this embodiment. This particular embodiment shows the eight inductive charging coils 50 in one possible position. The eight inductive coils can alternatively be positioned towards the hem of the jacket, as depicted by 51. The total number, location and size (diameter) of embedded inductive charging coils may vary as required by the specification of the embodiment, as previously stated in the description of FIG. 15 above. The sewing line 7 in the inset diagram is represented by a number of small dots. A detailed view of the complete sewing line 7 is shown in FIGS. 1 and 3.

Figure 17:
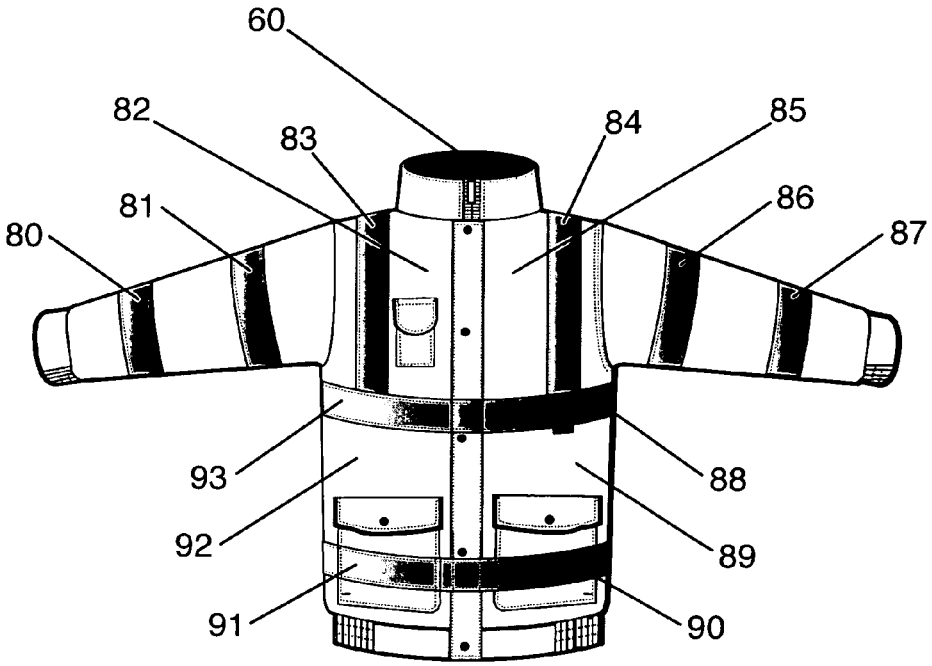
FIG. 17 shows one possible embodiment of the autonomous heated interlining embedded within a High-Visibility garment conforming to ANSI/ISEA 107-2010 Class 1, 2 or 3 or current equivalent thereof (front view).

FIG. 17 shows an alternate embodiment of the autonomous, self-powered heated interlining 4 incorporated (embedded) in a High-Visibility garment 60 that conforms to ANSI/ISEA 107-2010 Class 1, 2 or 3 subject to the number of reflective stripes 80, 81, 83, 84, 86, 87, 88, 91 and 90. This figure shows the front view of the High-Visibility garment with a number of reflective stripes both vertical and horizontal applied. Primary heating regions 82 and 85 along with Secondary heating regions 92 and 89 are depicted on the front of this garment embodiment.

Figure 18:
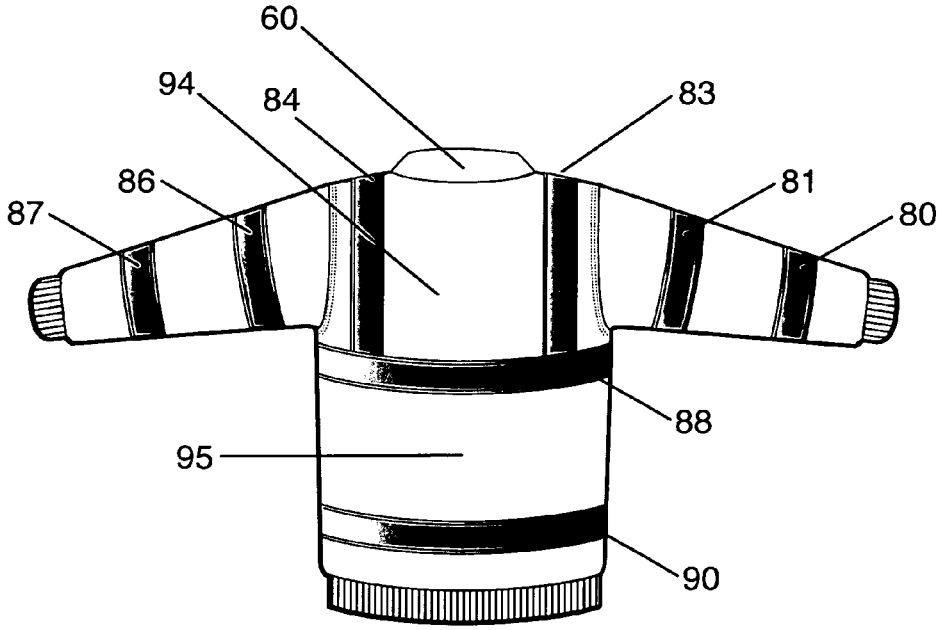
FIG. 18 shows one possible embodiment of the autonomous heated interlining embedded within a High-Visibility garment conforming to ANSI/ISEA 107-2010 Class 1, 2 or 3 or current equivalent thereof (back view).
Figure 19:
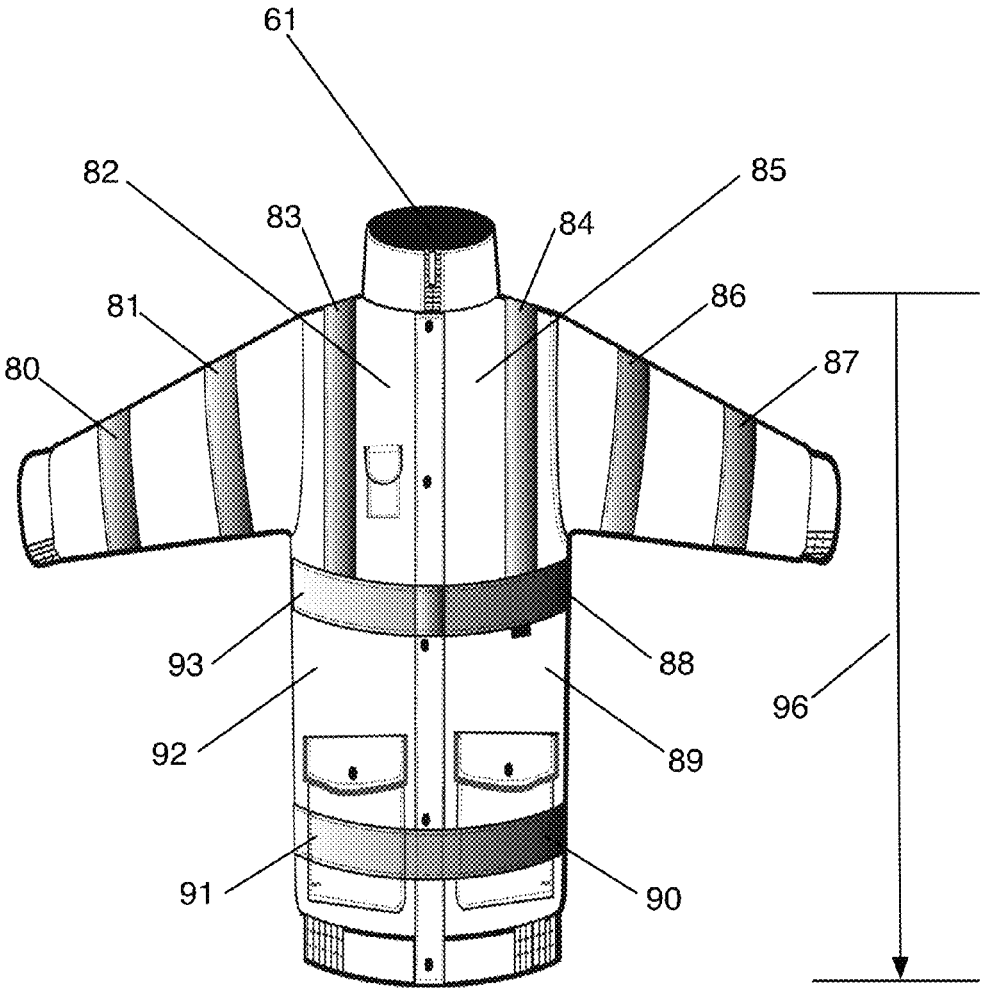
FIG. 19 shows one possible embodiment of the autonomous heated interlining embedded within a long length High-Visibility garment conforming to ANSI/ISEA 107-2010 Class 1, 2 or 3 or current equivalent thereof (front view).

FIG. 18 shows the back of garment 60 as depicted in FIG. 19; thus showing the rear of a High-Visibility garment 60 which conforms to ANSI/ISEA 107-2010 Class 1, 2 or 3 subject to the number of reflective stripes 87, 86, 84, 83, 81, 80, 88 and 90. The Primary back heating channel area 94 is clearly represented, and the Secondary heating channel area 95 can be seen in this particular embodiment.

FIG. 19 shows a longer length High-Visibility garment embodiment 61 with the autonomous, self powered heated interlining 4 incorporated (embedded) within it. This garment would conform to ANSI/ISEA 107-2010 Class 1, 2 or 3 subject to the number of reflective stripes 80, 81, 83, 84, 86, 87, 88, 91 and 90. This particular embodiment is a long fitting garment. The back length 96 measures on this embodiment approximately 36 to 38 inches in length (91.5 cm to 96.5 cm approximately). The longer implementation of heating channel spacing 27 as depicted in FIG. 8 would be required to implement the heating channels correctly for this embodiment. The standard length fitting embodiment would have a back length 96 measurement in the region of 30 to 31 inches in length (76.2 cm to 78.75 cm approximately) and require a smaller heating channel spacing 26 as depicted in FIG. 7.

Figure 20:
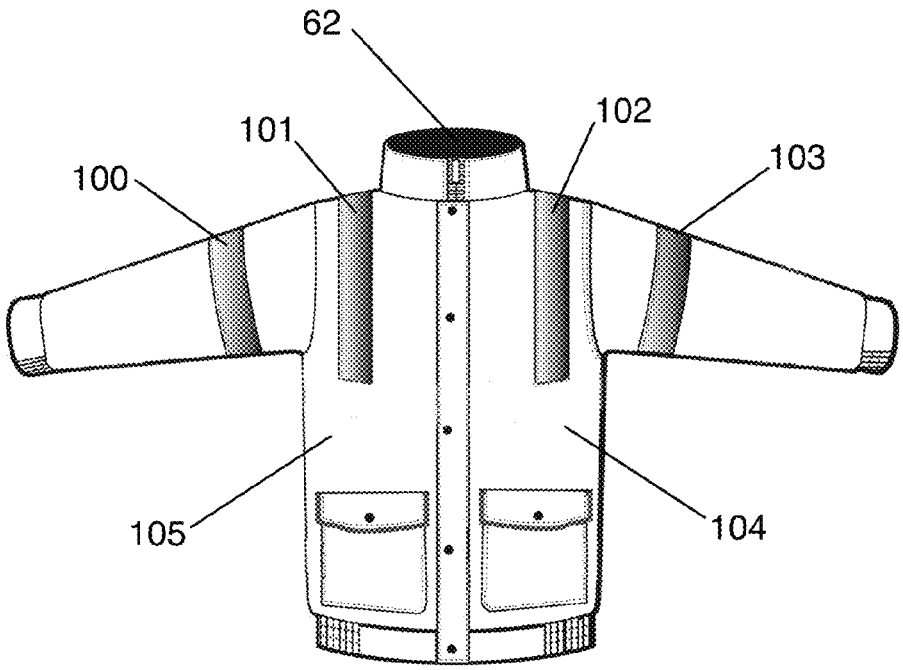
FIG. 20 shows an alternative embodiment of the autonomous heated interlining embedded within a High-Visibility garment with a reduced area reflective tape (100, 101, 102 and 103).
Figure 21:
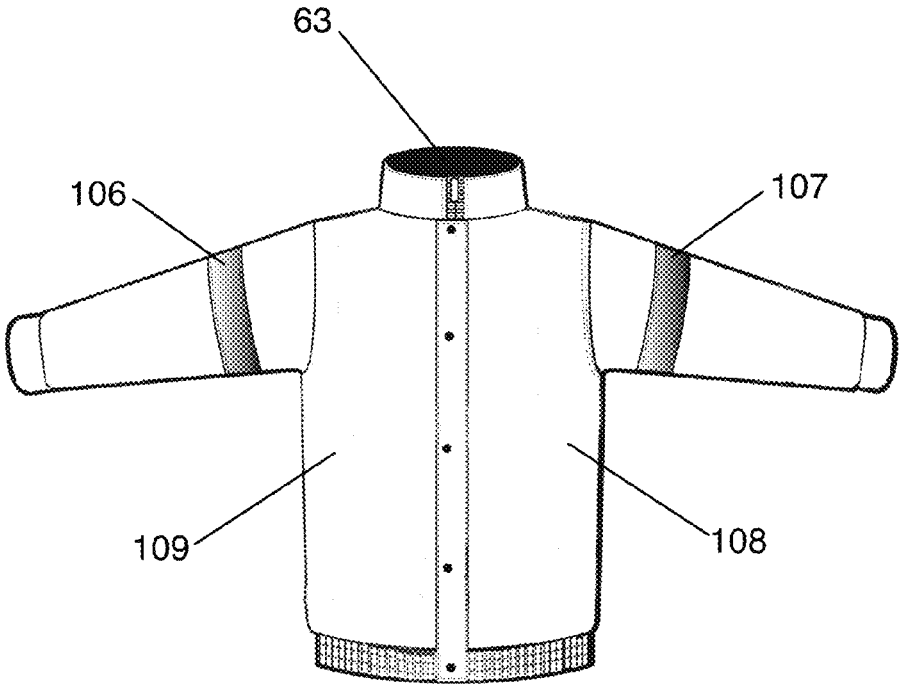
FIG. 21 shows a further alternative embodiment of the autonomous heated interlining embedded within a High-Visibility garment with reflective tape (106 and 107) on the arms only.

FIG. 20 shows an alternate embodiment of the autonomous, self-powered heated interlining 4 incorporated (embedded) in a different style of High-Visibility garment 62 with a smaller number and surface area of reflective stripes 100, 101, 102 and 103 in a vertical orientation only. The view shows the front of the garment. The Primary and Secondary heating channels and regions would be implemented in this embodiment as described previously in other embodiments to produce warmth for the wearer. This particular embodiment shows a shorter length bomber style High-Visibility garment. This garment would conform to a minimum of ANSI/ISEA 107-2010 Class 1 or 2 as depicted in this particular embodiment FIG. 21 shows a further alternate embodiment of the autonomous, self-powered heated interlining 4 incorporated (embedded) in yet another style of High-Visibility garment 63, with reflective arm stripes only 106, 107 and no front pockets. Once again this embodiment would have Primary and Secondary heating channels and regions implemented as described in detail previously to produce warmth for the wearer. This embodiment although produced with a High-Visibility materials may not conform to ANSI/ISEA 107-2010 Class 1, 2 or 3 specifications without further high-visibility reflective bands.

Figure 22:
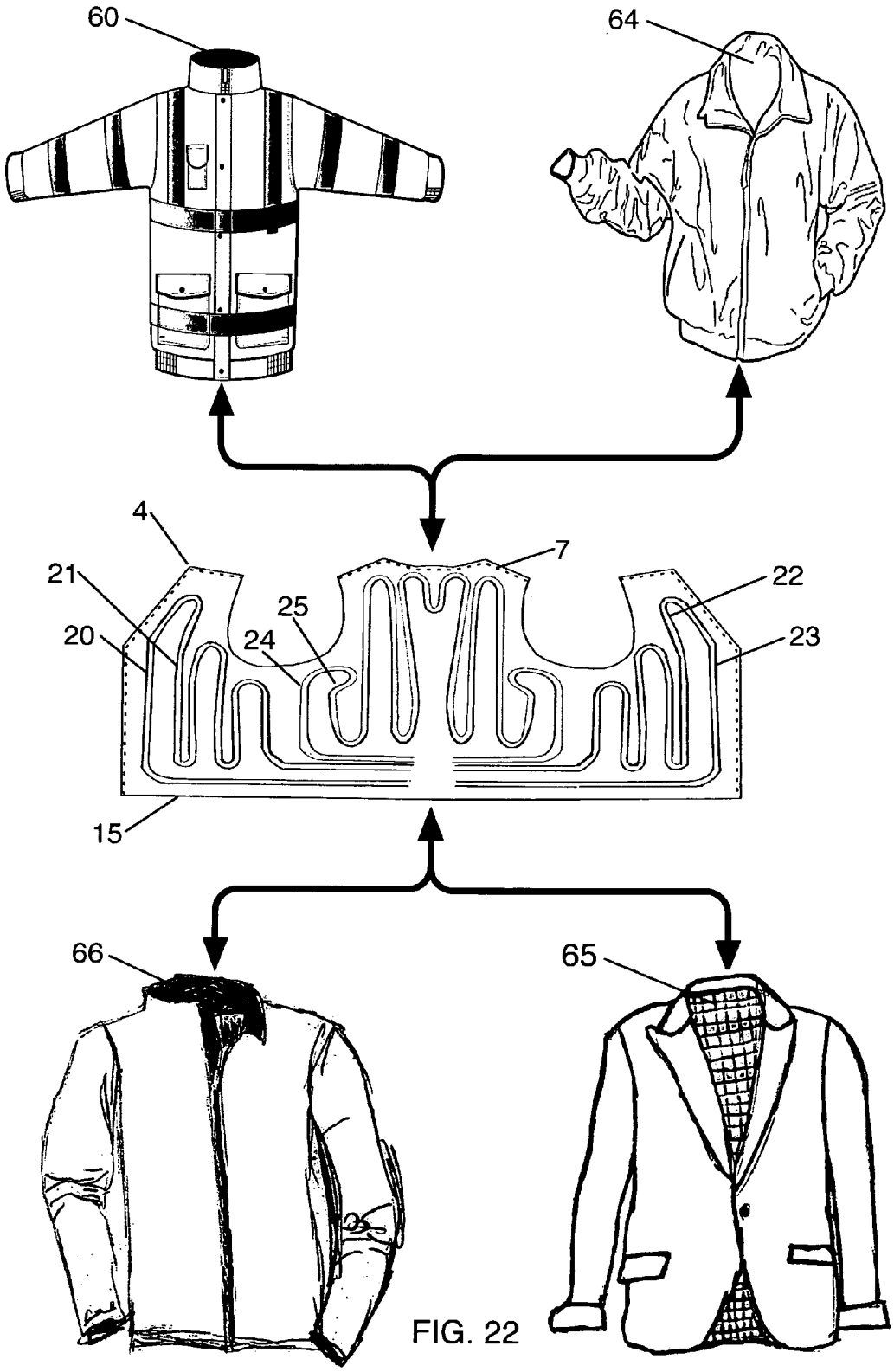
FIG. 22 shows a plurality of possible garment embodiments for the autonomous heated interlining, ranging from a High-Visibility work wear garment through 60 to a tuxedo 65. Also depicted is a uni-sex bomber style jacket 64 and a ladies ski jacket 66.
Figure 1:
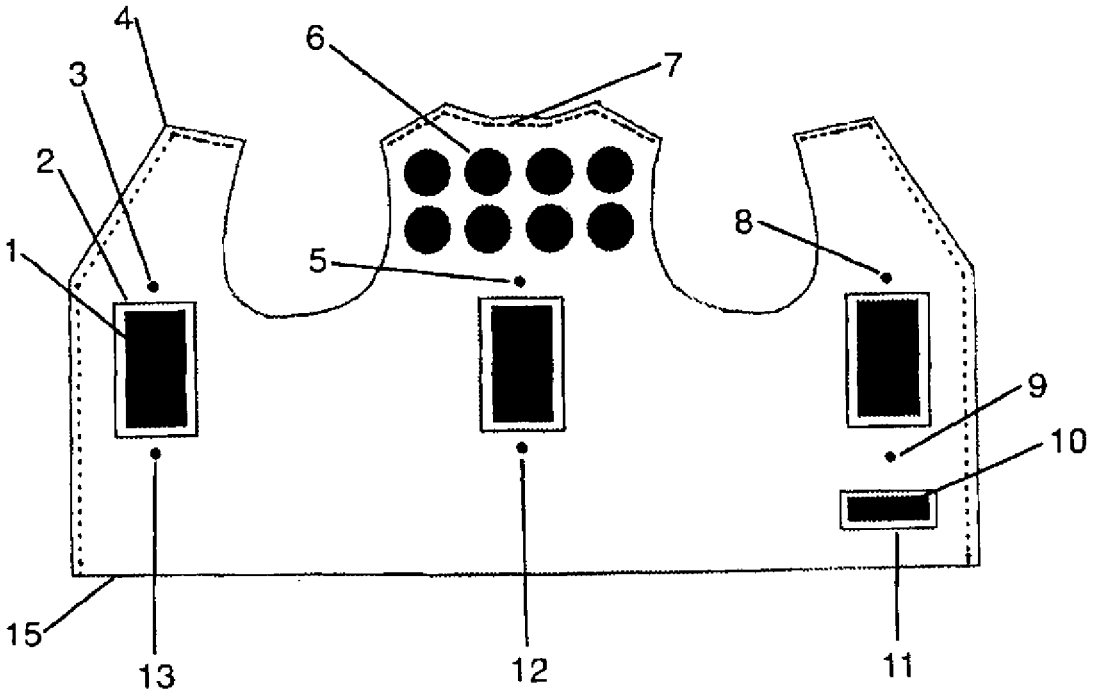
Figure 2:
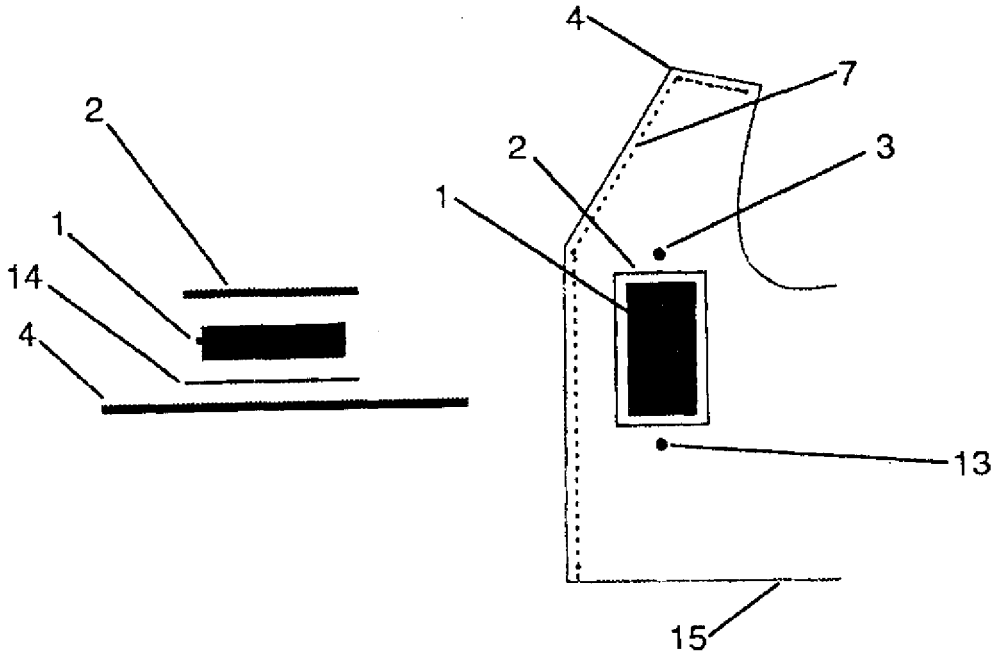
Figure 3:
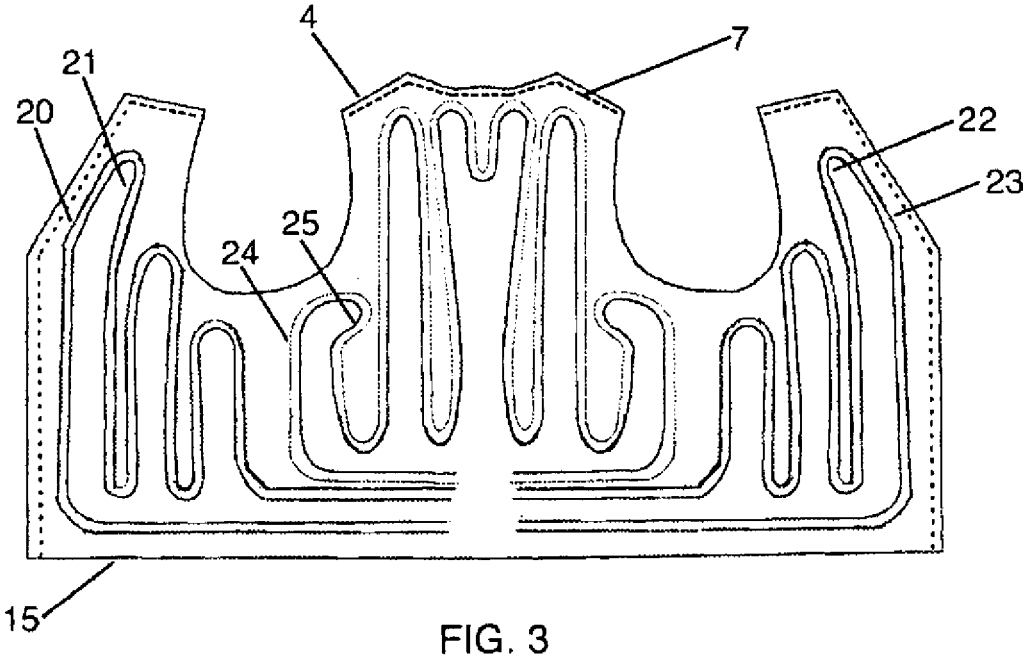
Figure 4:
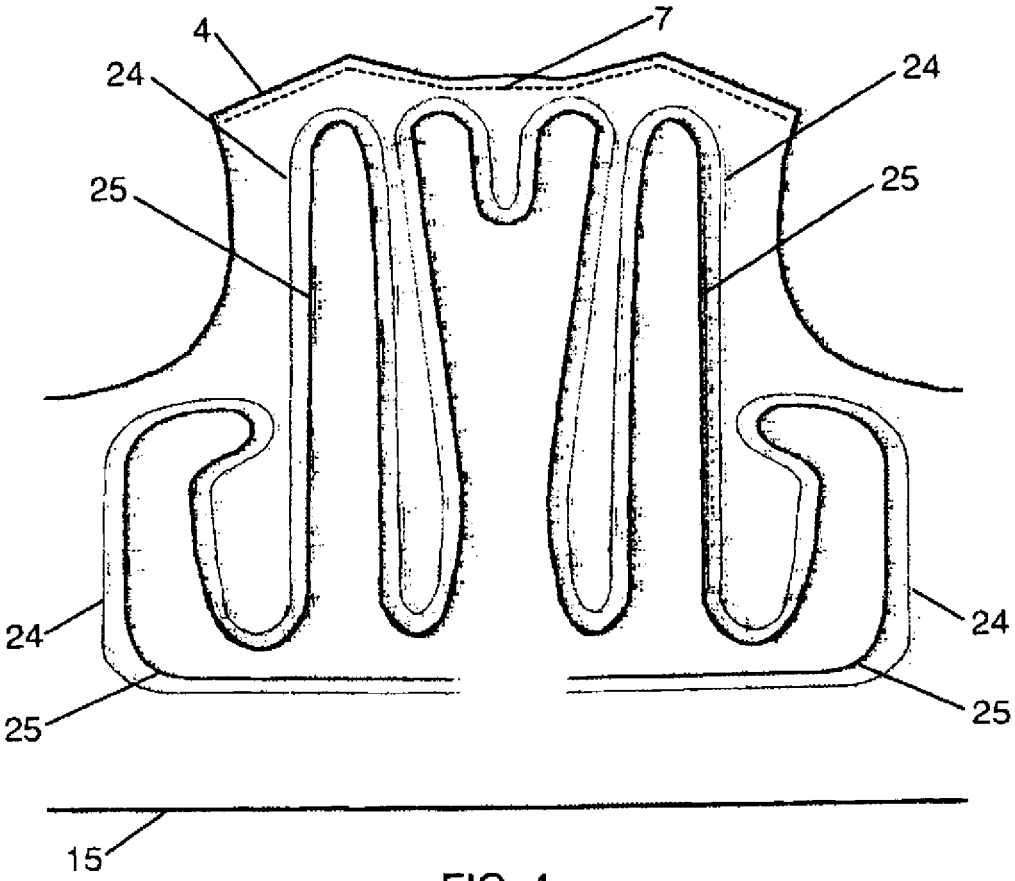
Figure 5:
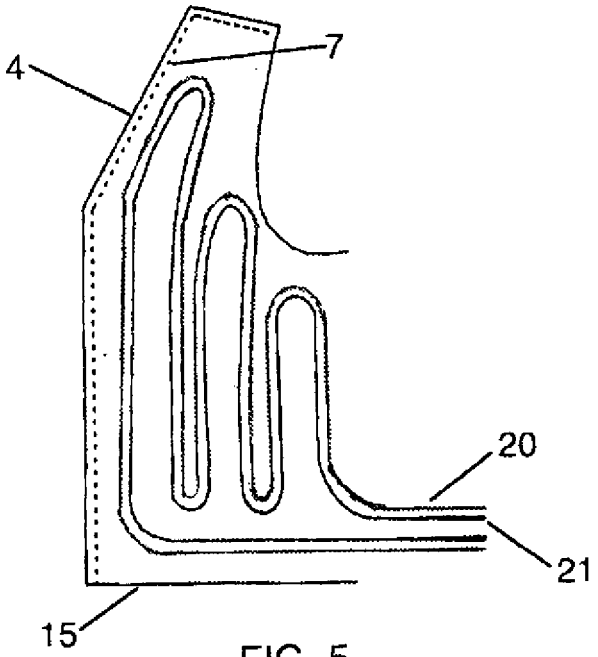
Figure 6:
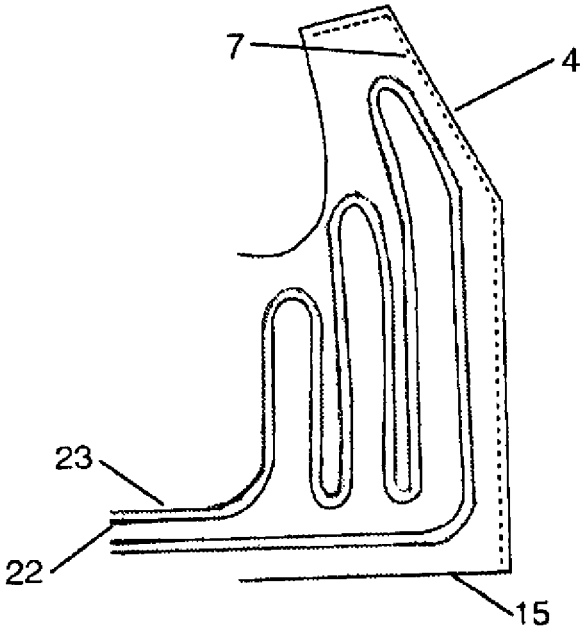
Figure 7:
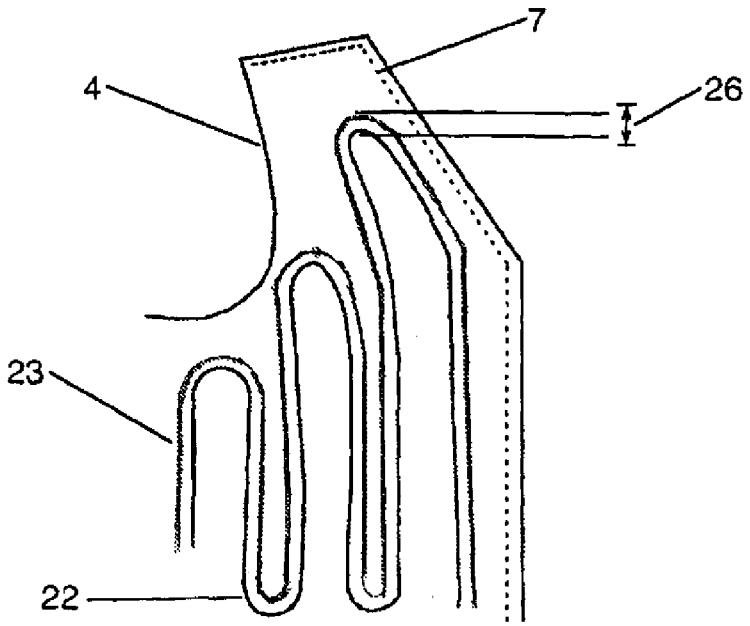
Figure 8:
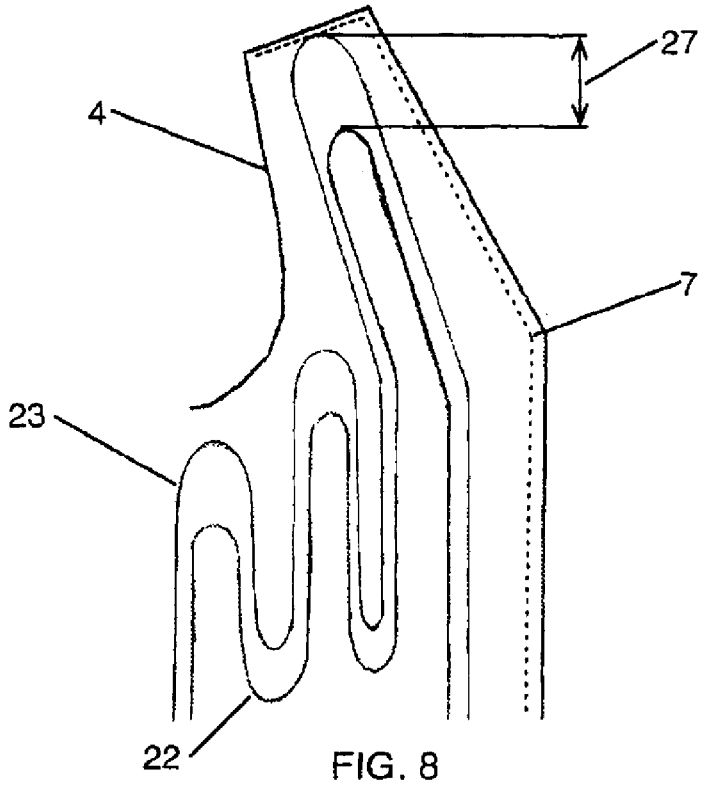
Figure 9:
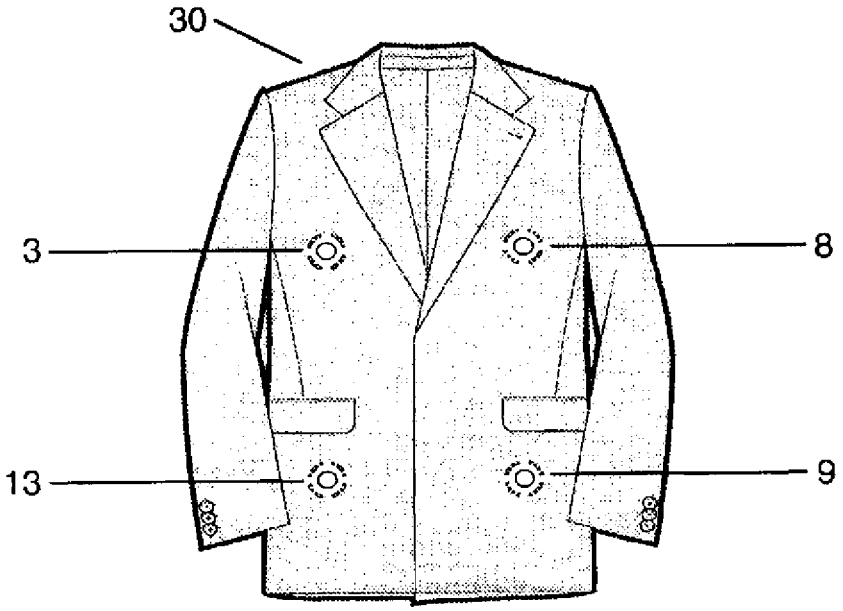
Figure 10:
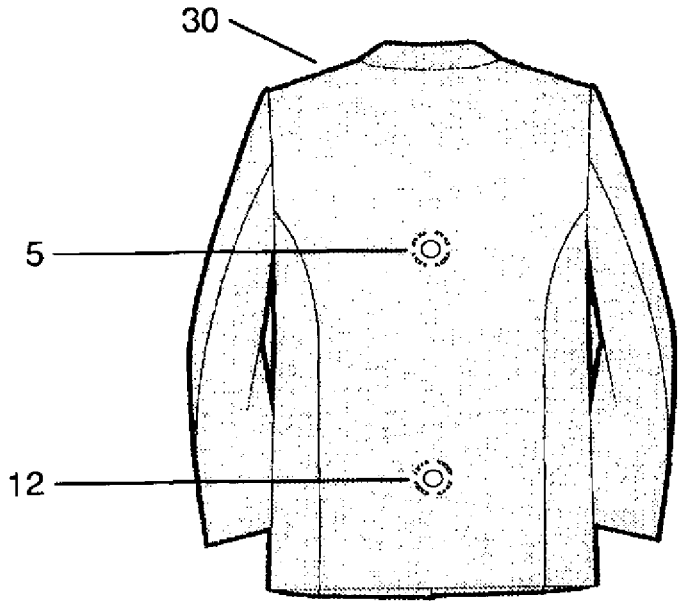
Figure 11:
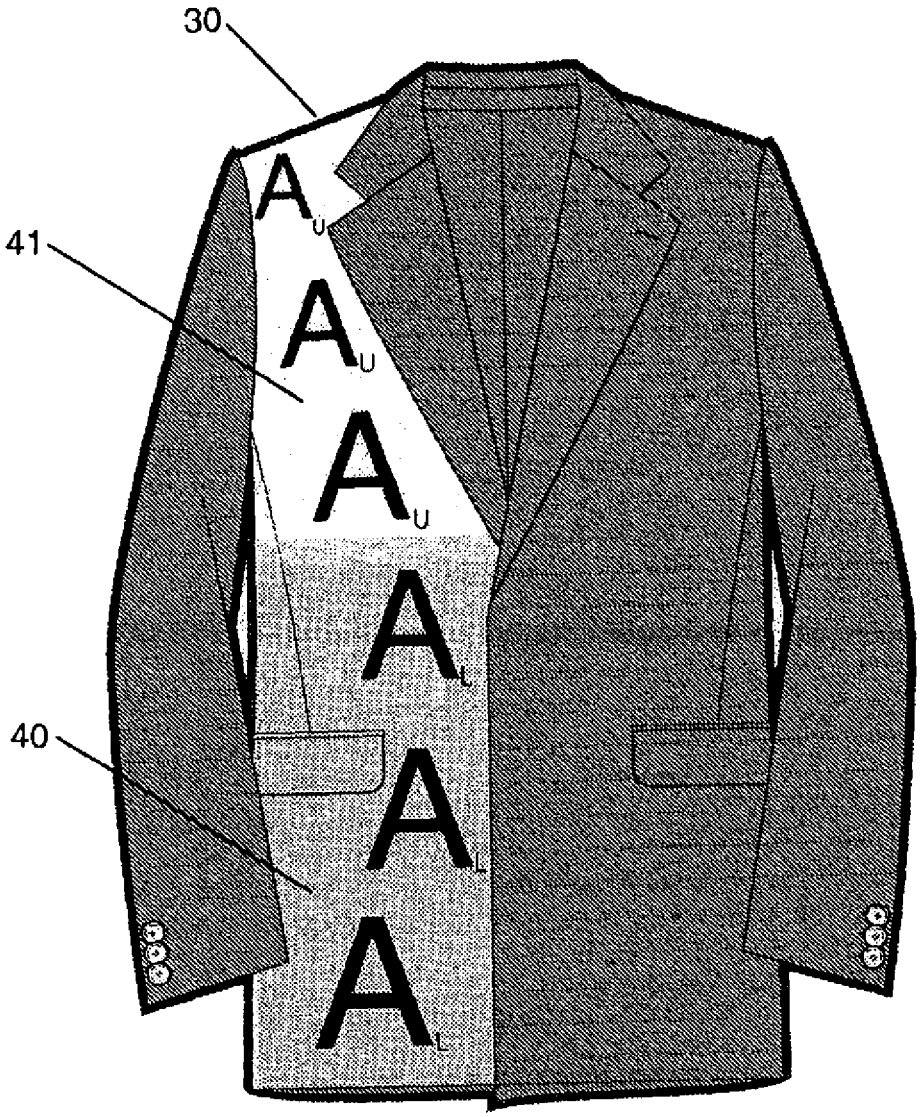
Figure 12:
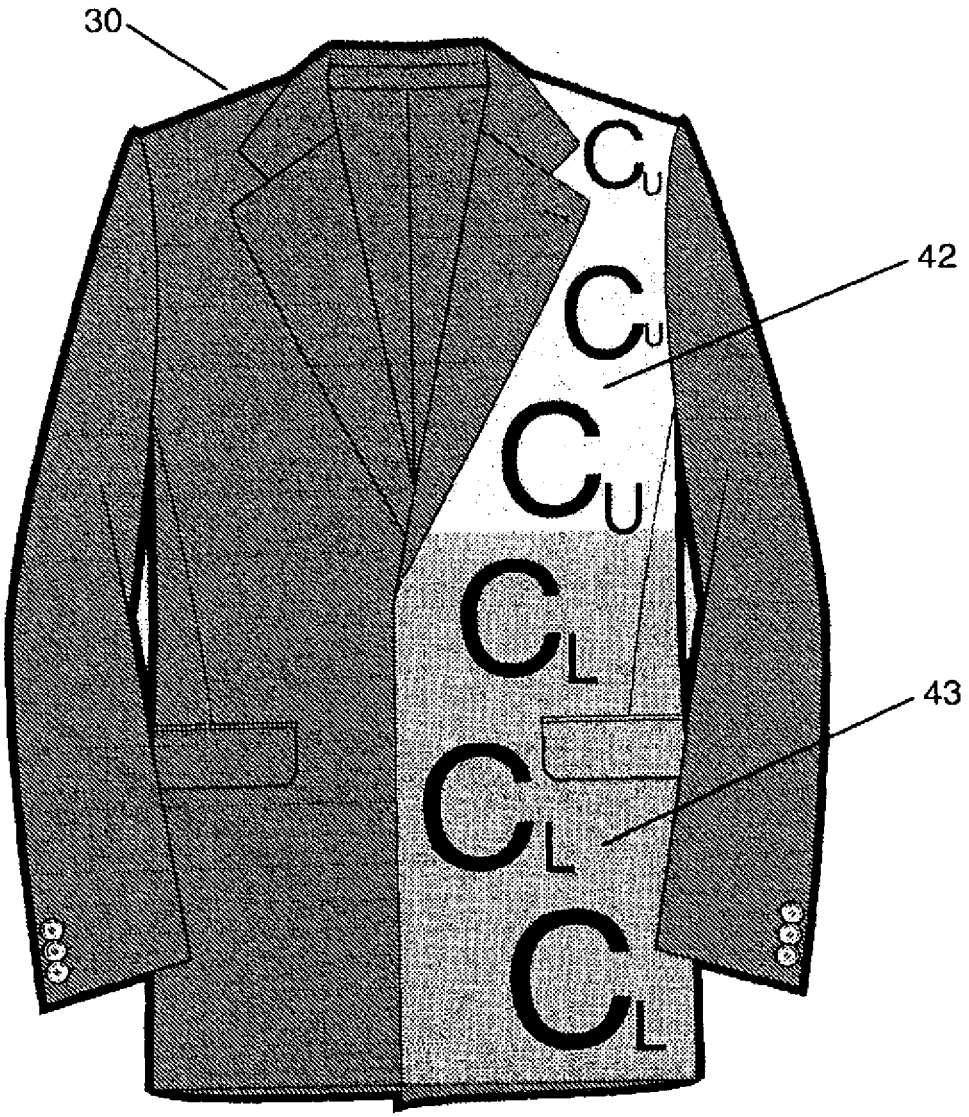
Figure 13:
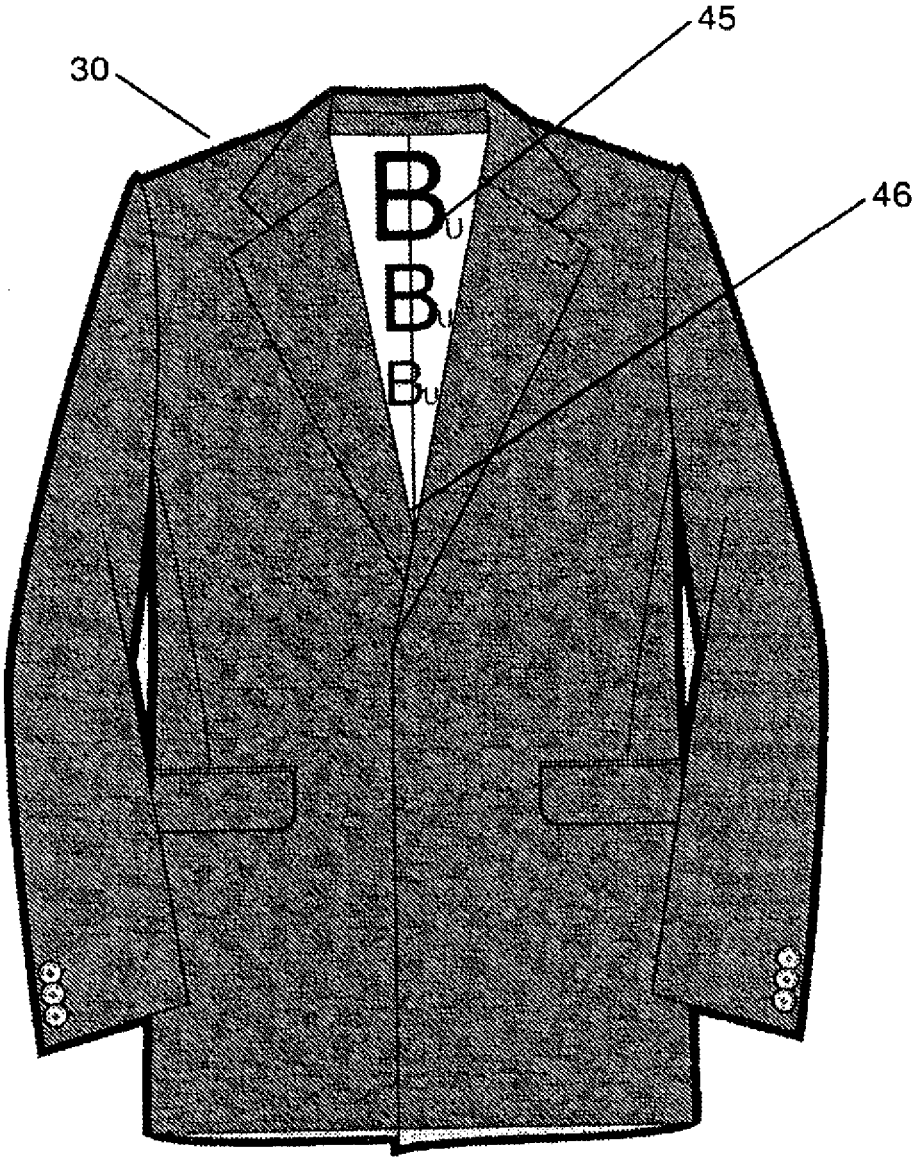
Figure 14:
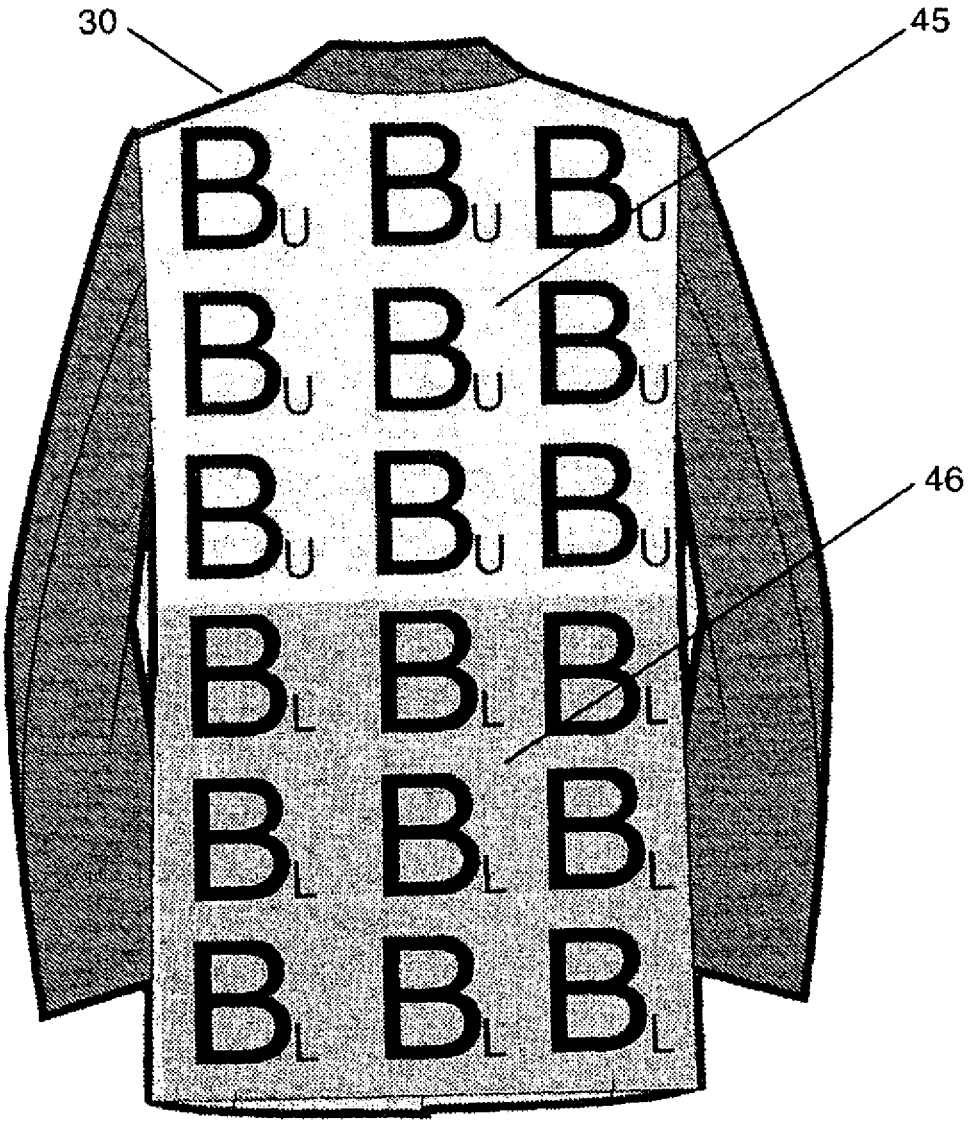
Figure 15:
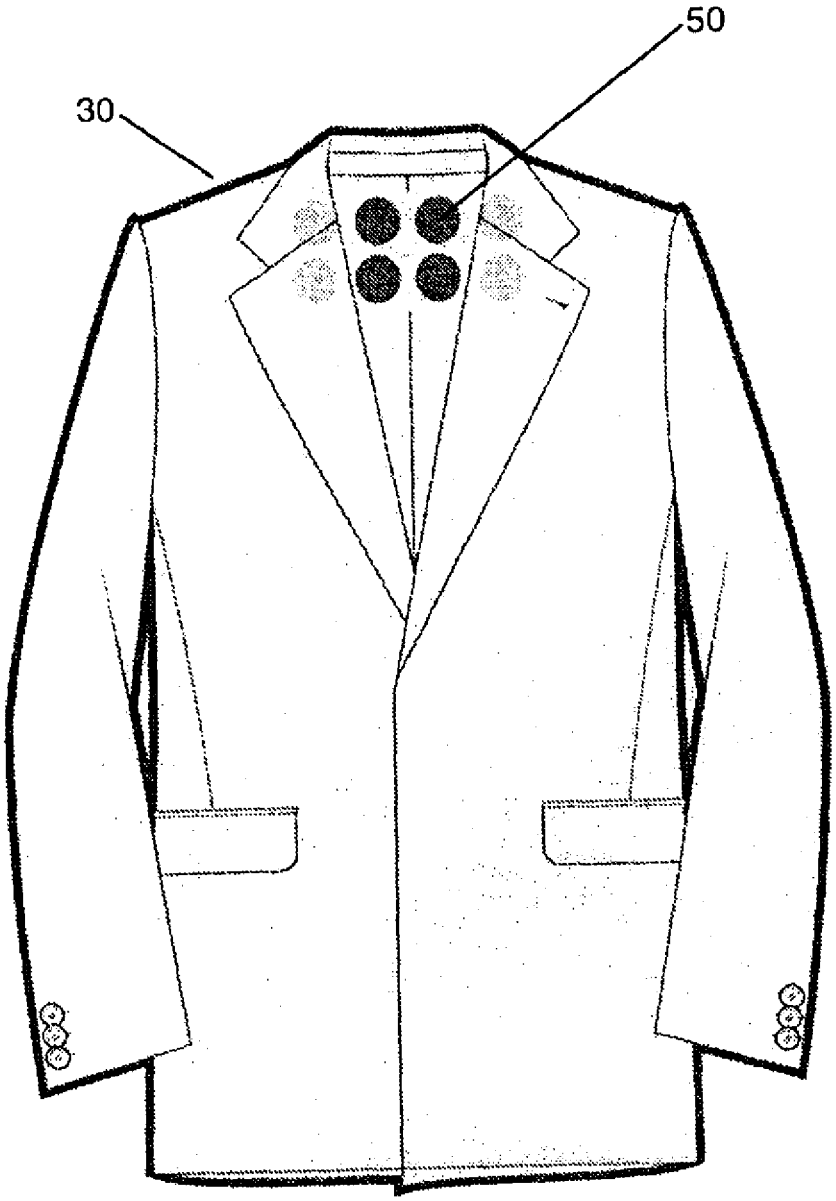
Figure 16:
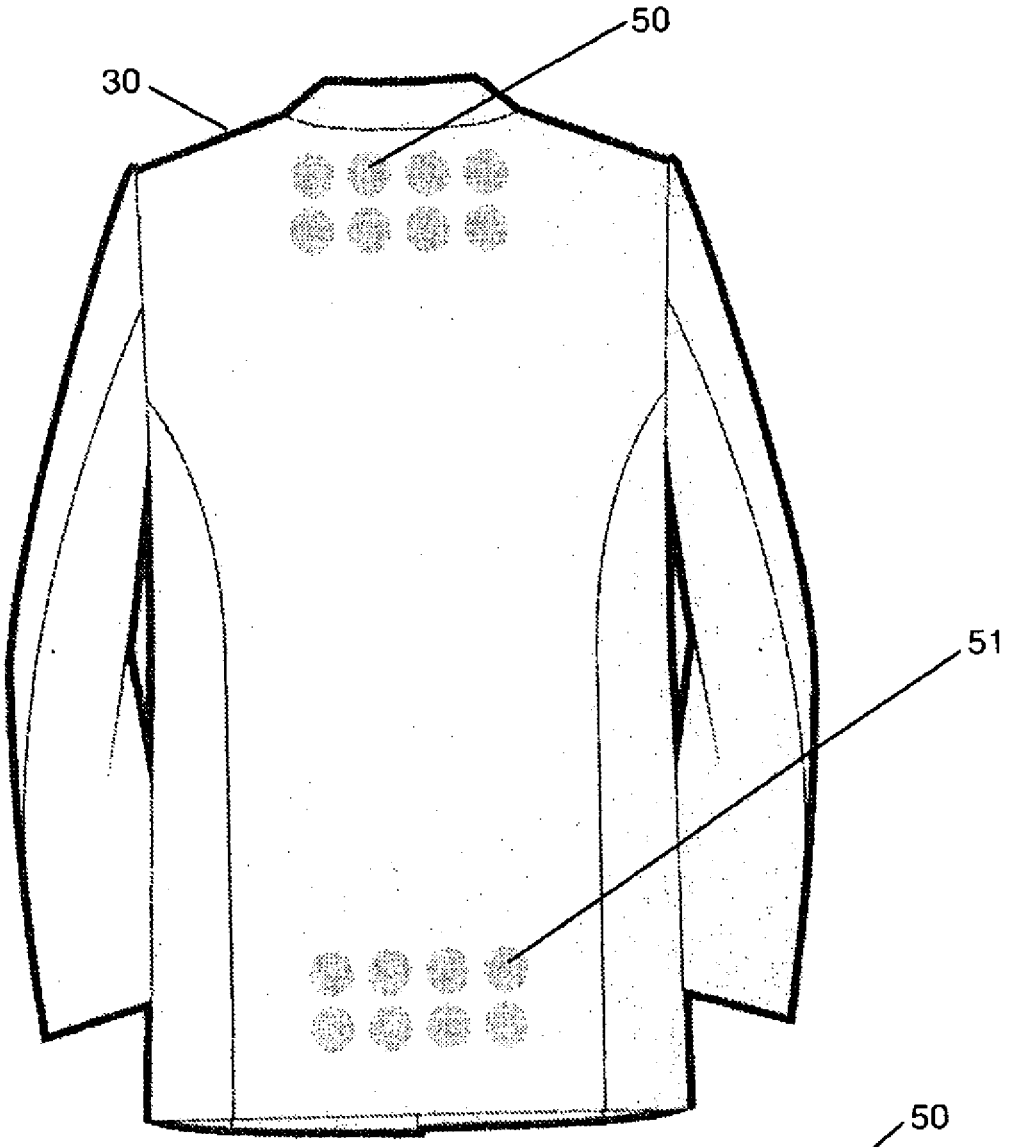
Figure 16:
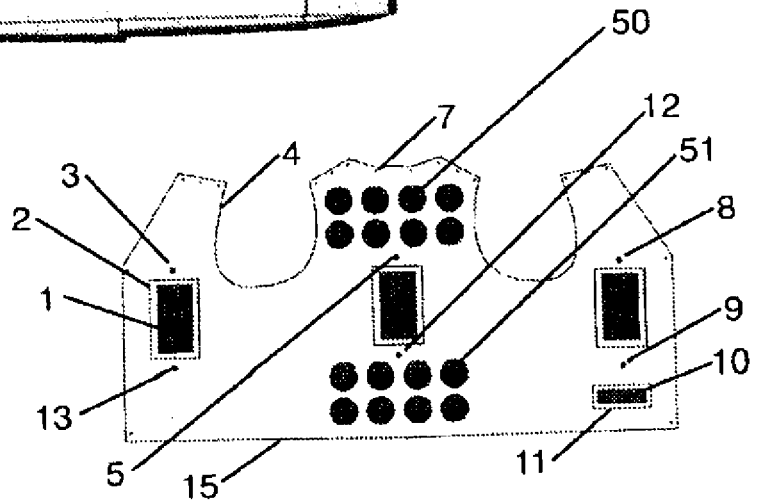
Figure 17:
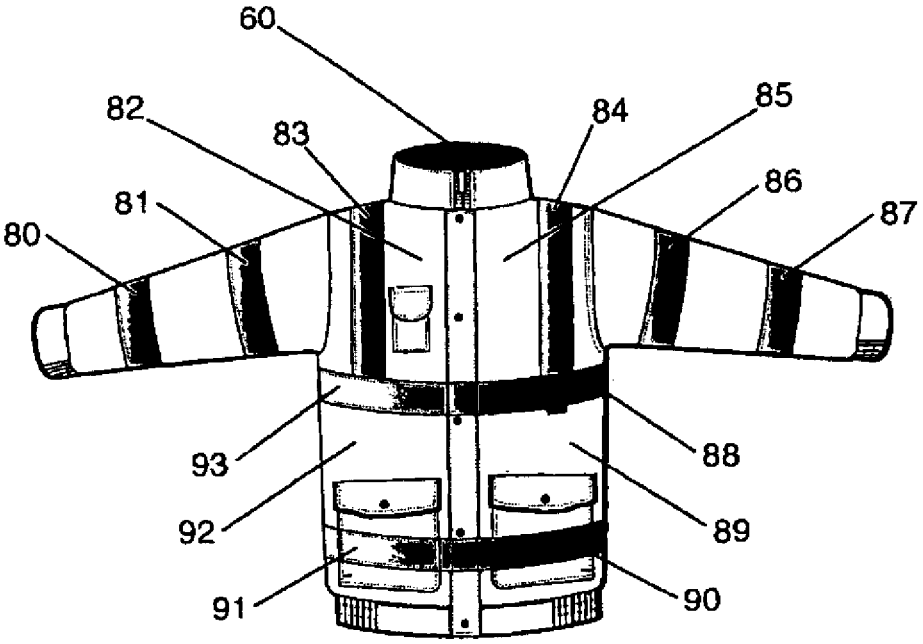
Figure 18:
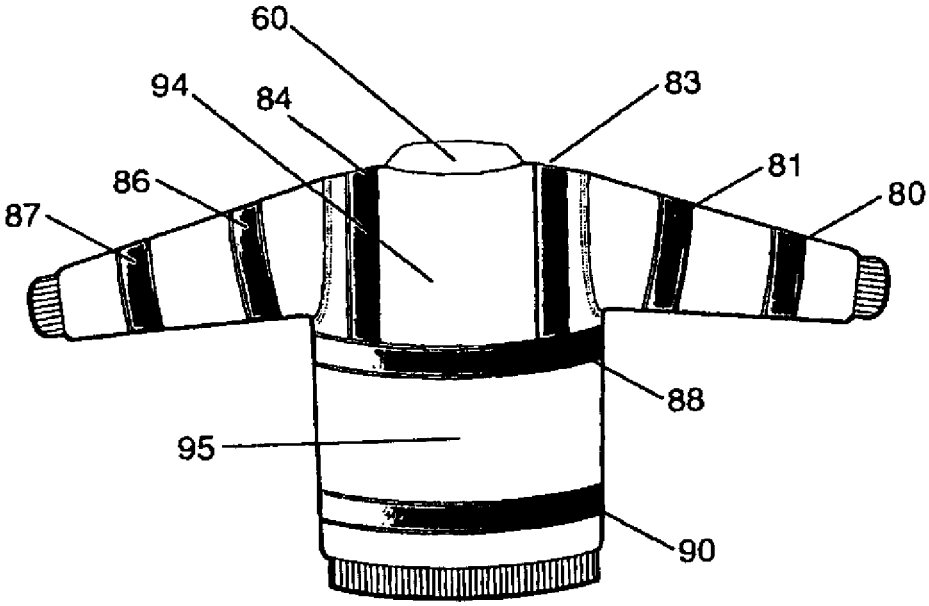
Figure 19:
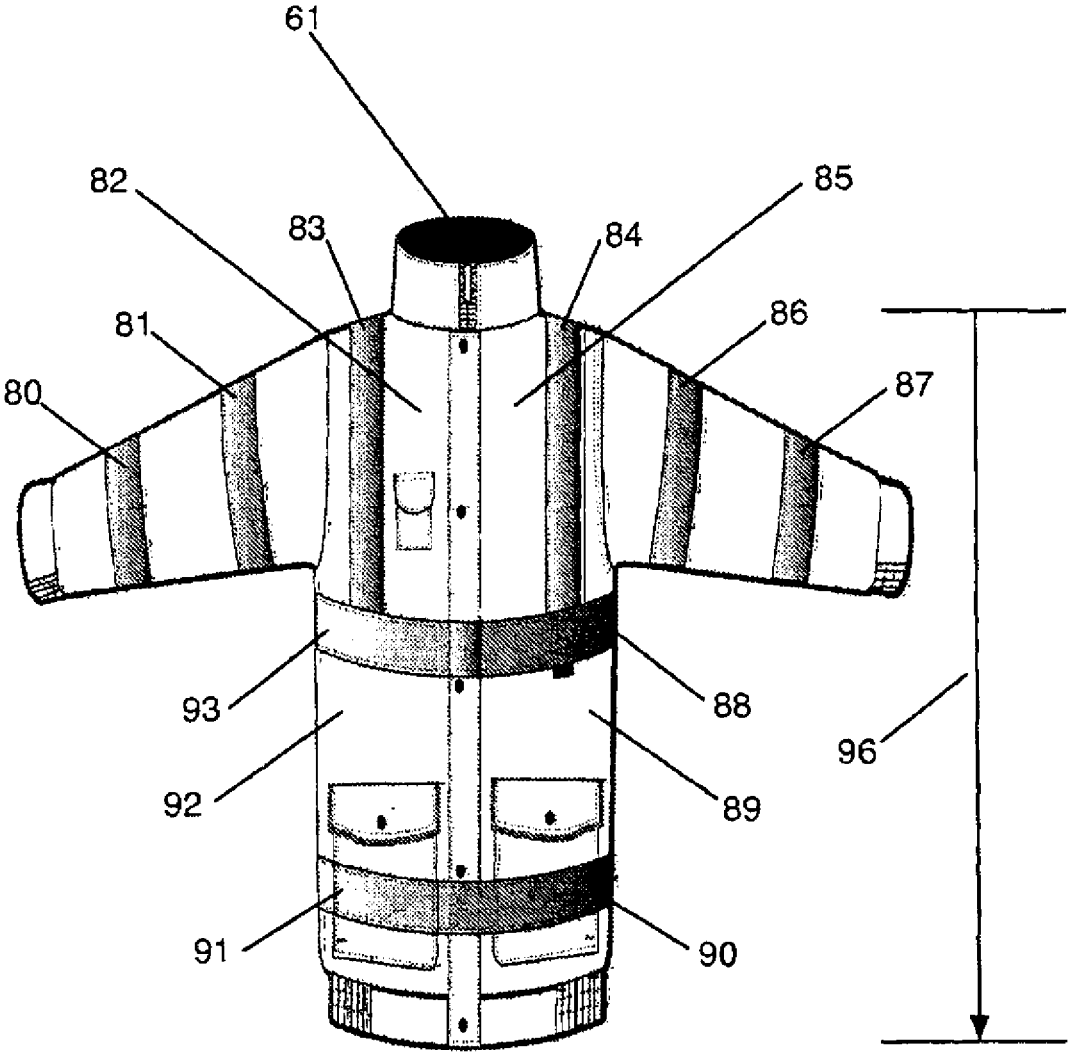
Figure 20:
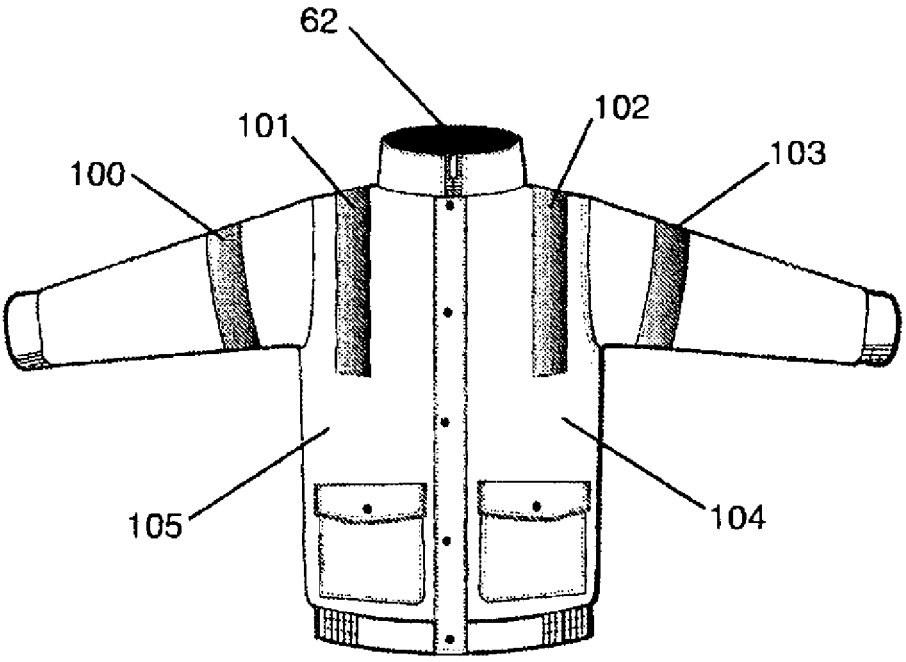
Figure 21:
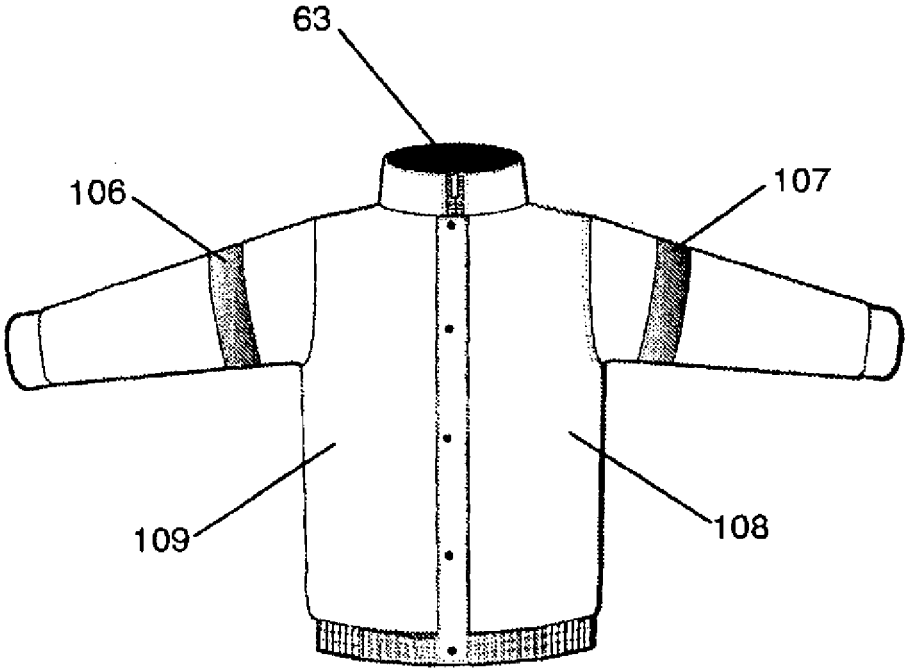
Figure 22:
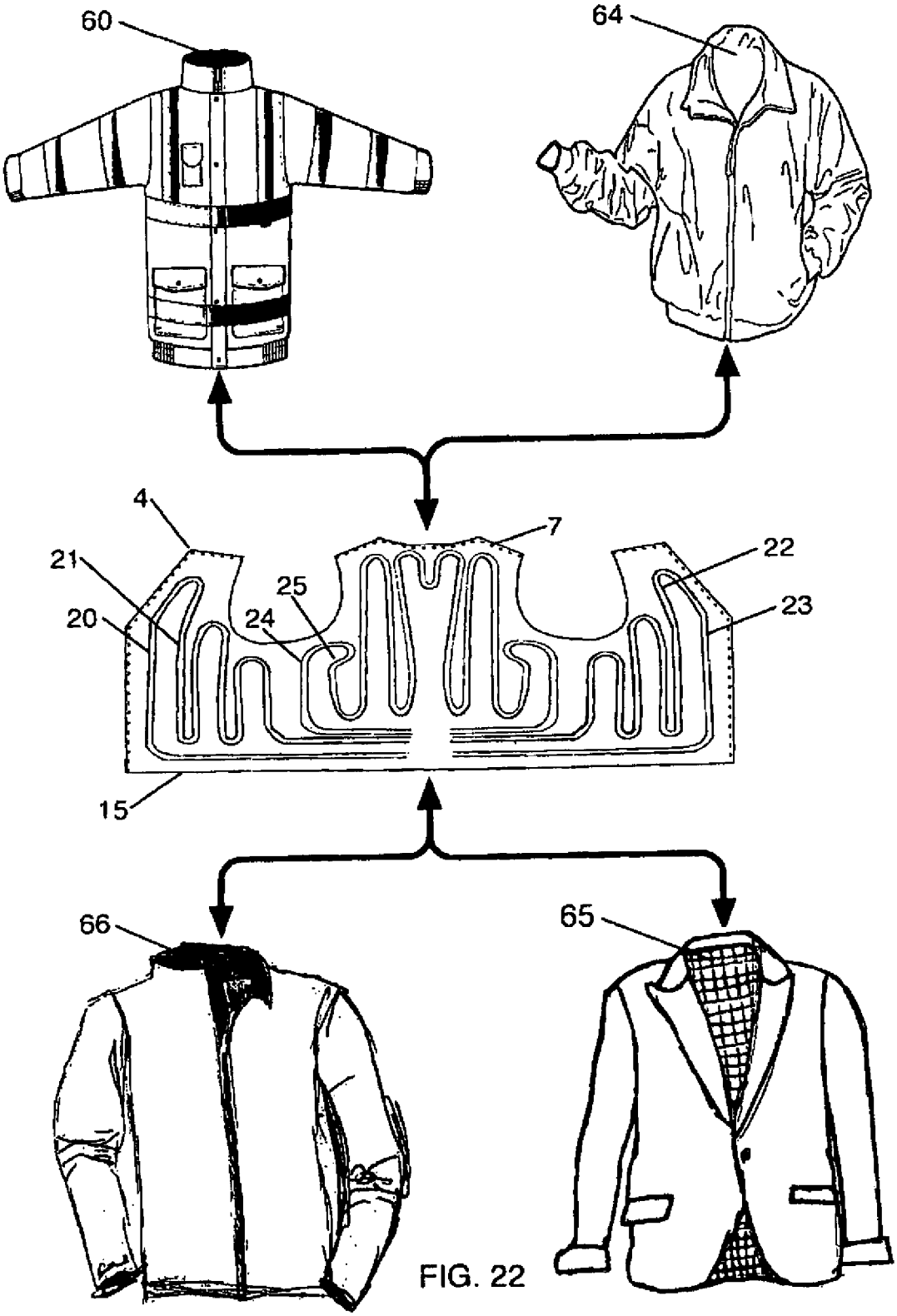

FIG. 22 shows a small number of alternate embodiments that may have the autonomous, self-powered heated interlining 4 fitted (embedded). Garment 60 is one type of embodiment fitted into a version of a High-Visibility garment that would conform to ANSI/ISEA 107-2010 Class 1, 2 or 3 subject to the number of reflective stripes fitted. Also shown in FIG. 22 is garment 64 which would be an embodiment within a lightweight uni-sex anorak/jacket. Garment 66 as shown would be an embodiment fitted within a heavyweight ski type of jacket, which may be fully padded and fleeced lined. A final embodiment shown in FIG. 22 is garment 65, this is a tuxedo jacket with silk facings and collar. The embodiment within a tuxedo shows the scope of possible alternative embodiments ranging from a High-Visibility working garment 60 to a luxury evening dinner garment such as a tuxedo jacket 65. A vast range of alternative embodiments exists which will be discussed later. All these embodiments shown in FIG. 22 and further embodiments could incorporate (be embedded with) all the standard features of the autonomous, self-powered heated interlining 4. A smaller sized autonomous heated interlining 4 could be produced for children's sized garments as discussed later in this description.

Figure 23:
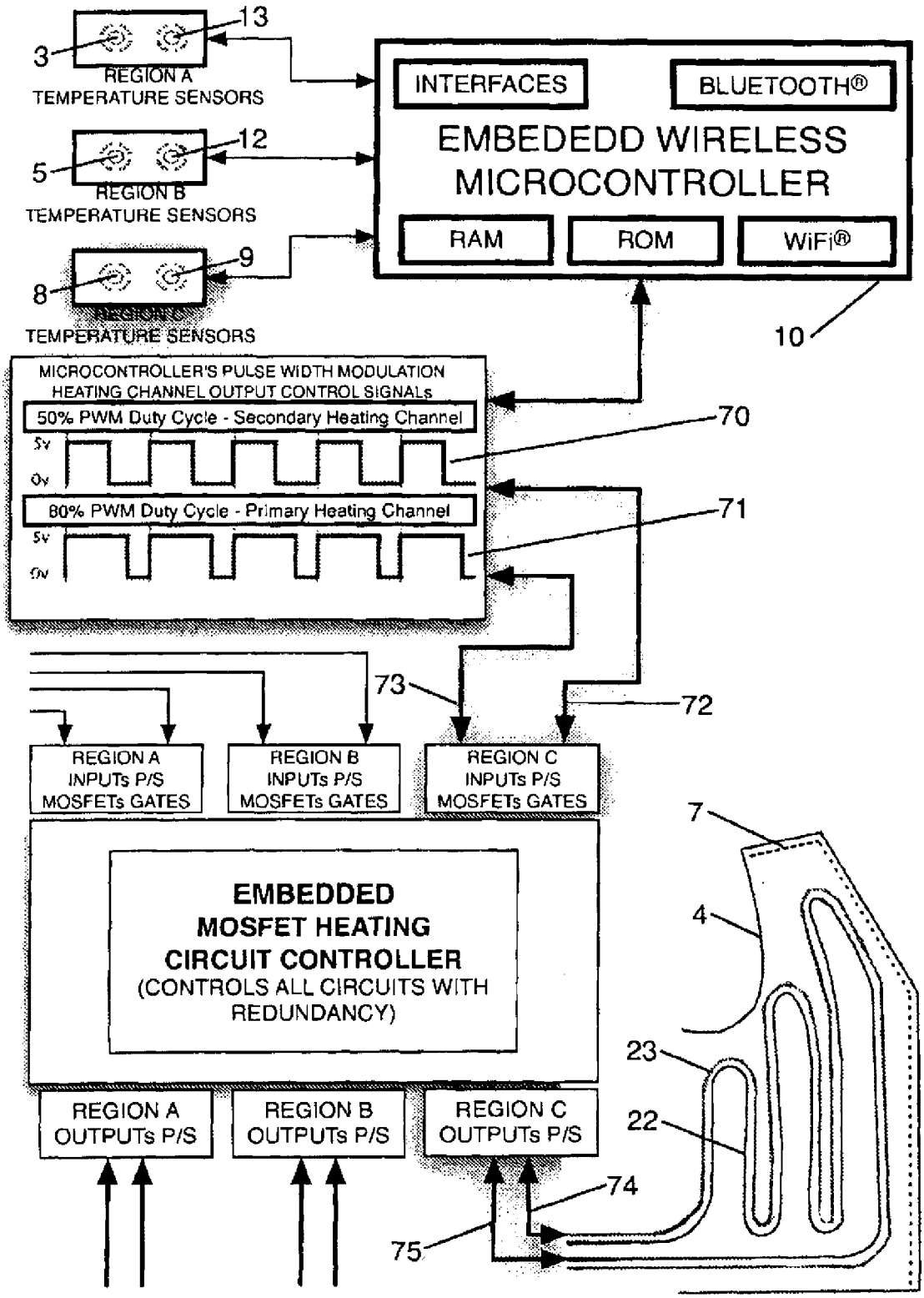
FIG. 23 shows the majority of the embedded system components of the autonomous heated interlining which act together to drive and monitor the primary and secondary heating channels with its inbuilt redundancy feature.

FIG. 23 depicts the components of the system that drive the Primary and Secondary heating channels in Region C of the autonomous, self-powered heated interlining 4. The components detailed in FIG. 23 are "Region Temperature Sensors" for regions A, B and C as follows (Region "A"-3/13), (Region "B"-5/12) and (Region "C"-8/9) respectively. The sensors information is relayed into the Embedded Microcontroller via a "1-Wire" digital interface. The Microcontroller outputs in this embodiment two PWM (Pulse Width Modulation) control signals. The PWM signals feed the individual gates of the Embedded MOSFETs, depicted in the figure as "EMBEDDED MOSFET HEATING CIRCUIT CONTROLLER" (EMHCC). The EMHCC drives the Primary and Secondary heating channels of each of the regions individually. FIG. 23 shows three separate regions being monitored by two digital temperature sensors in each region (total 6 heating sensors in this particular embodiment depicted). The Embedded Microcontroller then outputs two individually generated PWM signals 70 and 71 for each of the regions. The figure shows that the Primary Heating Channel in region C is being driven with an 80% (eighty) duty-cycle 73 and that the Secondary Heating Channel in the same region ("C") is being driven with a 50% (fifty) duty-cycle 72; these two signals are then fed directly into the EMHCC. The Primary Heating Channel 23 and Secondary Heating Channel 22 are driven by the Primary and Secondary Channel Outputs 74 and 75 respectively of the EMHCC. The EMHCC in this embodiment has a further two inputs and outputs (channel pairs) for regions A and B which in this figure are not depicted as being connected.

Figure 24:
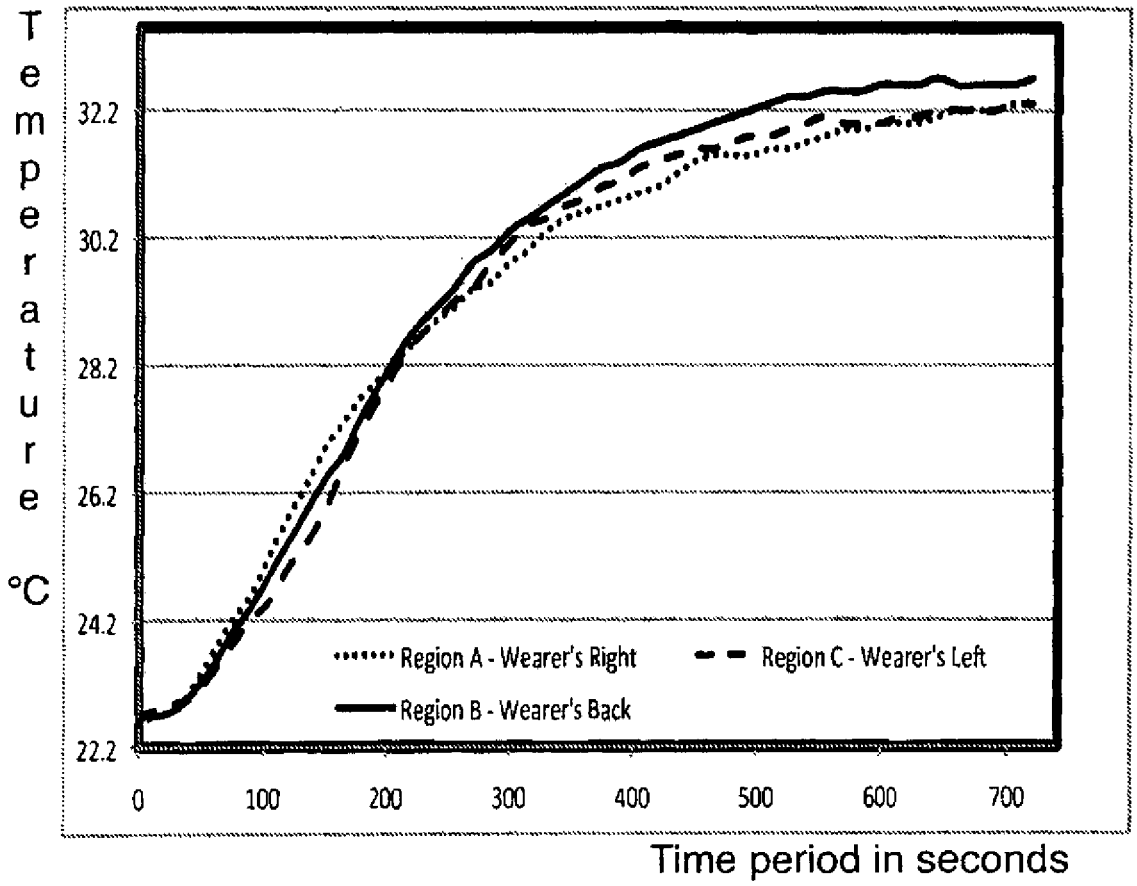
FIG. 24 is an actual graph plotted from data generated (heat output) from an autonomous heated interlining embedded within a High-Visibility garment. The graph shows temperature rise of three separate regions, "A"—wearer's right, "B"—wearer's back and "C"—wearer's left over a seven-hundred second running period at 50% power setting.

FIG. 24 shows a graph accurately plotted with the temperature rise of Regions "A", "B" and "C" of a garment fitted with the autonomous, self-powered heated interlining 4. The graph indicates temperature rise over a period of time in seconds from zero to seven hundred seconds. In this graph each of the three regions have a different line marking type to show the temperature plots clearly of each region over the time period measured. The graph clearly demonstrates the uniform nature of the heat distribution throughout the three regions "A", "B" and "C". The graph data was obtained by measuring directly with the autonomous, self-powered, heated interlining's digital embedded temperature sensors. Further discussion of this graph and the results will be given in later paragraphs.

Figure 25:
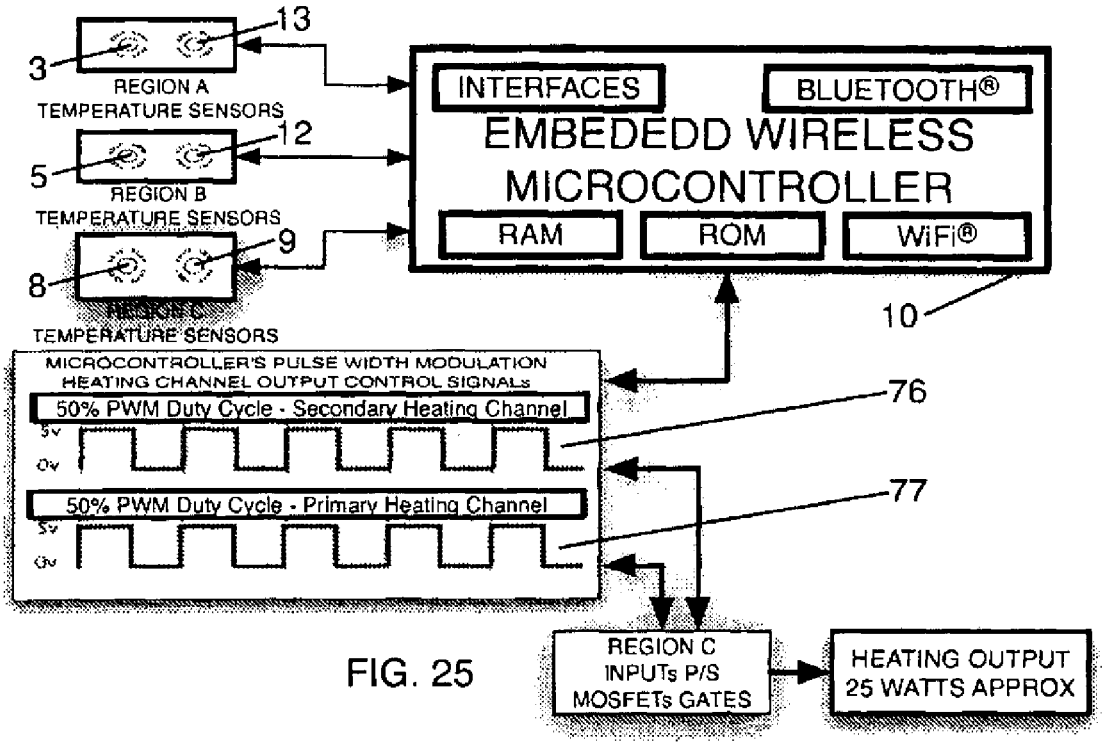
FIG. 25 shows the embedded Microcontroller's PWM outputs (heating control signals) 76 and 77 for region "C" and the associated driving outputs produced. The embedded Microcontroller is receiving temperature information (digital signals) from a plurality of embedded regional digital temperature sensors.

FIG. 25 depicts the Embedded Microcontroller and Regional Temperature Sensors for regions A, B and C (Region "A"-3/13), (Region "B"-5/12) and (Region "C"-8/9) respectively. Also depicted in an abbreviated form is the Embedded MOSFET Heating Circuit Controller (EMHCC) input and associated output. The figure illustrates a 50% duty cycle on both Primary and Secondary Heating Channels being output by the Embedded Wireless Microcontroller in the form of a PWM signal 76 and 77. These signals are fed into the region C's input channels of the EMHCC. The approximate combined (Primary and Secondary heating channels) heating output is 25 (twenty-five) Watts of heating output for region C. The PWM signals output by the Microcontroller are generated individually in response to a number of factors including the temperature levels sensed by the individual regional embedded digital temperature sensors (3/13, 5/12 and 8/9), operational status and possible failure of heating channels (Primary and Secondary) and the wearer/operators control inputs.

Figure 26:
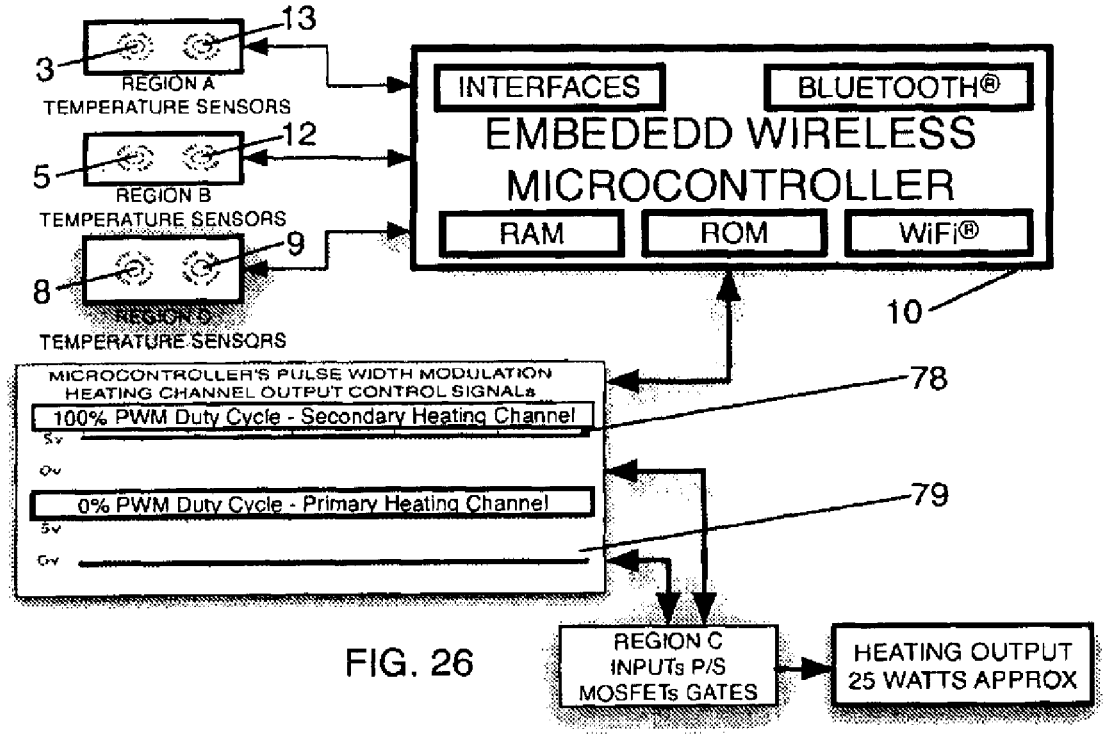
FIG. 26 shows the embedded Microcontroller's redundancy routine coming into effect subsequent to a complete failure of the primary heating channel 79. The Microcontroller automatically increases the PWM duty cycle on the secondary channel 78 in an attempt to compensate for the failure.

FIG. 26 depicts the same components as FIG. 25 detailed above. However, in this representation it can be seen that the PWM signals of the Primary 79 and Secondary 78 heating channels are different. The Primary PWM signal is outputting a 0% duty-cycle (zero ouput) and the Secondary PWM signal is outputting a 100% duty-cycle signal (on full-time). The approximate combined (Primary and Secondary heating channels) heating output is 25 (twenty-five) Watts of heating output for region C. The output at 25 Watts is virtually identical to that of FIG. 25 with a PWM signal of 50% duty-cycle each on the Primary and Secondary heating channels for region C. This virtually identical heating output demonstrate the possible scenario of a complete failure of Primary Heating Channel and thus the Secondary Heating Channel being driven at an increased duty-cycle in an attempt to re-establish the desired heating output as it was prior to the failure of the Primary Heating Channel. A detailed discussion of this redundancy control system will be given further in the main description that follows.

Figure 27:
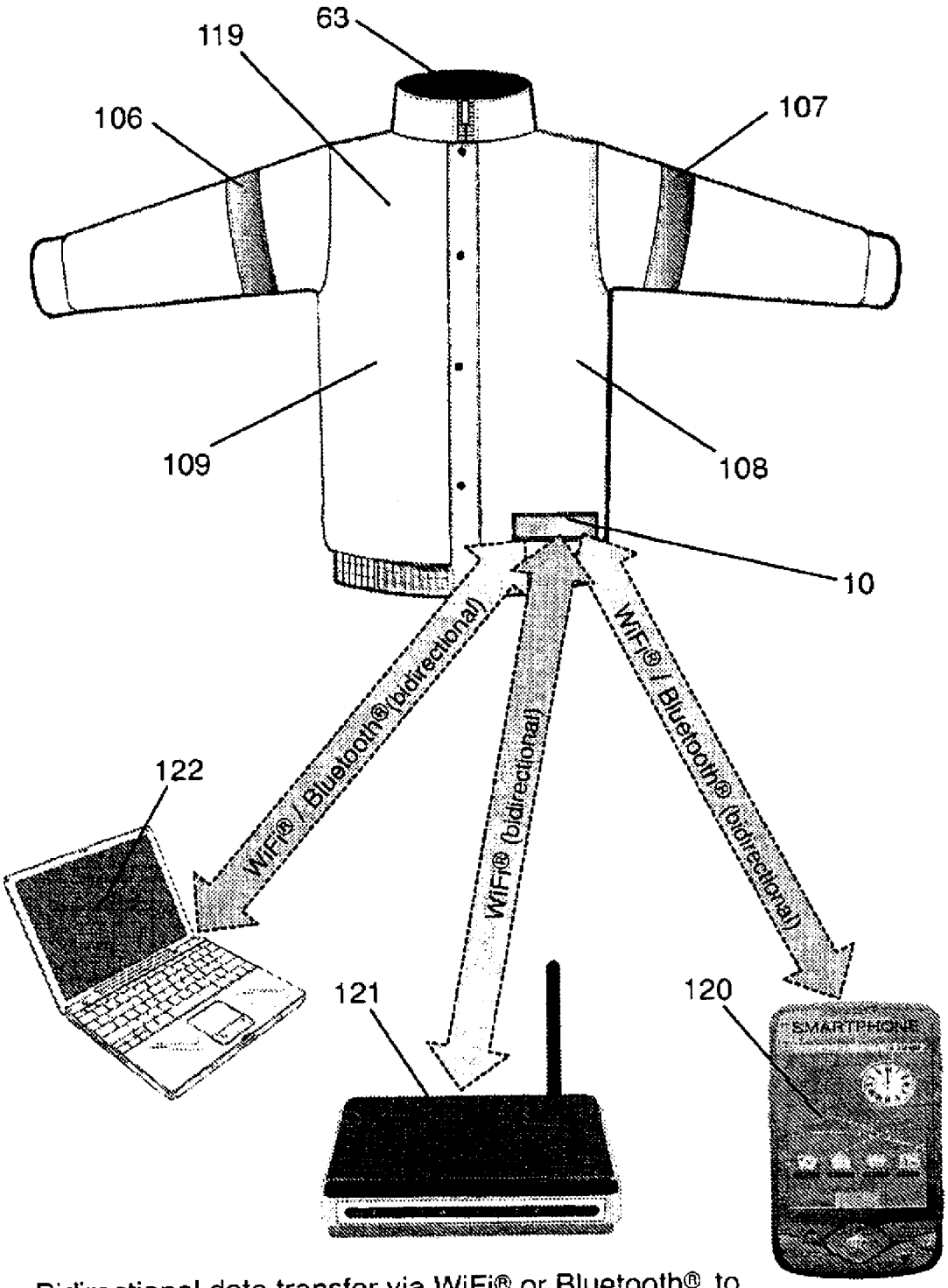
FIG. 27 shows the bidirectional communication that can take place between a mobile telephone 120, wireless router 121 and computer 122 and the embedded Microcontroller 10 in the autonomous heated interlining 4. The particular embodiment shown depicts a High-Visibility garment 63 with an embedded autonomous heated interlining 4.

FIG. 27 is a graphical representation of the bidirectional communication via WiFi®/Bluetooth® that occurs between the autonomous heated interlining 4 (embedded within a garment) and the controlling device. An embodiment with a High-Visibility garment 63, is depicted. The embedded Microcontroller with wireless module 10, communicates in a bidirectional manner with a mobile telephone 120, wireless router 121 or a laptop 122 (computer/tablet/iPad®) to monitor and control the heat distribution and output level (wattage) of the garment with the autonomous heated interlining 4 fitted (embedded). The garment 63 type depicted could be any one of vast number of embodiments as discussed previously and not just a High-Visibility type garment as shown here. FIG. 22 shows a small selection of the possible types of embodiment configurations. Refer to FIG. 22's description for more detail on the possible embodiments. The bidirectional wireless communication between the garment with the autonomous heated interlining 4 fitted (embedded) and the various wireless controlling devices, mobile 120, router 121 and /laptop/pc/tablet/iPad® 122 offer extensive flexibility in the control and monitoring of the garment either by the wearer and/or operator. The wireless router 121 can be configured to communicate via the internet, through a broadband (or dial-up) connection to allow a remote operator to monitor, control and configure the garment with the autonomous heated interlining 4 fitted/embedded from a remote location to the wearer's locality for a number of reasons possibly including medical. The autonomous heated interlining 4 can be configured to report ambient and set heating temperature information from the digital temperature sensors embedded within the autonomous heated interlining 4 on a regular timed basis if so required.

Figure 28:
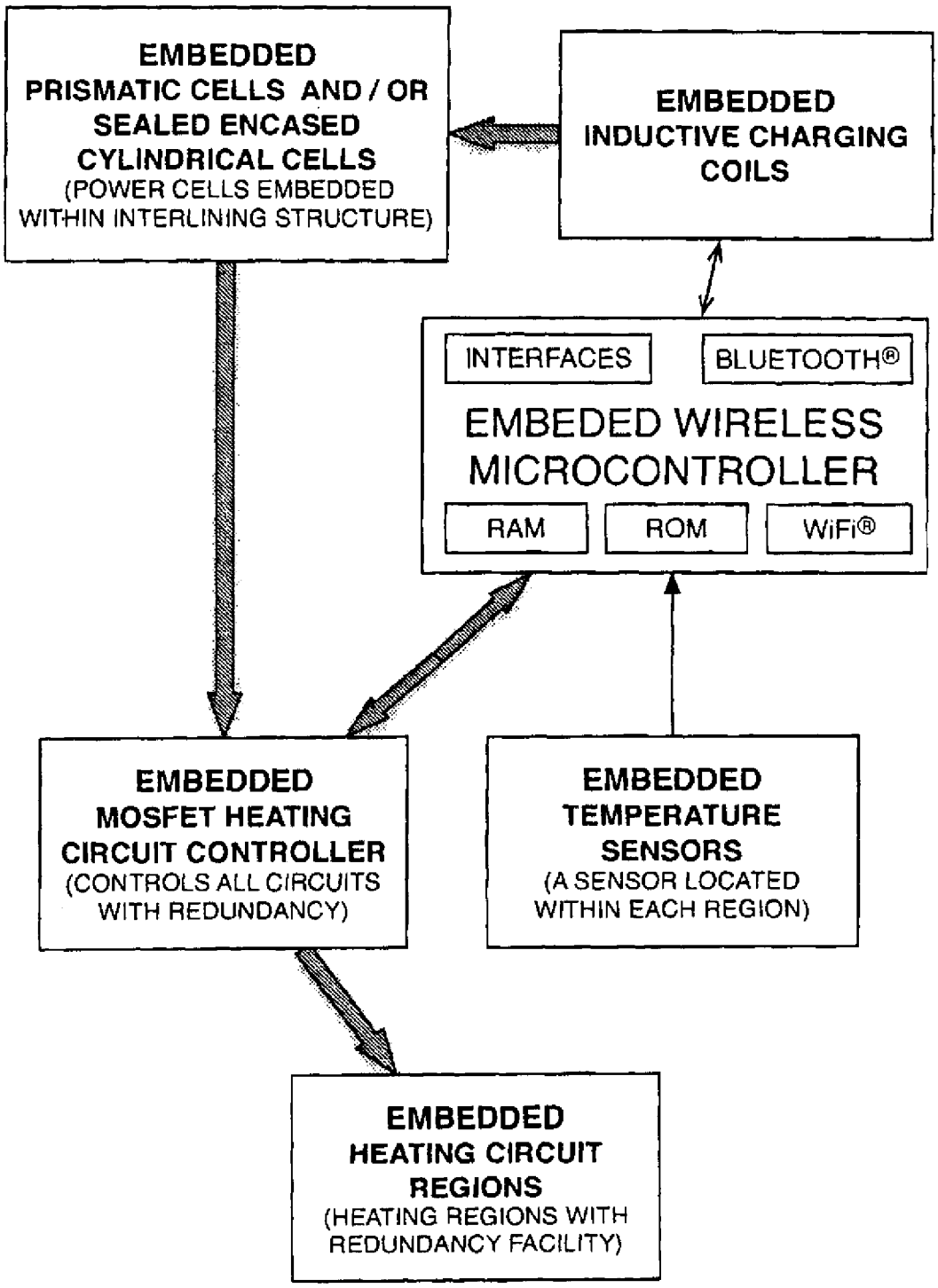
FIG. 28 is a components system chart for the autonomous heated interlining. The chart details the main embedded electrical components and the communication channels between the components.

FIG. 28 is the system chart detailing the embedded components; including the Prismatic Lithium Ion power cells 1 (or alternative chemistry and/or sealed abs encased 145 cylindrical power cells 151) of the autonomous, self-powered heated interlining 4. Detailed description of this system chart and the associated embedded components, along with their individual purpose will be given in detail in the following paragraphs.

Figure 29:
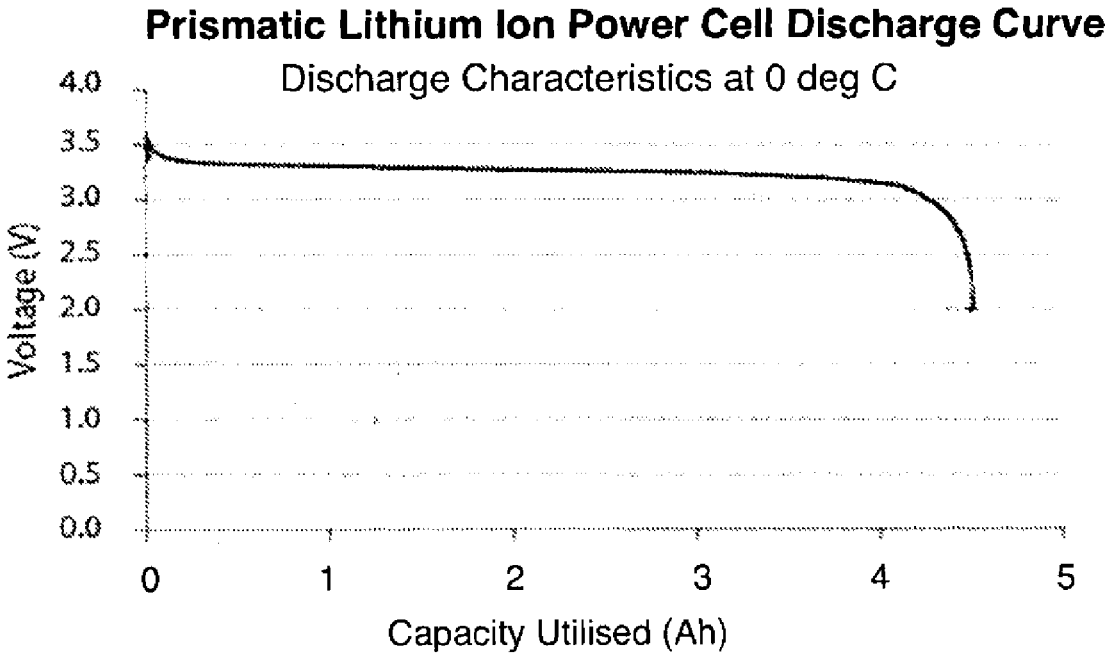
FIG. 29 is the discharge characteristic curve for an embedded Prismatic Lithium Ion power cell used to power the autonomous heated interlining in a particular embodiment at 0 degrees Celsius.

FIG. 29 is the "Discharge Curve" for the Prismatic Lithium Ion Power Cell as utilised in the autonomous heated interlining 4. The graph was produced by testing the aforementioned cell at an operating temperature of 0 degrees C., with a Constant Current (CC) load of 4.2 Amps (4200 ma) applied. The results were logged on a "Fluke® 289" True-rms Industrial Logging Multimeter (DMM) with "TrendCapture" facility. The voltage output of the cell was data logged at 1-minute intervals into the internal memory of the Fluke® 289 before exporting the logged data to specialist "FlukeView® Forms"

software via an I.R. to usb interface cable suitably attached to the Fluke® 289 DMM. The graph shown in FIG. 29 clearly demonstrates the extremely flat power discharge characteristics of the Prismatic Lithium Ion Power Cell (LiFeP04) embedded within the autonomous heated interlining 4. Further discussions of the implications of the discharge characteristics exhibited by the cell will be given later in the following paragraphs. A similar discharge curve would be expected to be produced by the alternative sealed abs encased cylindrical power cells of a similar chemistry type.

Figure 30:
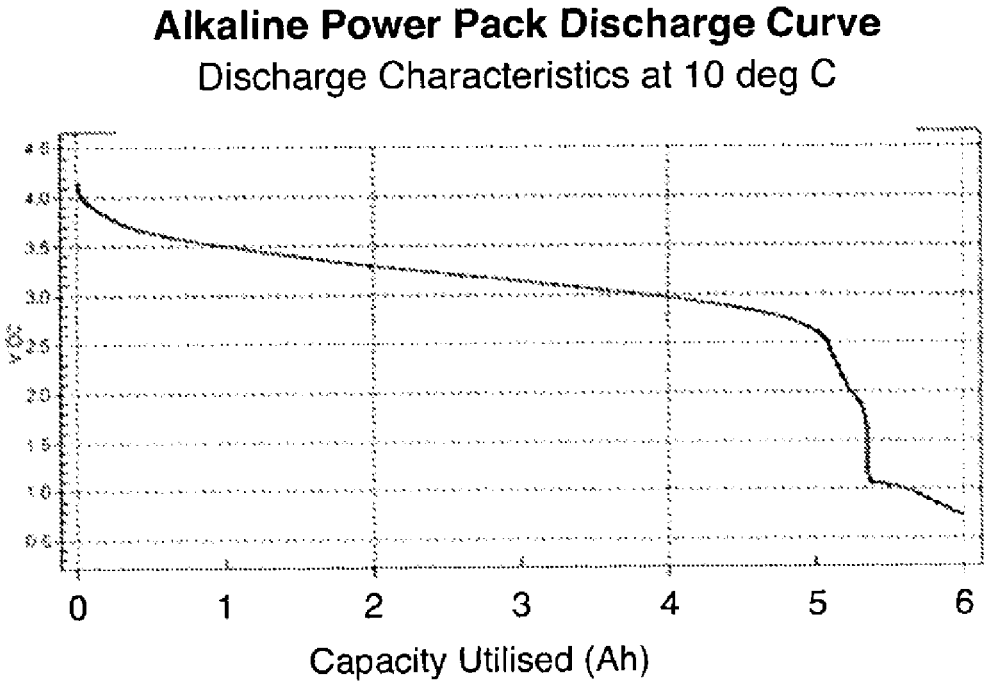
FIG. 30 is the discharge characteristic curve for Alkaline power cell used to power the autonomous heated interlining in a particular embodiment at 10 degrees Celcsius.

FIG. 30 is the "Discharge Curve" for an alternative power cell produced fundamentally from Alkaline based chemistry. The same testing equipment (Fluke® 289 DMM & FlukeView® Forms software) and procedure was used to produce this discharge curve graph. This test was conducted at an operating temperature of 10 degrees C., with a Constant Current (CC) load of 4.2 Amps (4200 ma) applied once again. The voltage output of the cell was data logged at 1-minute intervals into the internal memory of the Fluke® 289 before exporting the logged data to specialist "FlukeView® Forms" software as previously. The significantly steeper characteristics of this curve with appreciably higher (warmer) operating temperature will be discussed later in direct comparison to the Prismatic Lithium Ion Power Cell utilised in the autonomous heated interlining 4, or the alternative sealed encased cylindrical cells of the same chemistry type.

Figure 31:
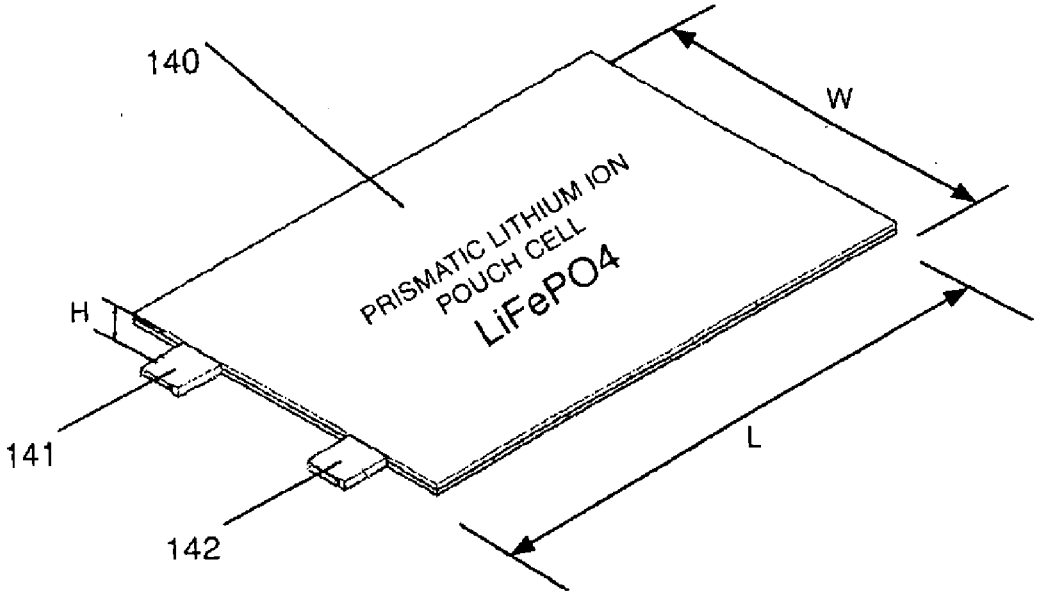
FIG. 31 shows a Prismatic Lithium Ion pouch cell 140 (LiFePO4) as would be embedded within the autonomous heated interlining in one embodiment for a power source.

FIG. 31 is a drawing showing the Prismatic Lithium Ion Pouch Cell 140, which in one embodiment of the autonomous heated interlining 4 is embedded within the felt interlining as depicted in FIGS. 1 and 2. The output terminal tabs (Anode and Cathode) 141 and 142 are clearly identifiable on one of the shorter sides of the pouch. The width (W) of the pouch, length (L) and height (H) will vary in direct proportion to the cell's output capacity (Ah). One particular embodiment, with a reduced cell output suitable for integration in a child's garment may be 120 mm (L) by 60 mm (W) by 10 mm (H) (4.7 inches by 2.4 inches by 0.4 inches respectively), having a rated output capacity of 6.3 Ah (6300 mAh). A plurality of varying cell (Prismatic Lithium Ion Pouch) sizes could be implement subject to a number of specific requirements and constraints including rated cell power (Ah), running time required, autonomous heated interlining heating output (total combined channel wattage) and space availability amongst a number of other variable factors which may need to be considered.

Figure 32:
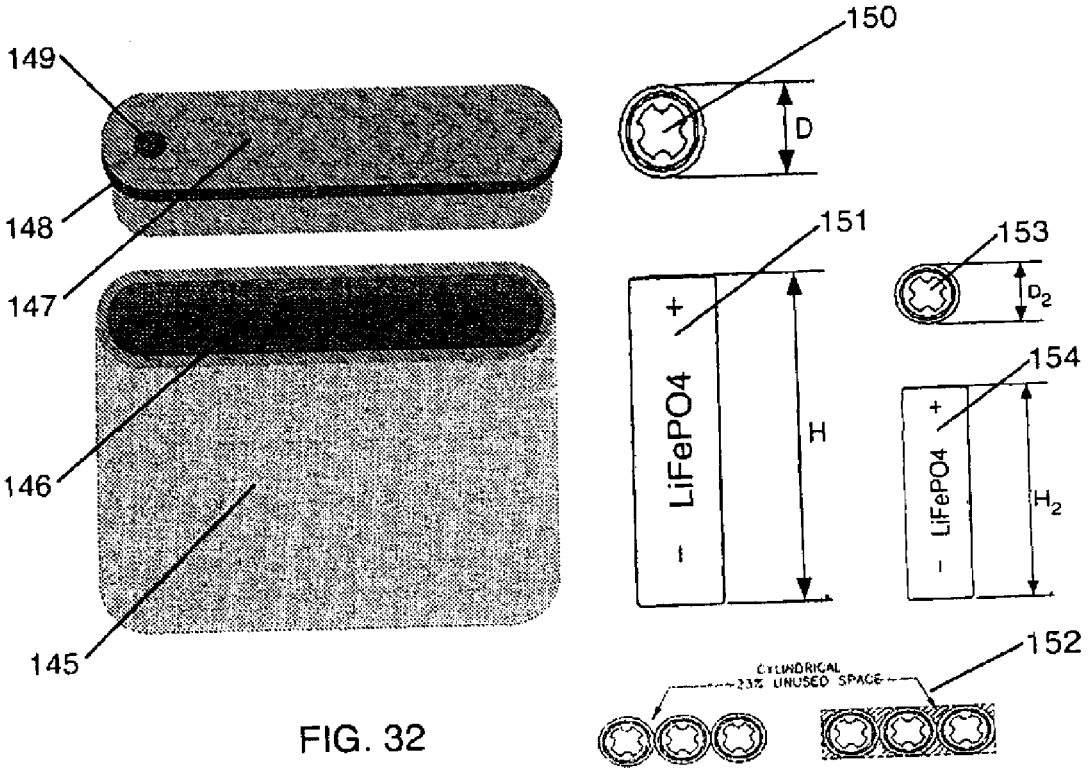
FIG. 32 shows an alternative possible embodiment for embedding cylindrical cells (151 and 154) within the autonomous heated interlining 4. The cell case 145 with sealed top 147 is produced from ABS material. A number of cylindrical cells would fit in the case and be connected in parallel.

FIG. 32 shows an alternative possible method of embedding Lithium Ion Cells (or similar chemistry cells) within the autonomous heated interlining. The figure shows one possible design for an ABS battery cell casing 145 with separate top 147 produced in ABS and sealed onto the main cell casing 145 with suitable sealant being used around the lower lip 148 of the casing top 147. The casing top has a suitably sized (diameter) exit hole 149 for the power leads to exit the sealed battery casing. The battery cell casing 145 has rounded edges to minimise wasted space associated with the use of cylindrical cells. A representation of wasted space associated with cylindrical cells is depicted graphically 152. A number of different cylindrical cells with varying diameters 150 and lengths 151 could be implemented subject once again, to a number of different factors, similar to those already discussed in the description of FIG. 33 above. One possible Lithium Ion cell embodiment (LiFeP04) 151 can be seen with a height (H) and a diameter (D). The diameter of the cell would be nominally smaller than the width of the ABS casing's internal wall dimension 146 so that the cells fit tightly into the casing and allow for some expansion during charging and any exothermic reaction, which may occur during high current drain situations such as full heat output of the autonomous heated interlining. An alternative smaller length ($H_2$) and diameter ($D_2$) cylindrical cell 154 is shown. This smaller cell size would be suitable in an embodiment for a child's autonomous heated interlining. The output voltage of the cell would be the same as the larger cell 151, but the Ah (amp/hour) capacity of the cell would be reduced in proportion to its reduction in size and volume ($H_2$ and $D_2$). The cells shown in FIGS. 31 and 32 are of Lithium Ion type chemistry, a plurality of other cell chemistry compositions exists such as Nanophosphate Lithium Ion, Ext Nanophosphate Lithium Ion, Nickel Cadmium, Nickel-metal Hydride, Lithium Ion, Lithium Ion Polymer and Lithium Iron Phosphate, amongst a variety of other known chemistry types. These alternative cell type compositions exist in a variety of formats such as prismatic pouches and cylindrical cell formats. The ABS casing 145 allows for any one of these types of chemistry to be used in any one specific embodiment of the autonomous heated interlining.

The invention relates to an autonomous, self-powered heated interlining which can be incorporated into virtually any form of structured lined garment. The following paragraphs give a detailed description of a number of possible embodiments for this invention, its design, construction and its manner of operation. The extremely flexible nature of this autonomous interlining 4 allows for an almost infinite number of possible embodiments; the embodiments shown in the figures and discussed herein are only a small representation of the immense number of possible wide ranging embodiments, and thus should not be considered to be exhaustive in any manner.

The autonomous, self-powered heated interlining 4 will for the remainder of this description be referred to as the autonomous interlining 4.

DETAILED DESCRIPTION

The autonomous interlining 4 has its own dedicated embedded power source; in the particular embodiments depicted in the figures, the embedded power source may consists of a plurality of Lithium Ion Prismatic Pouch Cells 1 or alternatively a plurality of cylindrical power cells with a similar chemistry base. The cylindrical cells would be encased in a sealed slim-line case made from ABS material; this cell type is depicted in FIG. 32. A plurality of Prismatic Pouch Cells 1 or cylindrical encased power cells 151 can be incorporated dependant upon the required output (heat) wattage of the autonomous interlining and the associated desired running time for said output (heat) wattage. The prismatic power cells and alternative cylindrical cells are not user (wearer) serviceable, and are actually completely embedded (sealed) within the construction of the autonomous interlining 4. The user (wearer) does not see or come into contact with the Lithium Ion Prismatic Pouch Cells 1 or alternative cylindrical cells at any time as they are embedded within sealed pouches/abs cases as represented in FIGS. 2 and 32 respectively. The user is never required to manipulate or service these power cells in any way. The prismatic and cylindrical cells have a charging life cycle (number of separate charges) in excess of 3200 charges, whilst still maintaining an 88% initial capacity charge state. The charging life cycle allows for a minimum life expectancy in excess of eight (8) years with normal to high usage levels on a regular daily basis. An experienced electronic engineer, if so required could replace the power cells, although given the long charging life cycle this is an unlikely scenario. The cells and the associated embedded charging method/circuitry will be discussed further in detail in the following description.

One embodiment sees the use of Nanophosphate Lithium Ion Prismatic Pouch Cells as depicted in FIG. 2. An alternative embodiment would be with the use of Lithium Ion Prismatic Pouch cells 140 or Lithium Ion cells (cylindrical) 151. The embedded cell's performance is improved by placing it within a sealed pouch located adjacent to the heating channels. It is a known fact that all battery cells performance, voltage and current output, is improved by ensuring that it operates at a higher than lower temperature. The operating temperature range of the Nanophosphate Lithium Ion Prismatic Pouch Cells is within the region of −30 degrees Celsius to +55 degrees Celsius. The cells 1 being placed embedded within the autonomous heated interlining 4, lined with an aluminium reflective cotton material 14 as clearly depicted in FIG. 2. This method of embodiment will ensure that at all times the cell's operating temperature will be maintained above 0 degrees Celsius and thus its performance will be greatly improved. The heating channels will actually warm the cells, and thus the performance and output of the cells will be improved in this particular embodiment. A possible alternative Prismatic Lithium Ion Pouch Cell that may be used is a "Nanophosphate EXT Lithium Ion" which handles extreme temperatures on both ends of the scale better, and thus has a better overall operating temperature range and performance.

This "EXT" type cell could be implemented for use in extreme cold weather environments. The use of "EXT" type cell chemistry would improve both the voltage and current output of the heated interlining 4 to both produce more heat output (wattage) and operate for a longer period of time between recharging cycles in colder operating conditions.

An alternative embodiment to the Prismatic Lithium Ion Pouch Cells 140 in FIG. 31, is to use a similar cell chemistry but in cylindrical format 151 as shown in FIG. 32 as previously discussed. The cylindrical cells would be wired in parallel and sealed in a slim-line case made from ABS material, manufactured with a sealing top 147. The number of cells wired in parallel will depend upon the required current output desired. One possible embodiment would be to have three cells encased together and wired in parallel with each other. Three cases (wired in parallel) of three cells would then be wired in series to produce an average, "off-load" combined voltage in the region of 9.6 volts. The total Ah (Amp/hour) capacity in this configuration would be in the order of 3.3 Ah (3300 mAh). The individual cell dimension would be in the order of 65 mm in height (H) and 18 mm in diameter (D) (2.5 inches by 0.70 inches respectively). A suitable cell for this particular embodiment would be an A123 SYSTEMS "APR18650-m1A", this cell being of a Lithium Ion Nanophosphate type chemistry structure. Alternatively, if a higher amp hour rating was required the "APR18650m1A" cell could be substituted for the "ANR26650-m1" which would in the same configuration of three cells in parallel connected three times in series to produce the same "off-load" combined voltage of 9.6 volts but at a higher 6.9 Ah (6900 mAh) total capacity. Numerous other types of different cells (types and chemistry) from a variety of manufacturers exist which could be implemented in this or similar planned embodiment subject to the voltage and amp hour requirements required. A plurality of other cell compositions exists such as Nanophosphate Lithium Ion, Ext Nanophosphate Lithium Ion, Nickel Cadmium, Nickel-metal Hydride, Lithium Ion, Lithium Ion Polymer and Lithium Iron Phosphate. These alternative cell type compositions exist in a variety of formats such as prismatic pouches and cylindrical cell formats. The voltage and Ah of these alternative cells vary considerably and the choice of cell for any particular embodiment will depend upon a number of factors such as heating output required (wattage) and total running time, amongst other factors such as weight.

The autonomous interlining also contains the embedded charging inductive coils and associated rectifier circuitry for the wireless charging system. A plurality of low power digital temperature sensors such as Dallas DS18B20 with the unique "1-Wire" interface are embedded within the autonomous interlining 4. The plurality of sensors are capable of individually reporting back to the embedded microcontroller with an accuracy of + or −0.5 degree Celsius for each of the measured regions. The sensors have a temperature measuring range of −55 degree Celsius to +125 degree Celsius. The particular embodiment shown in the figures depicts six Dallas DS18B20 digital temperature sensors being used to report directly back to the Microcontroller via a "1-Wire" digital interface. The sensors are configured to obtain power via the data input/output pin in "Parasite" mode so as to avoid running additional power feeds to the individual sensors. Alternative digital temperature sensors such Texas Instruments TMP102 with "SMBus™/Two-Wire" Serial Interface, could be implemented in place of the aforementioned Dallas DS18B20 digital sensors. A variety of other digital temperature sensors could be implemented if required. The fundamental purpose of whichever type of digital temperature sensor is implemented is to accurately report to the Microcontroller the temperature in the specific region being measured. The embodiment depicted in the figures demonstrates the use of six digital temperature sensors within three distinct regions ("A", "B" and "C"). A smaller or larger plurality of sensors and regions may be used dependant upon the embodiment (garment) the autonomous heated interlining 4 is being implemented within and the desired level of accuracy and functionality required.

The Microcontroller 10 monitors the temperature from each regional sensors (3, 5, 8, 9, 12 and 13) approximately once every second. The sensors each have a unique serial number that is used to identify the particular regional sensor when the temperature data is read via the "1-Wire" serial interface into the Microcontroller 10. An additional embodiment would allow for an extra sensor to be implemented for reading and reporting ambient temperature sent by the bidirectional communication channel. This would allow the Microcontroller to adjust the individual output levels to the MOSFETs in order to automatically regulate the autonomous heated interlining's heating channels in such a manner to accurately establish a temperature as set by the wearer or operator on the mobile telephone 120, laptop/pc/tablet/iPad®122 or remotely via an operator obtaining access to the autonomous heated interlining via the wireless router 121 connected to the internet (wide area network) or local network as depicted in FIG. 29. The temperature readings obtained from the plurality of sensors can be reported back to the wearer/operator via the bidirectional WiFi®/Bluetooth® Module that is embedded and interfaced to the Embedded Wireless Microcontroller 10. The temperature could then be displayed either numerically or graphically on the mobile telephone 120, laptop/pc/tablet/iPad® 122 or transmitted via the wireless router 121 connected to the Internet or local network. Accurate measuring and reporting of regional temperatures throughout the autonomous heated interlining 4 is of paramount importance to control and balance the temperature of the garment by utilising the received temperature data to control the Primary and Secondary regional heating channels within each of the regions individually. The system will also allow balanced temperature both throughout the plurality of individual regions and also vertically within each of the specific regions. The system will allow the Primary and Secondary heating channels within a specific region to be driven independently of each other should the embedded Microcontroller decide that due to a temperature mismatch within a specific region more heating output (wattage) is required in Primary channel of that region than the Secondary channel in the same region. The embedded Microcontroller may run the Primary channel at 80% duty-cycle whilst it runs the Secondary channel at 50% duty-cycle until it has established with a further later temperature reading, that the Primary and Secondary channel temperatures have now been appropriately balanced. The Microcontroller may also be programmed to balance the temperatures between the individual regions. The graph shown in FIG. 24 clearly indicates that in this particular embodiment measured the temperatures in regions "A", "B" and "C" are almost perfectly balanced with less than 0.3 degrees Celsius deviation between any of the individual aforementioned regions.

The autonomous interlining 4 also has an embedded 8-Bit Low Power Microcontroller 10 within its structure. Alternative Microcontrollers such as 4-Bit and 16-Bit could be implemented if required. The Microcontroller incorporates on-board system memory that contains custom written code for the control and monitoring of the heating system of the garment within which the autonomous interlining is embedded. The Microcontroller is interfaced to a WiFi®/Bluetooth® controller module via an UART interface or alternative interface such as I2C® (Wire) or a plurality of other types of available interfaces available on the embedded Microcontroller. The WiFi® module is a complete ultra low power embedded TCP/IP solution. The module offers stand alone embedded wireless 802.11 b/g/n networking. The module incorporates its own 2.4 GHz radio, processor, TCP/IP stack, real-time clock and UART (Universal Asynchronous Receiver Transmitter) interface. The WiFi®/Bluetooth® module allows the autonomous interlining 4 to be controlled from any device having a wireless connection and web browser or appropriate operating system with suitable Application (App with Serial data connection or similar communication protocol). A mobile phone 120 with WiFi® or a Laptop (computer/tablet/iPad®) 122 with WiFi® can easily be used to operate the autonomous interlining with ease. The wireless router 121, which may be connected to the Internet will allow for a remote operator to monitor, configure and operate the autonomous interlining 4 from a remote location (WAN) or a local location via a local area network (LAN). A detailed description of this will be given in the following paragraphs.

The final major components of the autonomous interlining will now be discussed prior to a full description with reference to the figures in order in which they appear. The autonomous interlining produces a highly consistent and uniform level of heat output (wattage) throughout the garment it is installed within. The particular embodiment depicted has a plurality of heating regions ("A", "B" and "C") to ensure equal distribution of heating throughout the complete garment to which it is fitted (embedded). The system incorporates both Primary and Secondary heating channels for each region. The Microcontroller monitors and controls (cycles) the Primary and Secondary channels in an automatic manner relative to the requirements the wearer or operator has selected via the wireless WiFi®/Bluetooth® controller (possibly mobile telephone 120, remote operator via wireless internet connected router 121 and/or laptop/pc 122). The desired heat output and hence level can be chosen and set either by utilising the web browser on the mobile telephone 120 or laptop/personal computer 122 (including tablet/iPad®) or by the use of a dedicated application on the mobile 120 or laptop/pc/tablet/iPad® 122 as required. The system is designed to operate currently with both IOS®, Android® devices and should be able to be functional with future similar devices that operate on Wireless and/or Bluetooth® protocols using similar operating systems and platforms.

The embodiment has both Primary and Secondary heating channels for all the regions. The fundamental purpose of the Primary and Secondary heating channels is to ensure a complete redundancy facility should either of the channels fail on a temporary or permanent basis whilst operating. The Primary and Secondary channels are individually controlled by separate MOSFET's that are driven and monitored directly from the Embedded Wireless Microcontroller 10. The software stored in the Microcontroller 10 monitors on a regular time basis, approximately once every second the current level being drawn by each of the individual heating channels in each of the regions, Primary and Secondary on an individual basis using a highly accurate "Hall" type sensor, with the output being logged by the Microcontroller. The Microcontroller 10 immediately reports to the operator if any one or more heating channels have failed or it has detected an operating anomaly in the previous operating period. The reporting of the failure is accomplished through the WiFi®'s/Bluetooth®'s bidirectional data transfer to the mobile telephone 120, wireless router 121 or laptop/pc/tablet/iPad® 122 the operator is using to control the device. The system is also programmed to automatically increase the heating output (duty-cycle) of the remaining channel in the region for which the other channel has failed in an attempt to maintain the previous heating output. The following situation demonstrates the above; if in one of the regions the Secondary channel has failed and prior to the failure occurring the heating level in that region for both channels was being controlled at a 40% duty-cycle, then the system would automatically increase the duty-cycle on the remaining channel (Primary) to 80% duty-cycle in order to obtain a similar level of heating output (wattage). The system would continue to monitor the failed channel and the remaining channels so that should the situation change in any way the Microcontroller 10 can take the appropriate action to attempt to maintain the set and desired heating level. The Microcontroller 10 can be considered to be intelligent in the manner in which it continually monitors and updates the heating duty-cycles of the regions for both the Primary and Secondary channels. The Primary and Secondary heating channels are at all times driven independently of each other to maximise control efficiency.

The autonomous, self-powered heated interlining 4 incorporates its own wireless inductive charging system. One embodiment, which demonstrates the nature and location of the wireless inductive charging coils 6 and system is depicted within FIG. 1. The user (wearer) or operator of the garment never has to give any direct thought to the in-depth charging management and process. One charging embodiment is by means of simply hanging the garment on a special hanger which has embedded wireless inductive charging coils (primary) contained within it. The special hanger, which is connected to a high frequency Alternating Current (AC) supply, charges the garment by wireless magnetic inductive means. The placement of the garment on the hanger allows the wireless inductive coils to magnetically couple. The circuitry is designed to ensure that near perfect Magnetic Resonance occurs between the primary coils in the hanger and the secondary pick-up coils embedded within the autonomous interlining 4. The autonomous interlining contains the required rectifier circuitry so as to convert the induced AC (Alternating Current) to DC (Direct Current) for charging of the embedded Prismatic Lithium Ion Power Cells 1 or alternative cylindrical cells 151. The Microcontroller 10 monitors and adjusts the charging cycle as required. The embedded Microcontroller 10, reports via WiFi®/Bluetooth® if the embedded Prismatic Lithium Ion Power Cells 1 or the embedded abs encased cylindrical cells 145 are reaching a critical level and require imminent charging.

The autonomous, self-powered heated interlining 4 is designed to be embedded within virtually any form of structured garment male or female, adult or child. The figures show a number of different embodiments, although the ones shown are by example only and are not in any manner exhaustive of the possible implementations. Although the interlining is primarily designed for use in outside cold weather environments; the system can also be efficiently utilised within indoor environments that are cold, and that cannot be heated from a practical point of view for any number of reasons. The system could be incorporated into life saving garments, and hence the Primary and Secondary heating channels and associated monitoring and redundancy control system are of particular importance in this type of embodiment. The system is designed to be extremely user friendly, and no knowledge of heating or electronics is required to run and manage the system's usage. The wearer or operator never needs to have any real mechanical or electrical aptitude to use the system (heated garments), and hence children and the elderly could use it with ease. The garment is simply taken from its charging hanger or alternative charging embodiment and then worn as any normal garment, but with the distinct advantage of heating output to keep the wearer warm or alive in extreme conditions.

The control and adjustment of the garment can either be undertaken from a mobile telephone 120 either with a web browser or the appropriate downloaded software application (App). The system can also be controlled from any desktop computer, laptop or tablet 122 (iPad® or other type). One embodiment that is envisaged is the use of the autonomous, self-powered heated interlining within a suitable garment for the elderly or infirm. The garment would allow the wearer to be kept warm at a constant temperature either inside a building or outside if required. Control and management of the garment in this particular embodiment may be undertaken by way of a laptop or desktop computer managed by a younger operator (nurse etc). The system would allow for any number of autonomous, self-powered heated interlinings 4 embedded within suitable garments to be controlled remotely at any one location as each is identified to the controlling software (App or web server) by way of a unique serial number identifier (or logged to a wearer's name). This embodiment within a medical field would allow the control to be established via a wireless router 121 either on an internal network (LAN) or connected to the Internet (WAN) to establish control. This form of embodiment ensures that each wearer is kept at a predefined temperature for his/her own comfort and health requirements. The heating efficiency and cost saving of this embodiment by heating individuals directly as apposed to large areas (buildings) would be significant, both from a financial point of view and the decreased Carbon footprint which would follow by reducing the average heating levels in the large buildings and more directly heating the individual in an efficient manner.

Referring to the figures once again, a comprehensive description of the embedded components of the autonomous, self-powered heated interlining 4 and its associated external accessories will now be given in detail.

FIG. 1, shows the main components of the autonomous interlining excluding the heating channels for clarity. The layout of one possible embodiment of the heating channels can be seen in FIG. 3; clearly identified are the Primary (20, 24 & 23) and Secondary (21, 25 & 22) heating channels in the three regions in this particular embodiment. Looking at item 1 (FIGS. 1 & 2) this is the Prismatic Lithium Ion power cell. The power cell is enclosed within a stitched pouch 2. The digital temperature sensors DS18B20 are shown at positions 3, 5, 8, 9, 12 and 13 which correspond to the different individual heating regions in this embodiment. The main felt interlining which supports all the components is shown by 4. A plurality of inductive charging coils 6 can be seen located together. These coils are of a planar nature and are connected to the embedded charging circuit. The circuit incorporates a capacitor wired in parallel to form a resonant tank circuit tuned to a specific frequency in the low Megahertz range. The output of the coils is fed into a full-wave bridge rectifier to produce the Direct Current (DC) power used for charging the embedded Prismatic Lithium Ion power cells (or encased cylindrical cells of similar chemistry composition) via a charging control chip such as a Linear Technology° "LTC4052" which is produced in an MSOP package for convenience of application. A range of alternative charging control chips exists that could also be used in this embodiment and similar embodiments to monitor and control the charging of the embedded cells. The stitch line 7 for stitching into a garment can be clearly seen. The stitching would follow the outer edge, with an appropriate seam allowance being implemented. The stitching would follow the facing, shoulder seam, back neck facing, shoulder seam and facing. Stitching along the lower horizontal edge 15 would not be necessary. The Microcontroller 10 and associated WiFi®/Bluetooth® module, located on the Microcontroller's circuit board can be seen with the surrounding pouch 11. The Microcontroller 10 would be embedded and stitched into pouch 11, thus being invisibly fixed into the autonomous heated interlining 4 felt. The Microcontroller's circuit would be encased within a slim-line, rectangular, high-impact rigid ABS enclosure. The enclosure would have gasket seals and rubber grommets to establish an IP54 rating. The ABS material could be substituted for a material with similar characteristic paying particular attention to its weight, which needs to be minimised as far as possible.

FIG. 2, shows an enlarged/exploded view of the power cell 1. The base felt 4; on the top of this base felt is a rectangular layer 14 of reflective insulating Rayon material at approximately 175 gms. The Rayon material is coated with a thin layer of Aluminium oxide. The Aluminium coating reflects any heat produced by the Lithium Ion Prismatic cell back towards the Prismatic cell. The heating channels (Primary and Secondary) stitched above the pouch covering 2 apply a degree of heating to the Prismatic cell embedded within the pouch. The layer of Aluminium coated Rayon material 14 situated between the interlining fabric 4 and the Prismatic Cell ensures that heat energy is reflected back into the cell so as to maximise its low temperature performance and longevity. The prismatic power cell 1 is encapsulated in a pouch with a felt covering 2 stitched in place and sealing it from the wearer, thus making it embedded. This particular embodiment has three Lithium Ion Prismatic cells embedded within the autonomous heated interlining 4 felt base. Alternative number of cells could be implemented subject to the heat output (wattage) and running time required.

FIG. 3 is the complete layout of the heating regions and Primary and Secondary heating channels. The Primary heating channel 20 on the left (wearer's right) is seen above the Secondary heating channel 21 on the left. The back region Primary heating channel 24 is above the Secondary heating channel 25. The right Primary heating channel (wearer's left)

23 is located above the Secondary heating channel 22. All of the heating channels (Primary/Secondary) are driven by separate MOSFET's. The heating channels are positioned in such a manner as to ensure an efficient and even distribution of heat throughout the garment it is installed (embedded) within. The embodiment shown in relation to the Primary and Secondary heating channels produces a total heat coverage of some ninety-seven (97%) percent relative to total area of the interlining. The MOSFETs are directly driven by the digital outputs of the Microcontroller using a digital logic level signal to produce a duty-cycle for each individual heating channel in isolation from the adjacent channels. The flexibility offered by this method of control allows for precise, adjustable stability of heat generated throughout the garment the autonomous interlining is embedded within. Duty-cycle can be programmed to be any value between 0.4% and 100% using a method of PWM (Pulse Width Modulation) output from the digital pins of the microcontroller chip, which is directly driving the MOSFETs. The output heating wattage of the autonomous heated interlining can thus approximately produce between 0.38 watts and 95 watts at maximum power.

FIG. 4 shows an enlarged view of the central back section of the autonomous heated interlining. The Primary heating channel 24 is shown located above the Secondary heating. The position (layout) of the heating channels are prepared (planned) in such a manner as to optimise heating area coverage and distribution. Approximately 98% of the total heated interlining area is evenly heated by the Primary and Secondary heating channels in the embodiment shown.

FIG. 5 shows a detailed view of the Primary and Secondary heating channel 20 and 21 respectively on the left side (wearer's right) of the autonomous heated interlining. Approximately 96% of the heated interlining area is evenly heated by the Primary and Secondary heating channels 20 and 21 in this embodiment. The Primary 20 and Secondary 21 heating channels are driven separately by the MOSFETs as described in detail above.

FIG. 6 shows a detailed view of the Primary and Secondary heating channels 23 and 22 respectively on the right side (wearer's left) of the autonomous heated interlining. Approximately 96% of the heated interlining area is evenly heated by the Primary and Secondary heating channels 23 and 22 in this embodiment. The Primary 23 and Secondary 22 heating channels are driven separately by the MOSFETs as described in detail above.

FIG. 7 shows a detailed view of the Primary and Secondary heating channels 23 and 22 respectively on the right side (wearer's left) of the autonomous heated interlining. The spacing between the Primary and Secondary channels can be varied to accommodate for longer length garments if the interlining needs to be fitted to a long fitting garment of some nature. One embodiment of the interlining for a garment with a length of approximately thirty (30) inches (76 cm) between back of neck seam and hem of garment would be with a spacing between Primary and Secondary heating channels 26 of approximately 1.25 inches to 1.5 inches (3.1 cm to 3.9 cm approximately). This length of garment with a distance of approximately 30 inches (76 cm) between back neck seam and hem would be considered to be a regular or standard length fitting, for a person of average height of approximately 5 ft 7 inches (1.70 m).

FIG. 8 shows an alternate embodiment of the Primary and Secondary heating channels 23 and 22 respectively on the right side (wearer's left) of the autonomous heated interlining. The spacing 27 between the Primary and Secondary heating channels in this embodiment has been increased to approximately 4.5 inches to 5 inches (11.4 cm to 12.7 cm). This increased spacing allows for the autonomous interlining to be increased in length and thus fitted into a garment with a length of approximately 36 to 38 inches (91 cm to 96.5 cm) between back neck seam and hem. The increased length would be considered to be a long or tall fitting garment. The actual distance between channels (Primary and Secondary) 27 can be adjusted as required to ensure the interlining fits the garment appropriately and produces full heat coverage (98% area approximately) from neck to the hem of the garment the interlining is fitted into. This length of garment with a distance of approximately 36 to 38 inches (91 cm to 96.5 cm) between back neck seam and hem would be considered to be a long or tall fitting, for a taller person with a height of approximately 1.85 m. The ability to alter the channel spacing in this manner, either smaller or larger, enables the autonomous heated interlining 4 to be fitted (embedded) into any specific embodiment (garment). Once the correct spacing has been calculated, the heating channel layout can be produced.

FIG. 9 shows one embodiment of a possible style garment 30 the autonomous heat interlining 4 can be fitted into. The digital temperature sensors DS18B20 are positioned in the different heating regions as shown by locations 3, 8, 9 and 13. The temperature sensors are configured in such a manner so that one of the sensors reads the heat generated by the Primary heating channel and the other by the Secondary heating channel. The Primary heating channels are read in this figure by 3 and 8. The Secondary heating channels are read in this figure by 13 and 9 respectively. The digital temperature data is transmitted using the "1-Wire" network to the Microcontroller. The type of sensor used in this embodiment, Dallas DS18B20 is only one of a variety of possible types of digital temperature sensors that could be embedded within the autonomous heated interlining 4 and connected (interfaced) with the Microcontroller for accurately measuring and logging the region's temperature.

FIG. 10 shows the position of the Primary and Secondary heating sensors for measuring temperature on the back of the garment 30. The Primary heating channel on the back is measured by the position of the Primary sensor 5 on the upper back and the Secondary heating channel is measured by the position of the Secondary sensor 12 on the lower back. The digital temperature data is transmitted using a 1-Wire network to the Microcontroller. The type of sensor used in this embodiment Dallas DS18B20 is only one of a variety of possible types of digital temperature sensors that could be embedded within the autonomous heated interlining and connected (interfaced) with the Microcontroller for accurately measuring and logging the region's temperature.

FIG. 11 shows the front view of one particular embodiment of a garment 30, which has the autonomous heated interlining embedded within it. The figure shows heating region "A" that is heated by the Primary and Secondary Heating channels. The Primary channel is marked as "Au" 41 on the figure and the Secondary heating channel is marked as "AL" 40. The heating in this region "A" can be monitored and accurately balanced/controlled by the Microcontroller and the information it receives from the digital temperature sensors. The Primary 41 and Secondary 40 circuits are continuously monitored for failure. The Microcontroller controls the heating cycles (duty-cycle) of each of the channels separately, should it be found that one circuit was to develop a fault the other circuit's duty-cycle (on period) would be increased in order to maintain the desired heating output (wattage). The Primary and Secondary channels are each separately controlled by their own MOSFETs. The gates of the MOSFETs are each individually driven by a discrete digital pin on the Microcontroller. Any fault in either the Primary or Secondary heating channels would be reported to the wearer/operator by sending a message via the WiFI®/Bluetooth® wireless communication module that is incorporated within the Microcontroller. If a fault in one of the heating channels (Primary or Secondary) was to resolve itself automatically, then the Microcontroller would again detect this and alter the duty-cycle (on/off period) in order to maintain the desired heating output (wattage) as originally set prior to the fault being detected. The operator would then be advised once again that the fault had rectified itself by an alert being sent to the controlling device either by wireless or Bluetooth® communication. The controlling device would either be a mobile telephone 120 and/or a laptop/pc/tablet/iPad® 122 as depicted in FIG. 27. A remote device could also be advised of the fault rectification (or other notifications/parameters) by the wireless router 121 which could be connected either to a local area network (LAN) or the Internet on wide area network (WAN). One possible embodiment utilising the wireless router 121 on a LAN or WAN would be to advise a carer/operator or medical professional of any change in the operating parameters of the autonomous heated interlining 4 embedded within the appropriate garment worn by the individual being cared for.

FIG. 12 shows the front view of one particular embodiment of a garment 30, which has the autonomous heated interlining within it. The figure shows heating region "C" which is heated by the Primary and Secondary heating channels. The Primary channel is marked as "Cu" 42 on the figure and the Secondary heating channel is marked as "CL" 43. The heating in this region "C" can be monitored and accurately balanced/controlled by the Microcontroller and the information it receives from the digital temperature sensors. The Primary 42 and Secondary 43 circuits are continuously monitored for failure. The Microcontroller controls the heating cycles (duty-cycle) of each of the channels separately, should it be found that one circuit was to develop a fault the other circuit's duty-cycle (on period) would be increased in order to maintain the desired heating output (wattage). The Primary and Secondary channels are each separately controlled by their own MOSFETs. The gates of the MOSFETs are each driven by a discrete digital pin on the Microcontroller 10. Any fault in either the Primary or Secondary heating channels would be reported to the operator by sending a message via the WiFI®/Bluetooth® wireless communication module that is incorporated within the Microcontroller. If a fault in one of the heating channels (Primary or Secondary) was to resolve itself automatically, then the Microcontroller would again detect this and alter the duty-cycle (on/off period) in order to maintain the desired heating output (wattage) as originally set prior to the fault being detected. The operator would then be advised once again that the fault had rectified itself by an alert being sent to the controlling device either by wireless or Bluetooth® communication. The controlling device would either be a mobile telephone 120 and/or a laptop/pc/tablet/iPad® 122 as depicted in FIG. 27. A remote device could also be advised of the fault rectification (or other notifications/parameters) by the wireless router 121 which could be connected either to a local area network (LAN) or the Internet on wide area network (WAN). One possible embodiment utilising the wireless router 121 on a LAN or WAN would be to advise a carer/operator or medical professional of any change in the operating parameters of the autonomous heated interlining 4 embedded within the appropriate garment worn by the individual being cared for.

FIG. 13 shows the front view of one particular embodiment of a garment 30, which has the autonomous heated interlining within it. The back of this garment is heated with a Primary 45 and Secondary 46 heating channels "Bu" and "BL" respectively. The back heating channels 45 and 46 are each driven and monitored separately. The Primary 45 and Secondary 46 channels are each driven by separate MOSFETs. The gates of the MOSFETs are individually driven by discrete digital outputs of the Microcontroller. The temperature of the Primary 45 and Secondary 46 channels are monitored by digital temperature sensors 5 and 12 respectively. The heating in this region "B" can be monitored and accurately balanced/controlled by the Microcontroller and the information it receives from the digital temperature sensors 5 and 12. The Microcontroller controls the heating cycles (duty-cycle) of each of the channels 45 and 46 separately, should it be found that one circuit was to develop a fault the other circuit's duty-cycle (on period) would be increased in order to maintain the desired heating output (wattage). The Primary and Secondary channels are each separately controlled by their own MOSFETs. The gates of the MOSFETs are each driven by a discrete digital pin on the Microcontroller 10. Any fault in either the Primary or Secondary heating channels would be reported to the operator by sending a message via the WiFI®/Bluetooth® wireless communication module that is incorporated within the Microcontroller. If a fault in one of the heating channels (Primary or Secondary) was to resolve itself automatically, then the Microcontroller would again detect this and alter the duty-cycle (on/off period) in order to maintain the desired heating output (wattage) as originally set prior to the fault being detected. The operator would then be advised once again that the fault had rectified itself by an alert being sent to the controlling device either by wireless or Bluetooth® communication. The controlling device would either be a mobile telephone 120 and/or a laptop/pc/tablet/iPad® 122 as depicted in FIG. 27. A remote device could also be advised of the fault rectification (or other notifications/parameters) by the wireless router 121 which could be connected either to a local area network (LAN) or the Internet on wide area network (WAN). One possible embodiment utilising the wireless router 121 on a LAN or WAN would be to advise a carer/operator or medical professional of any change in the operating parameters of the autonomous heated interlining 4 embedded within the appropriate garment worn by the individual being cared for.

FIG. 14 shows the back view of garment 30 as depicted in FIG. 13. The Primary 45 and Secondary 46 heating channel regions "BU" and "BL" respectively can be clearly identified in this figure. The heating and control of this area (45 and 46) is fully detailed above in FIG. 15's description.

FIG. 15 shows the front view of garment 30. The position of the embedded inductive charging coils 50 can clearly be seen in the collar area of the garment. This particular embodiment shows eight embedded inductive charging coils located within the back lining. An alternative embodiment with either a greater or smaller number of inductive charging coils could exist dependant upon the charging characteristics of the particular embodiment. The position of these embedded inductive coils is such that they will be in a direct vertical plane so as to closely magnetically couple with inductive coils embedded within the charging hanger used to charge the autonomous heated interlining 4 embedded power cells. A plurality of inductive charging coils 50 can be seen located together. These coils are of a planar nature and are connected to the embedded charging circuit. The circuit incorporates a capacitor wired in parallel to form a resonant tank circuit tuned to a specific frequency in the low Megahertz range. The output of the coils is fed into a full-wave bridge rectifier to produce the Direct Current (DC) power used for charging the embedded Prismatic Lithium Ion power cells (or alternative chemistry and/or cylindrical cells) via a charging control chip such as a Linear Technology° "LTC4052" which is produced in an MSOP package for convenience of application. A range of alternative charging control chips exists that could also be used in this embodiment and similar embodiments to monitor and control the charging of the embedded cells. This is one particular embodiment; the number, size and position of the planar inductive charging coils may vary subject to the charging requirements of the garment and its associated embedded Prismatic Lithium Ion power cells (or alternative chemistry and/or cylindrical cells 151). The charging coils may also be placed lower on the back of the garment 30 near the hem of the garment; this is depicted clearly in FIG. 16.

FIG. 16 is simply a rear view of garment 30 as shown in FIG. 15. The position of the embedded inductive charging coils can be seen in relation to the back of the garment. This is one particular embodiment; the number, size and position of the planar inductive charging coils may vary subject to the charging requirements of the garment and its associated embedded Prismatic Lithium Ion power cells (or alternative cylindrical cells 151 as previously detailed above). The charging coils 50 are position near the collar region of the garment; alternatively they may be positioned near the hem of the jacket 51 as clearly shown. The inset diagram of the autonomous heated interlining 4, also shows in this representation coils located near the collar region 50 and a further set of coils located near the hem 51. A variety of alternative embodiments may exist with the coils positioned anywhere in-between these two positions. The Primary charging coils must be positioned in a similar matching position in whatever embodiment is utilised so that efficient magnetic coupling can be produced between the Primary and Secondary coils.

FIG. 17 depicts a High-Visibility garment that contains the autonomous heated interlining. The garment will meet ANSI/ISEA 107-2010 Class 1, 2 or 3 specifications subject to the number and total area of high-visibility stripes applied. The arms of this embodiment have reflective stripes 80, 81, 86 and 87 applied. The main body of the High-Visibility garment has vertical reflective stripes 83 and 84 respectively applied. Horizontal reflective stripes 93, 88, 90 and 91 are stitched to the body. The heating regions of this embodiment include Primary and Secondary circuits for redundancy feature as found and discussed in the previous non High-Visibility garment embodiments already described. The wearer's left region is made up of the Primary channel area 85 and the Secondary channel area 89. The wearer's right region is made up of the Primary channel area 82 and the Secondary channel area 92. The Primary and Secondary channels are each separately controlled by their own MOSFETs. The gates of the MOSFETs are each driven by a discrete digital pin on the Microcontroller 10. Any fault in either the Primary or Secondary heating channels would be reported to the wearer/operator by sending a message via the WiFI®/Bluetooth® wireless communication module that is incorporated within the Microcontroller. If a fault in one of the heating channels (Primary or Secondary) was to resolve itself automatically, then the Microcontroller would again detect this and alter the duty-cycle (on/off period) in order to maintain the desired heating output (wattage) as originally set prior to the fault being detected. The operator would then be advised once again that the fault had rectified itself by an alert being sent to the controlling device either by wireless or Bluetooth® communication. The controlling device would either be a mobile telephone 120 and/or a laptop/pc/tablet/iPad® 122 as depicted in FIG. 27. A remote device (located locally or in remote location) could also be advised of the fault rectification (or other notifications/parameters) by the wireless router 121. The router 121 could be connected either to a local area network (LAN) or to the Internet on a wide area network (WAN) to notify remotely located devices and operators as detailed above.

FIG. 18 is the rear view of High-Visibility garment depicted in FIG. 17. The arms have reflective tape sewn on in positions 87, 86, 81 and 80. The vertical body stripes 83 and 84 match the front vertical stripes. Horizontal reflective stripes 88 and 90 match the front horizontal reflective stripes. The back of the garment has Primary and Secondary heated channels, 94 and 95 respectively. The autonomous heated interlining functions in an identical manner to the embodiment within a plain garment 30 as described in detail previously. This High-Visibility garment embodiment also has the embedded inductive charging coils in the same location as garment 30 previously described in detail. The charging method for this High-Visibility garment is identical in manner to the previously described garment 30. The garment is suspended on the charging hanger containing the embedded inductive charging coils and the embedded Prismatic Lithium power cells (or alternative cells as detailed above) are automatically charged as described before for garment 30. The charging circuitry for this particular embodiment operates in the same manner as the previous alternative embodiments detailed above.

FIG. 19 is a long fitting representation of the garment in FIG. 19. The garment conforms to ANSI/ISEA 107-2010 Class 1, 2 or 3 subject to the number and area of reflective stripes applied. This particular embodiment is around 12 inches (30.5 cm approx.) longer in fitting length than the standard or regular length garment depicted in FIG. 17. This long style High-Visibility garment can be fitted with the autonomous heated interlining 4. The increased distance between Primary and Secondary circuits 27 as depicted in FIG. 8 would be appropriate for this particular embodiment. The general operation of this longer length garment is identical to the previous embodiment of garment 30 and the regular length High-Visibility garment in FIG. 17. The charging procedure is also identical to the previous embodiments already discussed in detail.

FIG. 20 is simply an alternative embodiment of the High-Visibility garment with a reduced amount of reflective tape on the arms and body. The functioning of the autonomous heated interlining 4 within this garment is identical to previous embodiments previously discussed in detail. The charging method is also identical to previous embodiments.

FIG. 21 is yet a further alternative embodiment of a High-Visibility garment with reflective stripes on the arms only. The functioning of the autonomous heated interlining 4 within this garment is identical to previous embodiments previously discussed in detail. The charging method is also identical to previous embodiments.

FIG. 22 is a simple graphical representation of some alternative embodiments of the embedded autonomous heated interlining 4. Four alternative types of garment embodiments are shown. A High-Visibility Garment 60 is shown with a number of reflective stripes necessary to meet ANSI/ISEA 107-2010 Class 3 specifications. Garment 64 is an alternative embodiment; depicted is a unisex bomber style casual jacket with storm cuffs and a zip front. The next alternative embodiment is a ladies ski jacket 66 with fleece lining. The final embodiment depicted is a tuxedo jacket 65 with silk facing and fancy lining. All of the four embodiments shown are fitted with the same embedded autonomous heated interlining 4 as represented in the centre of the figure. Although the garment embodiments have varied considerably from a High-Visibility ANSI/ISEA 107-2010 Class 2 or 3 working jacket 60 to an evening wear tuxedo jacket 65, they all have the same embedded autonomous heated interlining incorporated within them. The garments all function in an identical manner with reference to the autonomous heated interlining. The four embodiments shown in FIG. 22 are simply a minor representation of the possible embodiments; the autonomous heated interlining 4 can be incorporated into virtually any structured lined garment as desired. The infinite flexibility of its central design implementation allows for almost limitless possibilities with regards its embodiments into structured lined garments. The embodiments represented so far have been based on adult sized garments; once again the design flexibility will allow for easy embodiment into children's sized garments of a structured lined nature as the adults. The choice of Prismatic Lithium Ion cells for children's garments would be based on smaller capacity cells with a lower power capacity. Alternatively, cylindrical cells 151 could be used in place of Prismatic Pouch Cells as depicted in FIG. 32. The heat output (wattage) would also be reduced for children's garments on a proportional basis relative to the heated surface area. The Microcontroller and associated components would not differ for a child's garment other than the aforementioned Prismatic Lithium Ion cells. The magnetic inductive charging circuitry would be the same except for a reduction in the diameter of the planar inductive coils embedded within the autonomous interlining 4; due to the smaller size and surface area of the complete interlining structure for a child's size garment embodiment.

FIG. 23 as previously discussed details the system and method by which the Regional Primary and Secondary Heating Channels are driven. The embodiment depicted has three regions, each one having two digital temperature sensors monitoring the specific regions temperature. The digital temperature sensors 3,13-5,12 and 8,9 feed the information into the embedded Microcontroller. The Microcontroller uses this information along with the settings of the wearer/operator and other sensory data to output PWM (Pulse Width Modulation) signals to the regional inputs of the EMBEDDED MOSFET HEATING CIRCUIT CONTROLLER (EMHCC). The output of the EMHCC is on an individual regional basis and drives the Primary and Secondary Heating Channels of the specific individual region of the autonomous heated interlining. The Microcontroller monitors closely the temperature consistency within each specific region and if necessary alters the individual PWM output of either the Primary or Secondary (or both) heating channels in order to balance the heat distribution in the particular region and across all the regions if the control settings match this requirement. The system also monitors a region for a specific failure of the Primary or Secondary circuit and accordingly adjusts the remaining functioning heating circuit in an attempt to maintain the previously set heating output (wattage). The Microcontroller also calculates and adjusts the PWM signals of the various individual regions so as to balance the temperature throughout the regions and thus the garment subject to the settings of the wearer/operator. FIG. 24 clearly shows that throughout a temperature rise from approximately 22.3 degrees C. to 32.3 degrees C. over a time period of some seven-hundred seconds (eleven minutes forty-seconds) the Microcontroller an associated components managed to maintain a balanced temperature throughout all the regions (A, B and C) of a garment to within 0.3 degrees C. The Redundancy monitoring and control system previously described is also of fundamental importance; the Microcontroller is constantly monitoring all the regional heating channels for total failure or lesser anomalies. The Microcontroller immediately attempts to adjust PWM heating channel control signals to correct the situation and reports any problems to the wearer/operator as previously described.

FIG. 24 is an actual graph from data generated (output) from an autonomous heated interlining 4 fitted to a High-Visibility garment as depicted in FIG. 17. The graph shows temperature accurately measured with "K"-type thermocouples implanted into the three regions "A", "B" and "C" during a timed tested that lasted for approximately 700 seconds (11 minutes 40 seconds). The garment output for the duration of the test was set at 50% power setting (50% duty-cycle on and 50% duty-cycle off), being approximately in the region of forty-eight (48) watts. The graph shows the temperature rise from approximately 22.3 degrees Celsius to approximately 32.3 degrees Celsius during the full run-time of the test. The three graph traces shown, clearly indicate that the three regions remained within approximately + or −0.3 degrees Celsius of each other at all times during the duration of the test. The excellent temperature consistency is due to the digital monitoring and control of each of the Primary and Secondary heating channels in the regions by the embedded Microcontroller, its associated control circuitry and digital temperature sensors.

FIG. 25 shows the Microcontroller's PWM outputs heating control signals for Region C and the associated outputs produced. The Microcontroller is receiving inputs from the two regional temperature sensors of region C, 8 and 9. The Microcontroller is using this information and control information from the wearer/operator received by WiFi® or Bluetooth® to drive the Primary and Secondary Heating Channels of region C with a 50% PWM signal on both the Primary and Secondary Heating Channels. The 50% PWM signals would generate an output of approximately 25 Watts in region C. The next FIG. 26, demonstrates a failure occurring in the Primary Heating Channel of region C and the effect of this if the wearer/operator doesn't alter the settings.

FIG. 26 demonstrates the scenario of the Primary Heating Channel in region C developing a fault that completely prohibits it from functioning. The Microcontroller senses the complete failure of the Primary Heating Channel C by sensing no current draw on that particular heating region's channel ("C"—Primary). The current draw of all heating channels are monitored on a regular basis with the use of a "Hall" sensor as previously detailed. The failure of a heating circuit and the corresponding reduction in current draw is notified to the Microcontroller by making an "Interrupt" call; this call is then used to alter the PWM control signals as follows. The PWM signal of heating channel "C"—Primary is automatically set to 0% duty-cycle, effectively turning the "C"—Primary channel off and isolating it. The Microcontroller then calculates that it must alter the output of the Secondary Heating Channel in region C to 100% duty-cycle to produce an almost identical output, to that that was previously being generated (approximately 25 watts) prior to the failure of the "C"—Primary Channel. The Microcontroller continues to monitor the Primary Channel (and also Secondary Channel), should the Microcontroller detect that the "C"—Primary Channel works again then it will accordingly re-adjust the PWM outputs of the Primary and Secondary back to 50% PWM on each channel to deliver the same output as originally set. The Microcontroller periodically, once every 5 seconds, checks failed channels by switching the failed channel on at 100% duty-cycle for a short period (1 second) and monitoring the current draw with the "Hall" sensor to see if the channel has re-instated itself. The Microcontroller apportions around twenty percent (20%) of its total processing time to monitoring for errors and taking the necessary course of action to attempt to rectify them if possible and notify the wearer/operator.

FIG. 27 is a graphical representation of the bidirectional communication that can take place between a mobile telephone 120, wireless router 121, computer 122 and a garment 63 with the autonomous heated interlining 4 embedded within it. The autonomous heated interlining can communicate in a bidirectional manner with the controlling device, mobile telephone 120 wireless router 121 and laptop 122 or similar WiFi®/Bluetooth® enabled device such as a pc/tablet/iPad®. The embedded Microcontroller within the autonomous heated interlining 4 has its own WiFi®/Bluetooth® module incorporated to allow it to communicate in a bidirectional manner with the device being used to control the garment (with autonomous heated interlining embedded within it). The bi-directional manner of communication allows the Microcontroller to report any statistical data or faults to the operator or wearer of the garment. The garment can transmit information such as battery level, heat levels in the different regions, ambient heat level and any faults should they occur. The autonomous heated interlining (garment) can warn the operator/wearer if the embedded power cells are going to require an imminent charge and the current charge levels of the Prismatic Lithium power cells (or alternative chemistry and cell type 151 as detailed previously). The operator/wearer can alter heat levels for all regions or individual regions as required. An operator with a single laptop or computer with WiFi® or Bluetooth® could monitor and control a large number of garments (autonomous heated interlinings) with ease. A number of garments could also be controlled and monitored from a tablet device (Android® or other operating system), or IOS® based device such as an IPad®. Monitoring and control of a large number of autonomous heated interlinings could occur in a medical environment simultaneously and seamlessly by one operator. Each and every autonomous heated interlining would have its own unique identification code as well as its own unique "MAC" address for the WiFi®/Bluetooth® connection. The unqiue "MAC" address could be linked in the software to a wearer's (patients) name for ease of control and monitoring.

FIG. 28 is the components system chart. The chart details the main embedded electrical components and the communication channels between the components. The system chart depicts six key components that exist within the autonomous heated interlining 4. The central component is the embedded Microcontroller that incorporates wireless and Bluetooth® modules along with memory (RAM/ROM) and interfaces. The Microcontroller communicates with a number of other components, as its function is primarily the central control component. The system chart also depicts the embedded Prismatic Lithium Ion cells (or similar chemistry and/or embedded cylindrical cells 151) and the embedded inductive charging coils and associated circuitry to charge the cells. This includes a LTC4052 Linear Technology® Lithium Ion Battery Charger Chip in msop package or similar and a full-wave bridge rectifier. Embedded temperature sensors within each region communicate directly with the Microcontroller via a "1-wire" interface (or alternative interface) on a regular interval. Further sensors to measure and communicate ambient temperature may also be present in some of the embodiments. The Microcontroller drives via PWM (Pulse Width Modulation) on separate digital pins the embedded MOSFETs. The MOSFETs Gates are directly driven with the PWM digital signal from the embedded Microcontroller. The MOSFETs drive the Primary and Secondary heating channels in each of the regions as directed by the Microcontroller. The embodiment shown depicts three regions with each having a Primary and Secondary channel within each of the said regions. Alternative embodiments with larger or smaller number of regions and channels may exist and each of the channels would be driven as before by MOSFETs linked to a PWM enabled output from an embedded Microcontroller. The embedded Microcontroller communicates via wireless or Bluetooth® protocol with the operator and/or wearer using a mobile telephone 120, laptop/pc/tablet/iPad® 122 or wireless router 121 as depicted in FIG. 27. The operator may be in a remote location to the wearer as the wireless router 121 can be connected to a local area network or Internet (LAN or WAN respectively). All the devices can communicate in a bidirectional manner with the embedded Microcontroller either via wireless or Bluetooth® protocol. The autonomous heated interlining 4, can report a variety of information back to the wearer/operator such as fault detection and rectification. Regional temperature (of the garment) and ambient temperature along with the status of the charge level of the embedded Prismatic Lithium Ion cells (or similar chemistry and/or embedded cylindrical cells 151) can also be communicated back to the wearer/operator. Heat level settings can be set either individually by region or set as a whole for the garment. The wearer/operator either uses a dedicated interface via a web browser or a specifically written "App" (Application) for the Android®/Apple IOS® to control and monitor the garment fitted with the autonomous heated interlining 4.

FIG. 29 shows the Discharge Curve of the Prismatic Lithium Ion Power Cell at 0 degrees C. The graph demonstrates the extremely flat discharge characteristics of the Lithium Ion Cell being used in this particular embodiment. The benefit of the flat nature of this curve is that the autonomous heated interlining is able to maintain a constant heating output for longer without intervention from the Microcontroller having to alter the PWM signals to adjust for a reduction in heating output as the driving voltage decreases over time. The extremely flat nature of the discharge curve for this type of battery chemistry means that higher output heating levels (wattage) can be maintained for longer periods of time. The curve also remains flat at lower temperatures, which is an obvious benefit for a garment being worn in cold environments. The embedded nature of the cell as shown in FIG. 2, along with the cell being heated by the Primary and Secondary heating channels in the area along with the with the heat reflective cotton lining 14 of the pouch ensures maximum heating output (wattage) and the flattest discharge curve possible. These factors ensure the maximum heat output (wattage) and running time possible from embedded cells in all conditions, including severe climatic conditions below zero degrees centigrade.

FIG. 30 shows an alternative type of cell chemistry, which is often used, in basic heated garments. The sheer discharge curve of this cell chemistry, along with its poor low temperature performance gives rise to a quick and steady drop in heat output of the garment over a shorter total running time. The cells are often located in a pocket in the outer garment, which is not heated, and thus the cold environment further reduces output voltage and capacity of the cells, thus drastically reducing heating output (wattage) and running time. This cell chemistry is popular because of its wide availability and reasonable cost, but it offers considerably reduced performance and longevity over other types of available chemistry some of which have been detailed above.

FIG. 31 simply shows the graphical representation of a Prismatic Lithium Pouch Cell 140. The Anode and Cathode connectors can be seen 141 and 142 respectively. This Prismatic cell is embedded within the autonomous heated interlining as depicted in FIG. 2. The cell is embedded within a sealed pouch 2, which is lined with a heat reflective cotton lining 14 to ensure the maximum heat output from the Primary and Secondary heating channels is reflected back into the cell to aid the cells output in cold environments. The cell is embedded and sealed in a pouch so that wearer/operator never has to manipulate or service the cell throughout its considerable service lifetime.

FIG. 32 shows an alternative possible embodiment for embedding cylindrical cells within the autonomous heated interlining. The cell case 145 with sealed top 147 produced from ABS material. A number of cylindrical cells would be connected in parallel and would fit into case 145 in the top opening 146. A detailed description of this alternative battery casing and type has been given above in detail. This method of cell implementation has a number of benefits as it offers a good degree of flexibility in the possible type, nature and size of cells that can be incorporated.

The invention claimed is:

1. A autonomous heated interlining comprising:

at least four heating channels that are configured to be capable of individual control and isolation from each other, wherein each heating channel of at least a majority of said heating channels are configured for control with its direct adjacent heating channel to offer a redundancy failure control system, adjacent heating channels being configured as primary and secondary channel pairs;

a plurality of embedded prismatic power cells or a plurality of embedded abs battery cell casings containing power cells;

at least four embedded inductive charging coils distributed throughout the interlining structure connected to a charging control circuit responsible for charging and charging management of the embedded power cells;

a embedded microcontroller permanently affixed in a receptacle incorporating wireless connectivity and connected to the plurality of heating channels via a embedded mosfet heating controller circuit;

a plurality of embedded temperature sensors located in corresponding regions configured to sense primary and secondary heating channel outputs which are interfaced to the embedded microcontroller.

2. An autonomous heated interlining as in claim 1, wherein the primary and secondary heating channel pairs are configured in such a manner so as to allow the distance between the primary and secondary heating channels to be configured in such a way as to allow for varying lengths of the autonomous heated interlining structure as required to fit within a variety of different length embodiments.

3. An autonomous heated interlining as in claim 1, wherein the primary and secondary heating channel pairs are individually driven by the embedded microcontroller and the embedded mosfet heating controller circuit so as to enable the redundancy failure system that should it be detected that either the primary or secondary channel of a pair has failed the remaining functioning channel output is increased in an attempt to counter the failure and maintain the desired heating output.

4. An autonomous heated interlining as in claim 1, wherein the plurality of primary and secondary heating channels are distributed throughout the autonomous heated interlining in such a manner as to form distinct individually controllable heated regions within the garment to which the autonomous heated interlining will be embedded, each of the separate regions being independently controllable as required and the heating levels in each region being individually controlled or switched on and off as required;

the distinct individually controllable heated regions each having the redundancy facility as offered by the primary and secondary heating channels controlled by the embedded microcontroller and associated embedded mosfet heating controller circuit.

5. An autonomous heated interlining as in claim 1, wherein the plurality of embedded prismatic power cells comprises of a embedded prismatic power cell comprising of a chemistry of ext nanophosphate lithium ion.

6. An autonomous heated interlining as in claim 1, wherein the plurality of embedded prismatic power cells comprises of a embedded prismatic power cell comprising of a chemistry of nanophosphate lithium ion.

7. An autonomous heated interlining as in claim 1, wherein the plurality of embedded prismatic power cells comprises of a embedded prismatic power cell comprising of a chemistry of lithium ion.

8. An autonomous heated interlining as in claim 1, wherein the plurality of embedded prismatic power cells comprises of a embedded prismatic power cell comprising of a chemistry of nickel-cadmium.

9. An autonomous heated interlining as in claim 1, wherein the plurality of embedded prismatic power cells comprises of a embedded prismatic power cell comprising of a chemistry of nickel-metal hydride.

10. An autonomous heated interlining as in claim 1, wherein the plurality of embedded prismatic power cells comprises of a embedded prismatic power cell comprising of a chemistry producing a suitable power output.

11. An autonomous heated interlining as in claim 1, wherein the plurality of abs battery cell casings containing power cells comprises of embedded cylindrical power cells encased in a abs battery cell case comprising of a chemistry of ext nanophosphate lithium ion.

12. An autonomous heated interlining as in claim 1, wherein the plurality of abs battery cell casings containing power cells comprises of embedded cylindrical power cells encased in a abs battery cell case comprising of a chemistry of nanophosphate lithium ion.

13. An autonomous heated interlining as in claim 1, wherein the plurality of abs battery cell casings containing power cells comprises of embedded cylindrical power cells encased in a abs battery cell case comprising of a chemistry of lithium ion.

14. An autonomous heated interlining as in claim 1, wherein the plurality of abs battery cell casings containing power cells comprises of embedded cylindrical power cells encased in a abs battery cell case comprising of a chemistry of lithium ion polymer.

15. An autonomous heated interlining as in claim 1, wherein the plurality of abs battery cell casings containing power cells comprises of embedded cylindrical power cells encased in a abs battery cell case comprising of a chemistry of lithium iron phosphate.

16. An autonomous heated interlining as in claim 1, wherein the plurality of abs battery cell casings containing power cells comprises of embedded cylindrical power cells encased in a abs battery cell case comprising of a chemistry of nickel-cadmium.

17. An autonomous heated interlining as in claim 1, wherein the plurality of abs battery cell casings containing power cells comprises of embedded cylindrical power cells encased in a abs battery cell case comprising of a chemistry of nickel-metal hydride.

18. An autonomous heated interlining as in claim 1, wherein the plurality of abs battery cell casings containing power cells comprises of embedded cylindrical power cells encased in a abs battery cell case comprising of a chemistry producing a suitable power output.

19. The autonomous heated interlining as claimed in claim 1, wherein said interlining is configured within a high-visibility jacket.

20. The autonomous heated interlining as claimed in claim 1, wherein said interlining is configured within a high-visibility jacket conforming to ANSI/ISEA 107-2010 Class 1 or latest equivalent of said standard.

21. The autonomous heated interlining as claimed in claim 1, wherein said interlining is configured within a high-visibility jacket conforming to ANSI/ISEA 107-2010 Class 2 or latest equivalent of said standard.

22. The autonomous heated interlining as claimed in claim 1, wherein said interlining is configured within a high-visibility jacket conforming to ANSI/ISEA 107-2010 Class 3 or latest equivalent of said standard.

23. The autonomous heated interlining as claimed in claim 1, wherein said interlining is configured within a long length high-visibility jacket.

24. The autonomous heated interlining as claimed in claim 1, wherein said interlining is configured within a long length high-visibility jacket conforming to ANSI/ISEA 107-2010 Class 1, 2 or 3 by increasing the distance between the primary and secondary heating channels or the latest equivalent of said standard.

25. The autonomous heated interlining as claimed in claim 1, wherein said interlining is configured within a uni-sex body warmer.

26. The autonomous heated interlining as claimed in claim 1, wherein said interlining is configured within a male lightweight fashion jacket.

27. The autonomous heated interlining as claimed in claim 1, wherein said interlining is configured within a male fashion jacket.

28. The autonomous heated interlining as claimed in claim 1, wherein said interlining is configured within a male jacket.

29. The autonomous heated interlining as claimed in claim 1, wherein said interlining is configured within a female lightweight fashion jacket.

30. The autonomous heated interlining as claimed in claim 1, wherein said interlining is configured within a female fashion jacket.

31. The autonomous heated interlining as claimed in claim 1, wherein said interlining is configured within a female jacket.

32. The autonomous heated interlining as claimed in claim 1, wherein said interlining is configured within a male padded fashion jacket.

33. The autonomous heated interlining as claimed in claim 1, wherein said interlining is configured within a female padded fashion jacket.

34. The autonomous heated interlining as claimed in claim 1, wherein said interlining is configured within a male suit jacket.

35. The autonomous heated interlining as claimed in claim 1, wherein said interlining is configured within a female suit jacket.

36. The autonomous heated interlining as claimed in claim 1, wherein said interlining is configured within a male dinner suit jacket.

37. The autonomous heated interlining as claimed in claim 1, wherein said interlining is configured within any structured lined male jacket.

38. The autonomous heated interlining as claimed in claim 1, wherein said interlining is configured within any structured lined female jacket.

39. The autonomous heated interlining as claimed in claim 1, wherein said interlining is configured within any structured uni-sex upper torso garment.

40. The autonomous heated interlining as claimed in claim 1, wherein said interlining is configured within any structured lined child's jacket.

41. The autonomous heated interlining as claimed in claim 1, wherein said autonomous heated interlining is configured to transfer data in a uni-directional or bi-directional manner via wireless communication with a mobile telephone to the embedded microcontroller and associated embedded circuitry.

42. The autonomous heated interlining as claimed in claim 1, wherein said autonomous heated interlining is configured to transfer data in a uni-directional or bi-directional manner via wireless communication with a wireless router connected to a local area network or wide area network to the embedded microcontroller and associated embedded circuitry.

43. The autonomous heated interlining as claimed in claim 1, wherein said autonomous heated interlining is configured to transfer data in a uni-directional or bi-directional manner via wireless communication with a laptop computer to the embedded microcontroller and associated embedded circuitry.

44. The autonomous heated interlining as claimed in claim 1, wherein said autonomous heated interlining is configured to transfer data in a uni-directional or bi-directional manner via wireless communication with a personal computer to the embedded microcontroller and associated embedded circuitry.

45. The autonomous heated interlining as claimed in claim 1, wherein said autonomous heated interlining is configured to transfer data in a uni-directional or bi-directional manner via wireless communication with a tablet device to the embedded microcontroller and associated embedded circuitry.

* * * * *

UNITED STATES PATENT AND TRADEMARK OFFICE

CERTIFICATE OF CORRECTION

PATENT NO. : 8,779,331 B2
APPLICATION NO. : 13/675792
DATED : July 15, 2014
INVENTOR(S) : Michael Benn Rothschild It is certified that error appears in the above-identified patent and that said Letters Patent is hereby corrected as shown below:

On the Title Page

Delete the title page and substitute the attached title page therefor.

In the Drawings

Delete drawing sheets 1-15 and substitute the attached drawing sheets 1-22 therefor.

Signed and Sealed this
Nineteenth Day of August, 2014

Michelle K. Lee

Michelle K. Lee
*Deputy Director of the United States Patent and Trademark Office*

(12) United States Patent
Rothschild

(10) Patent No.: US 8,779,331 B2
(45) Date of Patent: Jul. 15, 2014

(54) AUTONOMOUS HEATED INTERLINING

(71) Applicant: Michael Benn Rothschild, London (GB)

(72) Inventor: Michael Benn Rothschild, London (GB)

(73) Assignee: Michael Benn Rothschild, London (GB)

( * ) Notice: Subject to any disclaimer, the term of this patent is extended or adjusted under 35 U.S.C. 154(b) by 0 days.

(21) Appl. No.: 13/675,792

(22) Filed: Nov. 13, 2012

(65) Prior Publication Data

US 2014/0131341 A1 May 15, 2014

(51) Int. Cl.
*H05B 1/00* (2006.01)
*H05B 1/02* (2006.01)

(52) U.S. Cl.
CPC ..... *H05B 1/0227* (2013.01)
USPC ..... 219/209

(58) Field of Classification Search
USPC ..... 219/209, 600–677, 211
See application file for complete search history.

(56) References Cited

U.S. PATENT DOCUMENTS

| | | | | |
|---|---|---|---|---|
| 7,816,632 | B2 * | 10/2010 | Bourke et al. | 219/635 |
| 2008/0083720 | A1 * | 4/2008 | Gentile et al. | 219/211 |
| 2010/0107657 | A1 * | 5/2010 | Vistakula | 62/3.5 |
| 2011/0215086 | A1 | 9/2011 | Yeh | |

FOREIGN PATENT DOCUMENTS

| | | |
|---|---|---|
| CA | 2007128129 | 11/2007 |
| EP | 0612291 | * 4/1996 |

* cited by examiner

*Primary Examiner* — Dana Ross
*Assistant Examiner* — Joseph Iskra

(57) ABSTRACT

A autonomous heated interlining including embedded prismatic power cells, microcontroller with WiFi and Bluetooth connectivity and wireless inductive charging. The interlining offers a complete and simple integrated heating solution for any structured lined jacket, with wireless control and charging. The interlining heating system offers both primary and secondary heating channels for the inbuilt redundancy feature. The autonomous heated interlining offers digital monitoring and wireless control with automatic heating redundancy management in case of primary or secondary heating channel failures, thus always ensuring heating output for the wearer. The wearer operates the autonomous heated interlining from his/her mobile telephone, tablet/iPad® or laptop/pc with a web browser or simple dedicated application wirelessly.

45 Claims, 22 Drawing Sheets

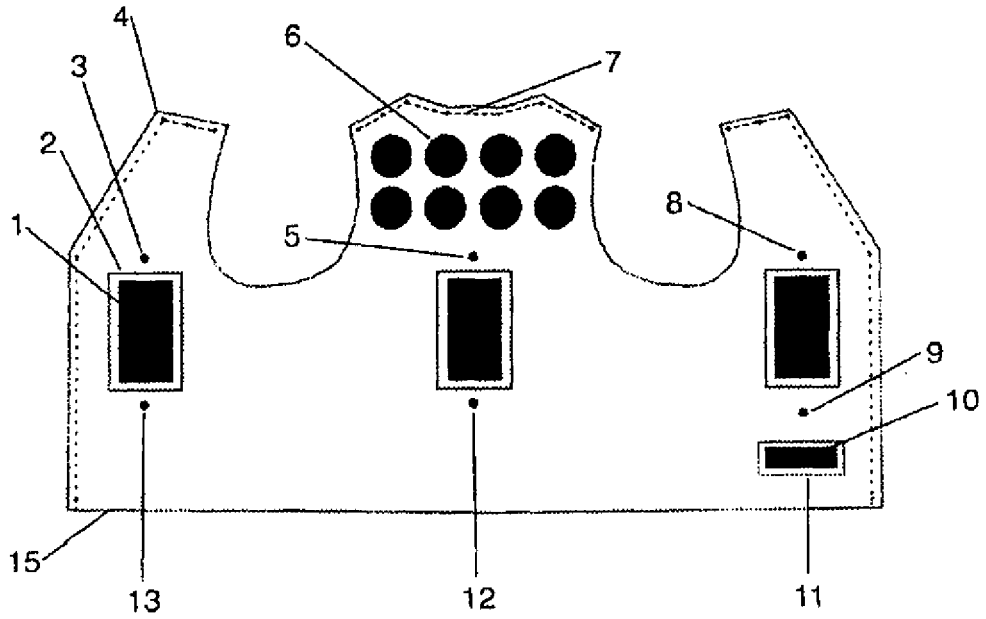

Bidirectional data transfer via WiFi® or Bluetooth® to Embedded Wireless Microcontroller Controller in garment